US009970211B2

(12) United States Patent
Konduc et al.

(10) Patent No.: US 9,970,211 B2
(45) Date of Patent: May 15, 2018

(54) GUIDE RAILS FOR MOBILE DRILLING RIG

(71) Applicant: Dreco Energy Services ULC, Edmonton (CA)

(72) Inventors: Kameron Wayne Konduc, Edmonton (CA); Yury Lugovtsov, Ekaterinburg (RU)

(73) Assignee: Dreco Energy Services ULC, Edmonton (CA)

( * ) Notice: Subject to any disclaimer, the term of this patent is extended or adjusted under 35 U.S.C. 154(b) by 0 days. days.

(21) Appl. No.: 15/498,572

(22) Filed: Apr. 27, 2017

(65) Prior Publication Data

US 2017/0335591 A1 Nov. 23, 2017

Related U.S. Application Data

(60) Provisional application No. 62/330,508, filed on May 2, 2016.

(51) Int. Cl.
*E04H 12/00* (2006.01)
*E04H 12/34* (2006.01)
(Continued)

(52) U.S. Cl.
CPC ..... *E04H 12/34* (2013.01); *E21B 7/02* (2013.01); *E21B 15/003* (2013.01); *E21B 12/00* (2013.01); *E21B 15/00* (2013.01)

(58) Field of Classification Search
CPC ..... E02B 17/04; E21B 19/00; E21B 19/02; E21B 19/06; E21B 19/24; B65G 65/00; B66C 19/00
See application file for complete search history.

(56) References Cited

U.S. PATENT DOCUMENTS 295,172 A 3/1884 Hill
1,557,070 A 10/1925 Logue
(Continued)

FOREIGN PATENT DOCUMENTS

CN 101476312 7/2009
CN 102536267 7/2012
(Continued)

OTHER PUBLICATIONS

*Blue Calypso, LLC* v. *Groupon, Inc.* (CAFC, Mar. 1, 2016) (46 pages).

(Continued)

*Primary Examiner* — Jason C Smith

(57) ABSTRACT

A system for supporting and transporting a drilling rig. The system may have a pair of rails, wherein each rail has a plurality of rail segments and a plurality of connections between the segments. Moreover, each connection may have a plurality of interlocking lugs secured with a shear pin and opposing abutment faces, such that each connection may be configured to transfer moment and shear forces between adjacent rail segments. In some embodiments, the each rail segment may be configured to support a point load of up to 1000 kips. In some embodiments, each rail segment may have a protruding connector and a receiving connector, and each connection may include the protruding connector of a first segment and the receiving connector of a second segment. In some embodiments, a portion of each connection may be configured for tension loading and another portion may be configured for compression loading.

20 Claims, 48 Drawing Sheets

(51) Int. Cl.

| | |
|---|---|
| ***E21B 7/02*** | (2006.01) |
| ***E21B 15/00*** | (2006.01) |
| *E21B 12/00* | (2006.01) |

(56) References Cited

U.S. PATENT DOCUMENTS 2,420,803 A * 5/1947 Tobin ..... E21B 15/003 248/647
2,657,017 A 10/1953 Curtis
2,663,375 A 12/1953 Caldwell
2,781,108 A 2/1957 Selberg et al.
3,063,509 A * 11/1962 Guier ..... E21B 19/00 173/151
3,099,323 A 7/1963 Kelley
3,228,151 A 1/1966 Woolslayer et al.
3,271,915 A 9/1966 Woolslayer
3,327,997 A 6/1967 Zenke
3,333,377 A 8/1967 Woolslayer et al.
3,477,235 A * 11/1969 Hester, Jr. ..... E02B 17/00 175/5
3,483,933 A 12/1969 Dyer
3,774,780 A 11/1973 Buffington
3,807,109 A 4/1974 Jenkins et al.
3,828,513 A 8/1974 Vanderklaauw
3,922,825 A 12/1975 Eddy et al.
3,942,593 A 3/1976 Reeve et al.
3,949,818 A 4/1976 Russell
3,977,542 A 8/1976 Stolzer
4,068,487 A * 1/1978 Pease ..... B63B 35/4413 104/35
4,081,932 A * 4/1978 Armstrong ..... B66C 23/52 173/28
4,128,229 A 12/1978 Elliston
4,135,340 A 1/1979 Cox et al.
4,269,395 A 5/1981 Newman et al.
4,290,495 A 9/1981 Elliston
4,366,650 A 1/1983 Patterson
4,375,241 A 3/1983 Gallon
4,375,892 A 3/1983 Jenkins et al.
4,421,447 A * 12/1983 Gudgel ..... E21B 19/02 166/77.52
4,587,778 A 5/1986 Woolslayer et al.
4,823,870 A 4/1989 Sorokan
4,831,795 A 5/1989 Sorokan
4,837,992 A * 6/1989 Hashimoto ..... E21B 15/00 52/118
4,885,893 A 12/1989 Wasterval, Jr. et al.
5,216,867 A 6/1993 Wasterval, Jr. et al.
5,407,302 A * 4/1995 Springett ..... E02B 317/00 405/196
5,492,436 A 2/1996 Suksumake
5,954,453 A 9/1999 Thomas
5,997,217 A * 12/1999 Verret ..... B63B 35/003 114/265
6,045,297 A 4/2000 Voorheese et al.
6,141,870 A 11/2000 McDermott et al.
6,171,027 B1 * 1/2001 Blankestijin ..... E02B 17/021 175/5
6,412,576 B1 7/2002 Meiners
6,634,436 B1 10/2003 Desal
6,729,804 B1 * 5/2004 Roodenburg ..... E02B 35/44 175/5
6,994,171 B2 2/2006 Orr et al.
6,997,647 B2 * 2/2006 Bennett, Jr. ..... E02B 317/021 405/201
7,360,589 B2 4/2008 Moncus
7,410,326 B2 * 8/2008 Morrison ..... E02B 17/0004 405/196
7,584,809 B1 9/2009 Flud
7,765,749 B2 8/2010 Paladis
7,931,076 B2 4/2011 Ditta et al.
8,047,303 B2 11/2011 Donnally et al.
8,287,212 B2 * 10/2012 Roper ..... E02B 17/00 405/196
8,468,753 B2 6/2013 Donnally et al.
8,516,751 B2 8/2013 Konduc et al.
8,549,815 B2 10/2013 Donnally et al.
8,555,564 B2 10/2013 Wasterval
8,556,003 B2 10/2013 Souchek
9,091,126 B2 7/2015 Thiessen et al.
9,109,399 B2 8/2015 Murr et al.
9,212,778 B2 12/2015 Winter
2002/0185319 A1 12/2002 Smith
2003/0102166 A1 6/2003 Jortveit
2003/0147726 A1 * 8/2003 Tolmon ..... E21B 19/155 414/21
2003/0172599 A1 9/2003 Frink
2004/0151549 A1 * 8/2004 Roodenburg ..... E02B 17/021 405/201
2004/0211572 A1 10/2004 Orr et al.
2004/0211598 A1 10/2004 Palidis
2004/0240973 A1 12/2004 Andrews et al.
2006/0180564 A1 * 8/2006 Keppel ..... B66C 9/08 212/330
2007/0272762 A1 * 11/2007 Click ..... E01B 11/54 238/14.05
2008/0257607 A1 10/2008 Winter
2009/0000218 A1 * 1/2009 Lee ..... E21B 15/00 52/123.1
2009/0188677 A1 7/2009 Ditta et al.
2009/0283324 A1 * 11/2009 Konduc ..... E21B 7/02 175/57
2009/0321135 A1 12/2009 Vora
2010/0150660 A1 6/2010 Nadarajah et al.
2010/0260555 A1 * 10/2010 Foo ..... E21B 15/003 405/201
2010/0303586 A1 12/2010 Hankins et al.
2011/0072737 A1 3/2011 Wasterval
2011/0114386 A1 5/2011 Souchek
2011/0280104 A1 11/2011 McClung, III
2012/0047820 A1 3/2012 Donnally et al.
2012/0138327 A1 6/2012 Sorokan et al.
2012/0201632 A1 8/2012 Yater et al.
2012/0304553 A1 * 12/2012 Konduc ..... E21B 15/00 52/112
2013/0168516 A1 7/2013 Winter
2013/0180186 A1 7/2013 Konduc et al.
2013/0269268 A1 10/2013 Thiessen et al.
2013/0305632 A1 11/2013 Rivera et al.
2013/0340572 A1 12/2013 Flusche
2013/0340998 A1 12/2013 Flusche
2013/0341036 A1 12/2013 Flusche
2014/0041855 A1 2/2014 Rodgers
2014/0090333 A1 4/2014 Vogt
2014/0158342 A1 6/2014 Smith et al.
2014/0259985 A1 9/2014 Petrello et al.
2014/0262518 A1 9/2014 Reddy et al.
2014/0262519 A1 9/2014 Pertello et al.
2014/0262520 A1 9/2014 Petrello et al.
2014/0263685 A1 9/2014 Yustus et al.
2014/0270974 A1 * 9/2014 Seng ..... E21B 15/003 405/201
2014/0270975 A1 * 9/2014 Seng ..... E21B 15/003 405/201
2015/0090450 A1 * 4/2015 Thiessen ..... E21B 15/003 166/285
2015/0152690 A1 6/2015 Sorokan et al.
2015/0184466 A1 7/2015 Rivera, Sr. et al.
2015/0218891 A1 8/2015 Padira et al.
2016/0052441 A1 2/2016 Korach
2016/0369523 A1 12/2016 Konduc et al.
2017/0241126 A1 * 8/2017 Konduc ..... E04B 1/3522

FOREIGN PATENT DOCUMENTS

| | | |
|---|---|---|
| RU | 1770509 | 10/1992 |
| RU | 81516 | 3/2009 |
| RU | 96904 | 8/2010 |
| RU | 137053 | 1/2014 |
| SU | 1461858 | 2/1989 |
| SU | 1686052 | 10/1991 |
| WO | 2004094762 | 11/2004 |

(56) References Cited

FOREIGN PATENT DOCUMENTS

| | | |
|---|---|---|
| WO | 2008114064 | 9/2008 |
| WO | 2009002189 | 12/2008 |
| WO | 2010132174 | 11/2010 |

OTHER PUBLICATIONS

Extended European Search Report for European Patent Application No. 12791970.2, dated Sep. 2, 2015 (8 pages).
Formal Response to Written Opinion of the International Searching Authority for PCT/CA2012/000510, filed Mar. 14, 2013 (4 pages).
In re Wolfensperger, 302 F.2d 950 (CCPA 1962), dated May 18, 1962 (8 pages).
International Search Report and Written Opinion for related PCT Application No. PCT/CA2015/000432 dated Sep. 24, 2015 (9 pages).
International Search Report and Written Opinion for related PCT Application No. PCT/CA2016/000229 dated Oct. 26, 2016 (9 pages).
International Search Report and Written Opinion for related PCT Application No. PCT/US2014/037431, dated Oct. 7, 2014 (17 pages).
International Search Report and Written Opinion for related PCT Application No. PCT/US2016/019507 dated Dec. 21, 2016 (17 pages).
National Oilwell Varco Elevator/Substructure/Setback Cross-Section drawing dated Jul. 24, 1979 (1 page).
National Oilwell Varco Mast & Substructure Erection Sequence drawing dated Sep. 15, 1979 (1 page).
Response to Extended European Search Report for EP 12791970.2, filed Mar. 9, 2016 (35 pages).
Written Opinion of the International Searching Authority for PCT Application No. PCT/CA2012/000510, dated Aug. 24, 2012 (3 pages).
International Search Report and Written Opinion for related PCT Application No. PCT/US2017/021095, dated Jun. 12, 2017 (16 pages).
Photographs of typical Uralmesh train rig, Sep. 2012 (2 pages).
Photograph of Uralmesh rig, Jul. 2014 (1 page).

* cited by examiner

GUIDE RAILS FOR MOBILE DRILLING RIG

CROSS-REFERENCE TO RELATED APPLICATIONS

The present application claims priority to U.S. Provisional Patent Application No. 62/330,508, filed on May 2, 2016, entitled Guide Rails for Mobile Drilling Rig, the content of which is hereby incorporated by reference herein in its entirety.

FIELD OF THE INVENTION

The present application is generally directed to mobile drilling operations. Particularly, the present application relates to rail assemblies for guiding a mobile drilling rig. More particularly, the present application relates to modular rail assemblies with moment resisting connections for distributing applied loads associated with drilling operations.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In some drilling operations, a drilling rig may be a mobile drilling assembly configured to move along guide rails or tracks. For example, a pair of parallel guide rails may support the drilling assembly. The guide rails may typically be hundreds of feet long, and may support and transport the drilling assembly. The drilling assembly may be guided along the rails between well locations. The guide rails may generally be arranged on the ground surface and over or near a well drilling location, such that the rails may support the drilling assembly during drilling operations. Each guide rail may be composed of several segments of track joined together.

The guide rails may generally be subjected to various loads, such as loading from the weight of the mobile drilling assembly, including drilling equipment, drilling fluid system equipment, and other equipment. The guide rails may further be subjected to loading caused by drilling operations, environmental loads such as wind loading on the drilling assembly, and/or other loads. Further, the guide rails may be subjected to contact stresses from the mobile drilling assembly moving over the rails via a roller moving system, for example. In some drilling locations, such as in particular remote locations or particular geographic areas, the ground surface may be generally soft or deformable. For example, in areas having a prevalence of permafrost, drilling operations may cause permafrost to thaw, and thus may lead to shifting, settling, or compression of soils. Such soft or deformable ground surfaces may have a relatively low bearing pressure, and thus may be unsuitable as a foundation for high loading over relatively small surface areas. Loading on guide rails from a mobile drilling apparatus, drilling operations, environmental factors, or other loads may cause the guide rails to experience bending, shear, and/or deflection forces. For example, where a drilling apparatus is arranged on a particular segment of guide rails, that particular segment may experience high bending, shear, and deflection forces. Particularly where the ground surface beneath the rails may be relatively soft or malleable, these bending, shear, and/or deflection forces may cause segments of guide rails to deform, sink into the ground, and/or disconnect at the joints. Deformed, sinking, and/or disconnected rail segments can lead to a tipping hazard for the drilling apparatus as well as reduced space below the drill floor for drilling operations.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a system for supporting and transporting a drilling rig. The system may have a pair of rails, wherein each rail has a plurality of rail segments and a plurality of connections between the segments. Moreover, each connection may have a plurality of interlocking lugs secured with a shear pin and opposing abutment faces, such that each connection may be configured to transfer moment and shear forces between adjacent rail segments. In some embodiments, the each rail segment may be configured to support a point load of up to 1000 kips. In some embodiments, each rail segment may have a protruding connector and a receiving connector, and each connection may include the protruding connector of a first segment and the receiving connector of a second segment. In some embodiments, a portion of each connection may be configured for tension loading and another portion may be configured for compression loading.

The present disclosure, in one or more embodiments, further relates to a rail for supporting and transporting a drilling rig, the rail having a plurality of rail segments. Each rail segment may have a base layer, a first intermediary layer, a second intermediary layer, and a rail assembly guide.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1A:
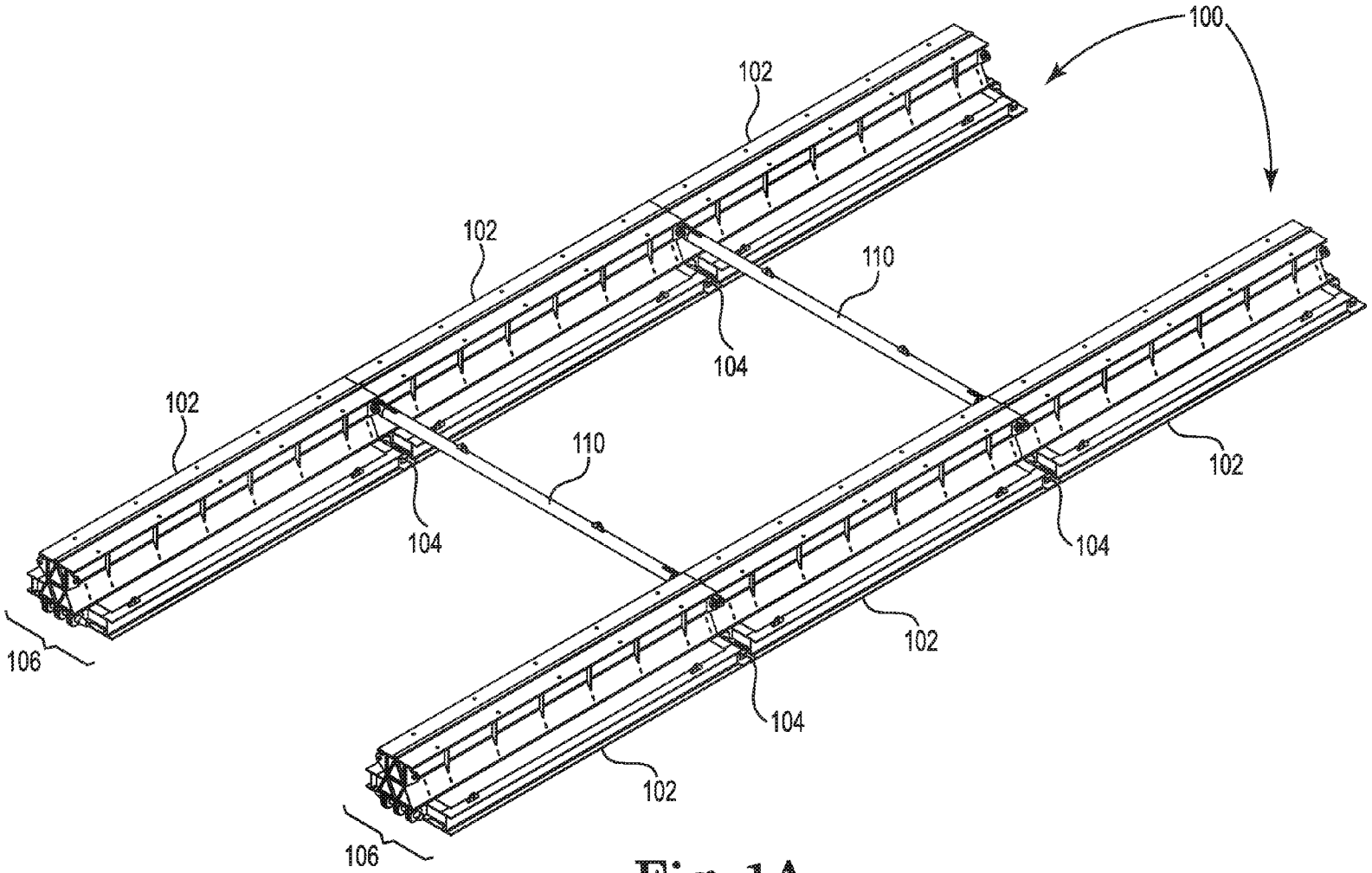
FIG. 1A is a perspective view of a pair of rails of the present disclosure, according to one or more embodiments.
Figure 1B:
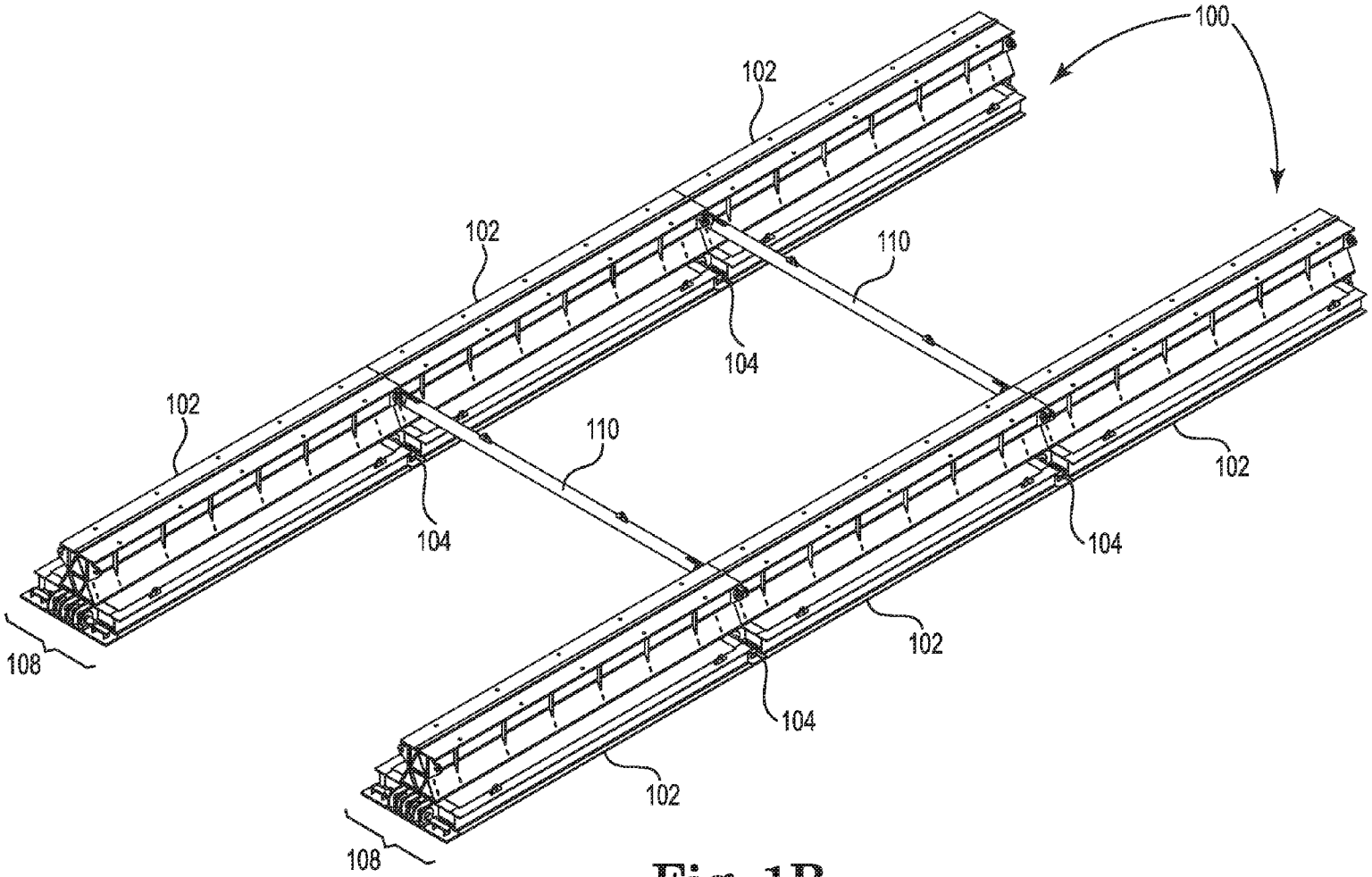
FIG. 1B is another perspective view of the pair of rails of FIG. 1A, according to one or more embodiments.

The present disclosure relates to modular guide rails for transporting a mobile drilling rig. The individual segments of the guide rails may be coupled using moment resistant connections, such that loading applied to one rail segment may be resisted by multiple rail segments. In this way, internal shear forces and bending moment forces caused by applied loading may be distributed among multiple rail segments, so as to mitigate deformation, sinking, and/or decoupling of the segments as a result of the loading. Moreover, guide rails of the present disclosure may have a higher moment of inertia than conventional rails Turning now to FIGS. 1A and 1B, a pair of guide rails 100 for a mobile drilling assembly is shown. The rails 100 may extend for hundreds of meters in some embodiments, allowing for a mobile drilling assembly to be transported over the rails and perform drilling operations. As shown, each parallel rail 100 may be modular, comprising a plurality of shorter segments 102. Each segment 102 may have a length of between about 3 and about 20 meters in some embodiments. Particularly, each segment 102 may have a length of between about 5 and about 15 meters in some embodiments. More particularly, each segment 102 may have a length of between about 8 and about 10 meters in some embodiments. In other embodiments, each segment 102 may have any suitable length. Moreover, in some embodiments, segments 102 may have differing lengths. The segments 102 of a rail 100 may couple together at connection points 104 on either end of each segment. As will be further described below, the connection points 104 may be moment resistant connections in some embodiments, capable of transferring bending and shear forces between coupled segments 102. In some embodiments, the rails 100 may have a series of crossbars 110 connecting the rails at intervals. The crossbars 110 may be configured to maintain proper separation distance between the parallel rails 100 in view of shifting soils or other movement, such that the rails may be spaced to accommodate a drilling rig assembly. In some embodiments, as shown in FIGS. 1A and 1B for example, the crossbars 110 may be arranged at connection points 104.

Figure 2A:
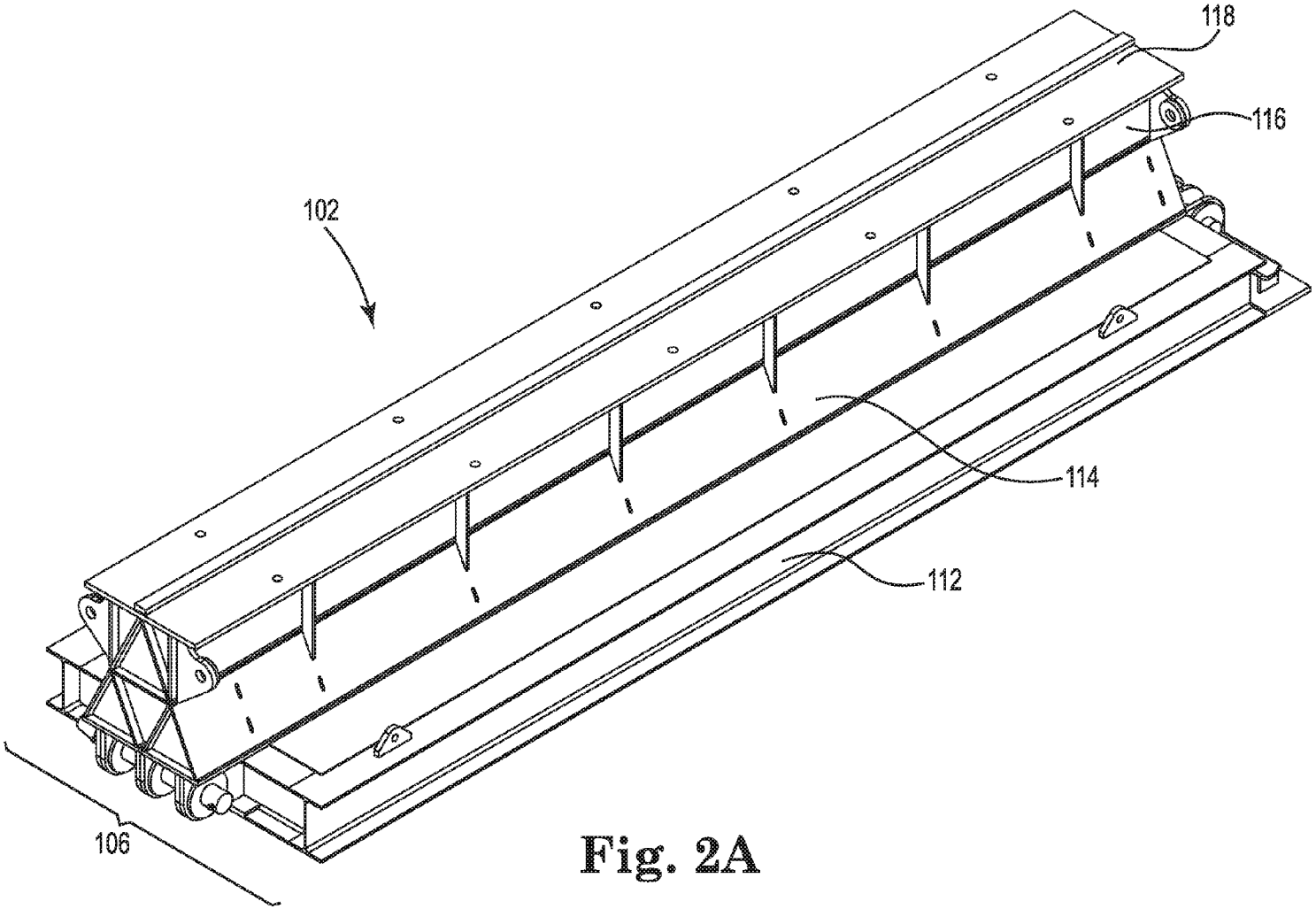
FIG. 2A is a perspective view of a rail segment of the present disclosure, according to one or more embodiments.
Figure 2B:
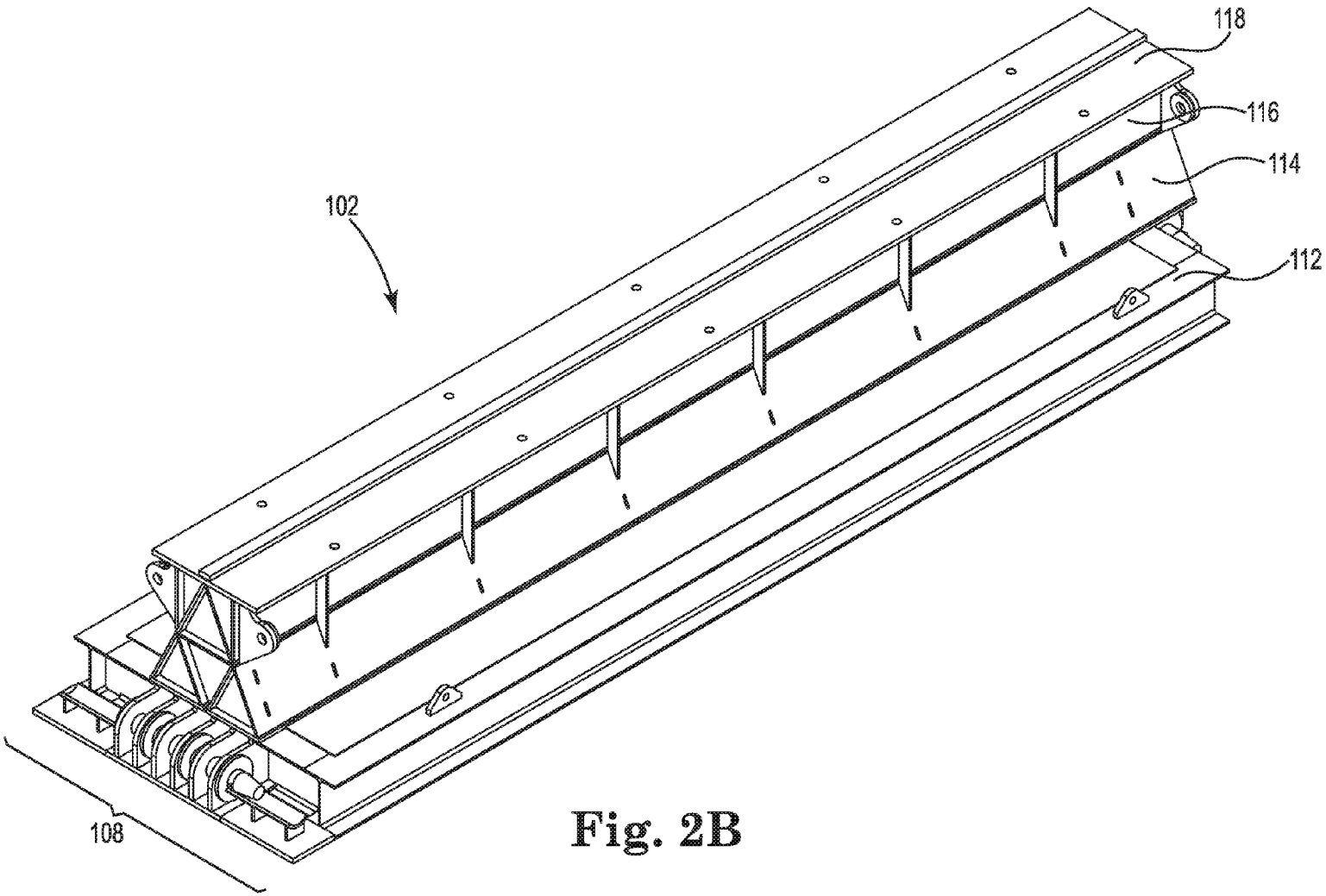
FIG. 2B is another perspective view of the rail segment of FIG. 2A, according to one or more embodiments.

Turning now to FIGS. 2A and 2B, a rail segment 102 of the present disclosure is shown. Each segment may be configured to carry and distribute load from drilling when present and receive and distribute load from adjacent segments when the rig is positioned on adjacent segments. In some embodiments, each rail segment 102 may have a protruding end 106 and a receiving end 108, configured for coupling to adjacent segments. In this way, each connection point 104 may include a protruding end 106 and a receiving end 108 provided by adjacent segments. The segment 102 may include a base layer 112, a first intermediary layer 114, a second intermediary layer 116, and a roller assembly guide 118. The base layer 112 may be arranged on the ground surface, a pad surface, or other surface on which the rails 100 are arranged. The base layer 112 may generally be configured to provide a supporting base for the segment 102 to transfer a load acting on the segment to the ground surface or other surface. The first and second intermediary layers 114, 116 may be arranged between the base layer 112 and the roller assembly guide 118, and may be configured to transfer a load acting on the roller assembly guide to the base layer. The roller assembly guide 118 may be configured to accommodate a roller assembly of a drilling rig, such that the drilling rig may be supported by and guided along the rails 100. The layered components of the segment 102 may be more clearly seen in FIGS. 3A-3D, for example.

Figure 3A:
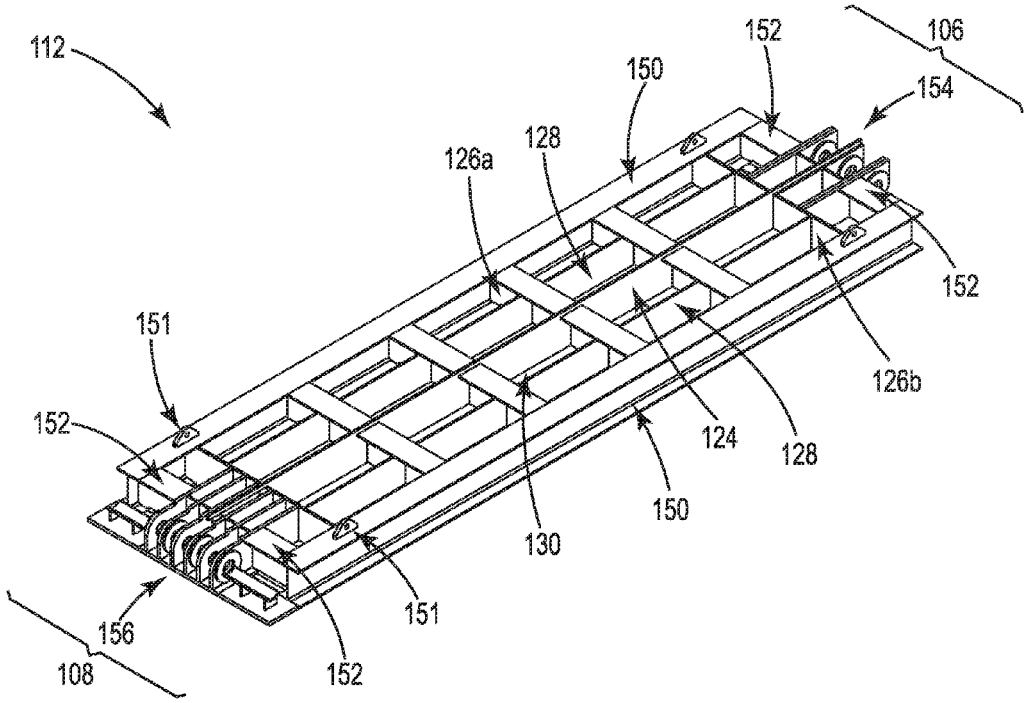
FIG. 3A is an exploded view of a base layer of a rail segment of the present disclosure, according to one or more embodiments.

Referring now to FIG. 3A, the base layer 112 may have a spine portion 124, a plurality of rib portions 126, a lower plate portion 130, a plurality of internal panels 128, a pair of outer beam portions 150, a pair of cross beam portions 152, a protruding connector 154, and a receiving connector 156.

Figure 4:
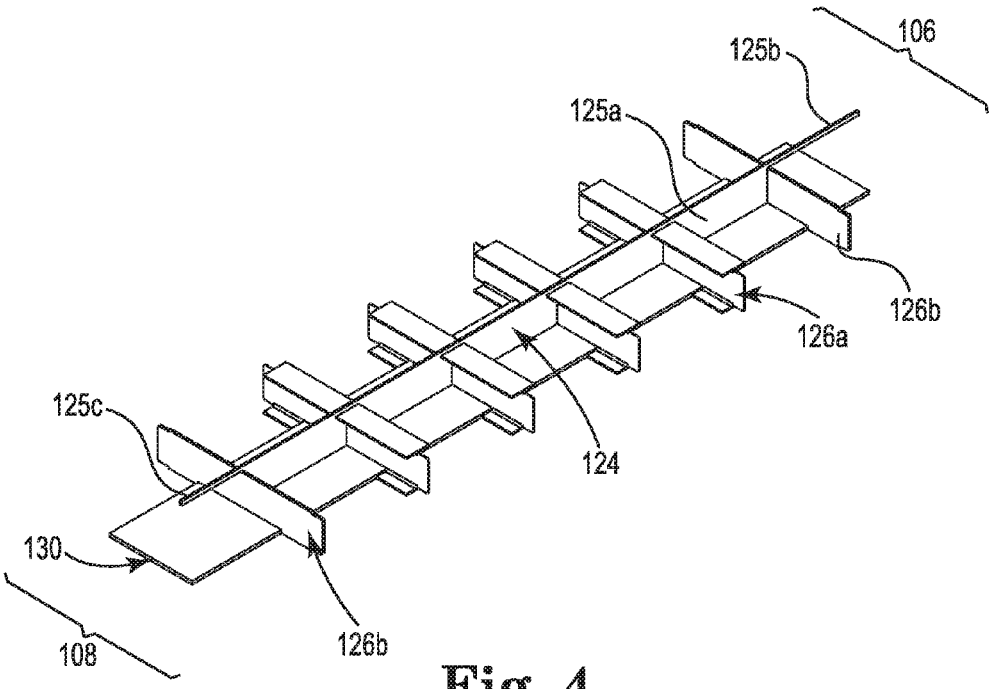
FIG. 4 is perspective view of a spine portion, plurality of rib portions, and a lower plate of a rail segment of the present disclosure, according to one or more embodiments.

FIG. 4 shows the spine portion 124 and a plurality of rib portions 126 arranged on the lower plate portion 130. The lower plate portion 130 may have an elongated shape, extending the full length or a substantial portion of the length of the segment 102. For example, the lower plate portion 130 may have a length of between about 3 to about 20 meters in some embodiments. Particularly, the lower plate portion 130 may have a length of between about 5 and about 15 meters in some embodiments. More particularly, the lower plate portion 130 may have a length of between about 8 and about 10 meters in some embodiments. The lower plate portion 130 may be aligned with a central axis of the segment 102 in some embodiments, and may have a top surface and an opposing bottom surface configured to be positioned on the ground, pad, or other surface on which the segment is arranged. The lower plate portion 130 may have a width of between about 50 and about 200 centimeters. Particularly, the lower plate 130 may have a width of between about 75 and about 125 centimeters in some embodiments. The lower plate 130 may have any suitable thickness.

The spine portion 124 may extend upward from a longitudinal center axis of the lower plate 130, and may have an elongated shape. A longitudinal axis of the spine portion 124 may generally be aligned above a longitudinal axis of the lower plate 130, and a latitudinal axis of the spine portion may be offset from a latitudinal axis of the lower plate. That is, for example, as shown in FIG. 4, the spine portion 124 may be shifted along the length of the lower plate 130 closest to a protruding end 106. In some embodiments, the spine portion 124 may have a central portion 125*a* and two struts or standoffs 125*b*, 125*c*.

The central portion 125*a* may extend between two outermost ribs 126*b*. The central portion 125*a* may have a length configured to be arranged between the two outermost ribs 126*b*. For example, in some embodiments, the central portion 125*a* may have a length of between about 3 and about 15 meters. Particularly, the central portion 125*a* may have a length of between about 5 and about 10 meters in some embodiments. More particularly, the central portion 125*a* may have a length of between about 6 and about 8 meters in some embodiments. The central portion 125*a* may have a width/height extending from the lower plate 130. It may be appreciated that the width of the lower plate portion 130 may be arranged generally orthogonal to the width of the spine portion 124. The width of the central portion 125*a* may be between about 10 and about 100 centimeters in some embodiments.

A first standoff 125*b* may extend outward along the length of the spine portion 124 nearest a protruding end 106 of the segment 102. The first standoff 125*b* may extend over an outer rib portion 126*b* nearest the protruding end 106. In some embodiments, the first standoff 125*b* may further extend beyond the length of the lower plate 130. The first standoff 125*b* may have a length extending from the central portion 125*a* of between less than 1 and up to about 2 meters, in some embodiments. The first standoff 125*b* may have width, arranged orthogonal to the width of the lower plate portion 130, of between less than 1 and up to about 10 centimeters in some embodiments.

A second standoff portion 125*c* may outward along the length of the spine portion 124 nearest a receiving end 108 of the segment 102. The second standoff 125*c* may extend over an outer rib portion 126*b* nearest the receiving end 108. In some embodiments, the second standoff 125*c* may have a shorter length than that of the first standoff 125*b*, and may stop short of an outermost edge of the lower plate 130. The second standoff 125*c* may have a length extending from the central portion 125*a* of between about 40 centimeters and up to about 120 centimeters, in some embodiments. The second standoff 125*c* may have a width, arranged orthogonal to the width of the lower plate portion 130, of between less than 1 and up to about 10 centimeters in some embodiments.

A plurality of rib portions 126 may generally be arranged along the length of the spine portion 124. It may be appreciated that the rib portions 126 may be arranged such that their lengths may be arranged generally perpendicular to the length of the spine portion 124. The segment 102 may have two outer rib portions 126*b* nearest respective protruding end 106 and receiving end 108, and one or more pairs of inner rib portions 126*a* arranged between the outer ribs.

Figure 5A:
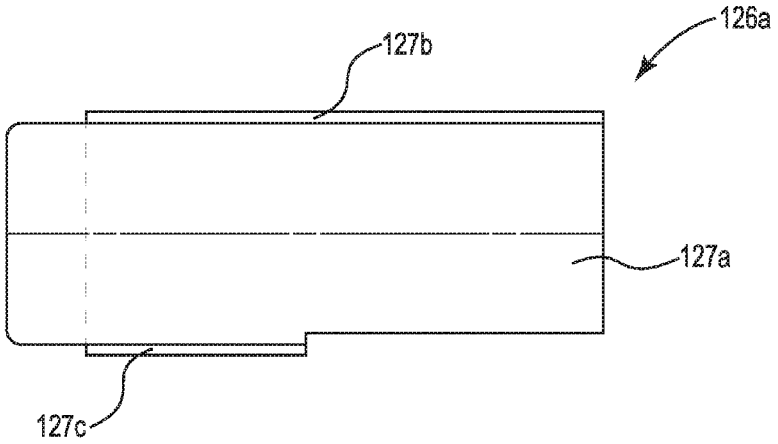
FIG. 5A is a side view of an inner rib portion of a rail segment of the present disclosure, according to one or more embodiments.

The inner rib portions 126*a* may generally be arranged in pairs, such that two inner ribs extending from opposing sides of the spine portion 124 may be aligned. Each inner rib 126*a* may have a length of between less than 1 and up to about 3 meters in some embodiments. Each inner rib 126*a* may have a length extending beyond the width of the lower plate 130, as shown for example in FIG. 4. Each inner rib portion 126*a* may have a width, arranged orthogonal to the width of the lower plate 130, of between about 200 and about 600 centimeters in some embodiments. FIG. 5A shows an inner rib portion 126*a*, according to some embodiments. As shown in FIG. 5A, in some embodiments, an inner rib portion 126*a* may have a wide flange shape with a center beam portion 127*a*, upper flange 127*b*, and lower flange 127*c*. As described above, the inner rib portion 126*a* may be configured to extend outward from the spine portion 124. In some embodiments, an inner rib portion 126*a* may be coped and have one or more notches or cutouts to accommodate the lower plate 130, outer beam portions 150, and/or other components. For example, as shown in FIG. 5A, the lower flange 127*c* of the inner rib portion 126*a* may be coped extending into the center portion 127*a*, so as to allow for positioning the inner rib over the lower plate 130. This may be seen in FIG. 4, where the center portion 127*a* of each inner rib 126*a* is arranged over the lower plate 130, and the lower flange 127*c* abuts the lower plate. It may be appreciated that the spine portion 124 may extend upward between the inner rib portions 126*a*, and extend further from the lower plate 130 than the inner rib portions. The upper 127*b* and lower 127*c* flanges of the inner rib portion 126*a* may additionally be coped to accommodate the outer beam portion 150. That is, for example, where the outer beam portion 150 comprises a similar wide flange shape, a portion of the flanges 127*b*, 127*c* of the inner rib 126*a* may be cut out to allow the center portion 127*a* to be positioned under the flanges of the outer beam portion 150. In other embodiments, one or more inner rib portions 126*a* may have different cutouts or notches to accommodate other components. Further, in still other embodiments, one or more inner rib portions 126*a* may have a different shape, such as a flat bar shape or channel or other beam shape.

Figure 5B:
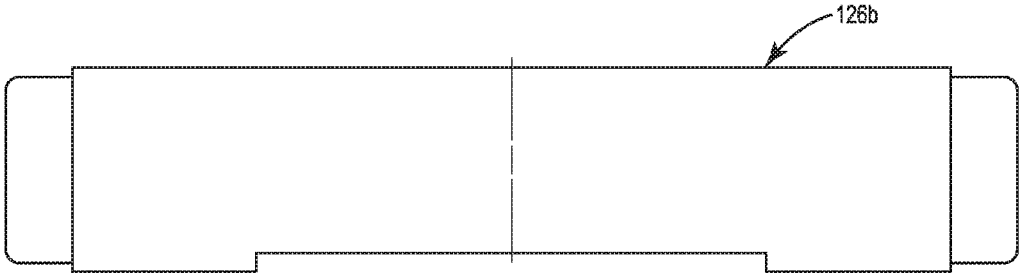
FIG. 5B is a side view of an outer rib portion of a rail segment of the present disclosure, according to one or more embodiments.

Each outer rib portion 126*b* may be arranged beneath a standoff 125*b*, 125*c* of the spine portion 124 and may be abut central portion 125*a*, such that the central portion 125*a* extends between the two outer rib portions. Each outer rib 126*b* may have a length of between less than 2 and up to about 6 meters in some embodiments. Each outer rib 126*b* may have a length extending beyond the width of the lower plate 130, such that both ends of the outer rib extend further than the width of the lower plate. Each outer rib portion 126*b* may have a width, arranged orthogonal to the width of the lower plate 130, of between about 200 and about 600 centimeters in some embodiments. FIG. 5B shows an outer rib portion 126*b*, according to some embodiments. As described above, the outer rib portion 126*b* may be configured to extend over the lower plate 130 and beneath a standoff 125*b*, 125*c* of the spine portion 124. In some embodiments, an outer rib portion 126*b* may have one or more notches or cutouts to accommodate the lower plate 130, outer beam portions 150, and/or other components. For example, as shown in FIG. 5B, a lower surface of the outer rib portion 126*b* may be coped or notched substantially at the center of the length of the rib, so as to allow for positioning of the outer rib over the lower plate 130. In this way, the central lower cutout may have a length and width the same or similar to the width and thickness of the lower plate 130. This may be seen in FIG. 4, where the outer ribs 126*b* are arranged around the lower plate 130. Similarly, the outer rib portion 126*b* may have a cutout in each of upper and lower surfaces on each end of the rib, so as to accommodate the outer beam portions 150. That is, for example, where the outer beam portion 150 comprises a wide flange shape, a portion of the width of the outer rib 126*b* may be cut out to allow a portion of the rib to be positioned under the flanges of the outer beam portion 150. In other embodiments, one or more outer rib portions 126*b* may have different cutouts or notches to accommodate other components. Further, in still other embodiments, one or more outer rib portions 126*b* may have a different shape, such as a wide flange, channel, or other beam shape.

The segment 102 may have any suitable number of rib portions 126. For example, in some embodiments, the segment may have two outer rib portions 126*b*, and four pair if inner rib portions 126*a*. In other embodiments, the segment 102 may have more or fewer outer 126*b* and/or inner 126*a* rib portions. In some embodiments, the rib portions 126 may be evenly spaced along the length of the central portion 125*a* of the spine portion 124. For example, a distance of between less than 1 and up to about 2 meters may span between adjacent pairs of rib portions 126.

The spine portion 124 and rib portions 126 may be arranged on the lower plate 130 closer to the protruding end 106 than the receiving end 108. That is, for example, a distance between the receiving end of the lower plate 130 and the closest rib 126*b* to that end may be greater than the distance between the protruding end of the lower plate and the closest rib to that end. It may be appreciated that the standoff 125*b* of the spine portion 124 may extend beyond the protruding end 106 of the lower plate 130, while the receiving end 108 of the lower plate 130 may extend beyond the standoff 125*c* of the spine portion 124.

Turning back to FIG. 3A, the base layer 112 may additionally have a plurality of internal panels 128 arranged between the ribs 126. For example, an internal panel 128 may extend between two adjacent ribs 126 arranged on a same side of the spine portion 124. The length of the internal panels 128 may be generally perpendicular to the lengths of the rib portions 126. The width of the internal panels 128 may extend upward from the lower plate 130. Internal panels 128 on a same side of the spine portion 124 may generally be aligned with one another, and separated by the ribs 126. Each internal panel 128 may have any suitable length, and may generally have a length configured to be arranged between two adjacent rib portions 126. For example, in some embodiments, each internal panel 128 may have a length of between less than 1 and up to about 3 meters. Each internal panel 128 may have any suitable width. For example, in some embodiments, each internal panel 128 may have a width of between about 10 and about 100 centimeters. In some embodiments, at least a portion of each internal panel 128 may be configured to be arranged beneath, or generally covered by, an upper flange of at least one inner rib portion 126*a*. In this way, the internal panels 128 may have one or more notches or cutouts on an upper surface of the panel, such that the internal panel may be arranged beneath the upper flange of one or more inner ribs 126*a*, for example. The internal panels 128 may generally help to stabilize the base layer 112 and/or support other layers.

With continued reference to FIG. 3A, the base layer 112 may additionally have a pair of outer beam portions 150 arranged along two edges of the base layer, extending between the protruding end 106 and receiving end 108. Each outer beam portion 150 may have a length extending the length or a substantial portion of the length of the segment 102. For example, the outer beam portion 150 may have a length of between about 3 to about 20 meters in some embodiments. Particularly, the outer beam portion 150 may have a length of between about 5 and about 15 meters in some embodiments. More particularly, the outer beam portion 150 may have a length of between about 8 and about 10 meters in some embodiments. In some embodiments, the outer beam portions 150 may have a wide flange cross sectional shape. In this way, the flanges of outer beam portion 150 may be configured to fit over or around the narrowed ends of the ribs 126, as discussed above, such that an upper surface of the outer beam portion 150 may generally align with an upper surface of rib portions 126. In other embodiments, the outer beam portions 150 may have any suitable cross sectional shape, such as a channel or other beam shape. In some embodiments, one or more lugs 151 may be arranged on the outer beam portions 150 and may be configured for lifting and/or transporting the rail segment 102.

In some embodiments, the base layer 112 may have one or more cross beam portions 152 extending between an outer beam portion 150 and a connector 154, 156 and/or lower plate 130. The cross beam portions 152 may each have any suitable length and width and may generally be configured to stabilize the connectors 154, 156. In some embodiments, for example, the cross beam portions 152 may have a length of between about 10 and about 100 centimeters. In some embodiments, a segment 102 may have four cross beam portions 152, such that a cross beam extends between each of the two outer beam portions 150 and each connector 154, 156, as shown for example in FIG. 3A. In some embodiments, the cross beam portions 152 may have a wide flange cross sectional shape, similar to or the same as that of the outer beam portions 150. In other embodiments, the cross beam portions 152 may have any suitable cross sectional shape, such as a channel or other beam shape. In some embodiments, one or more cross beam portions 152 may have one or more notches or cutouts on upper and/or lower surfaces, such as upper and/or lower flanges, so as to accommodate the lower plate 130 and outer beam portion 150. For example, the cross beam portions 152 may have three such cutouts similar to those describe above with respect to inner rib portions 126*a*.

Figure 6:
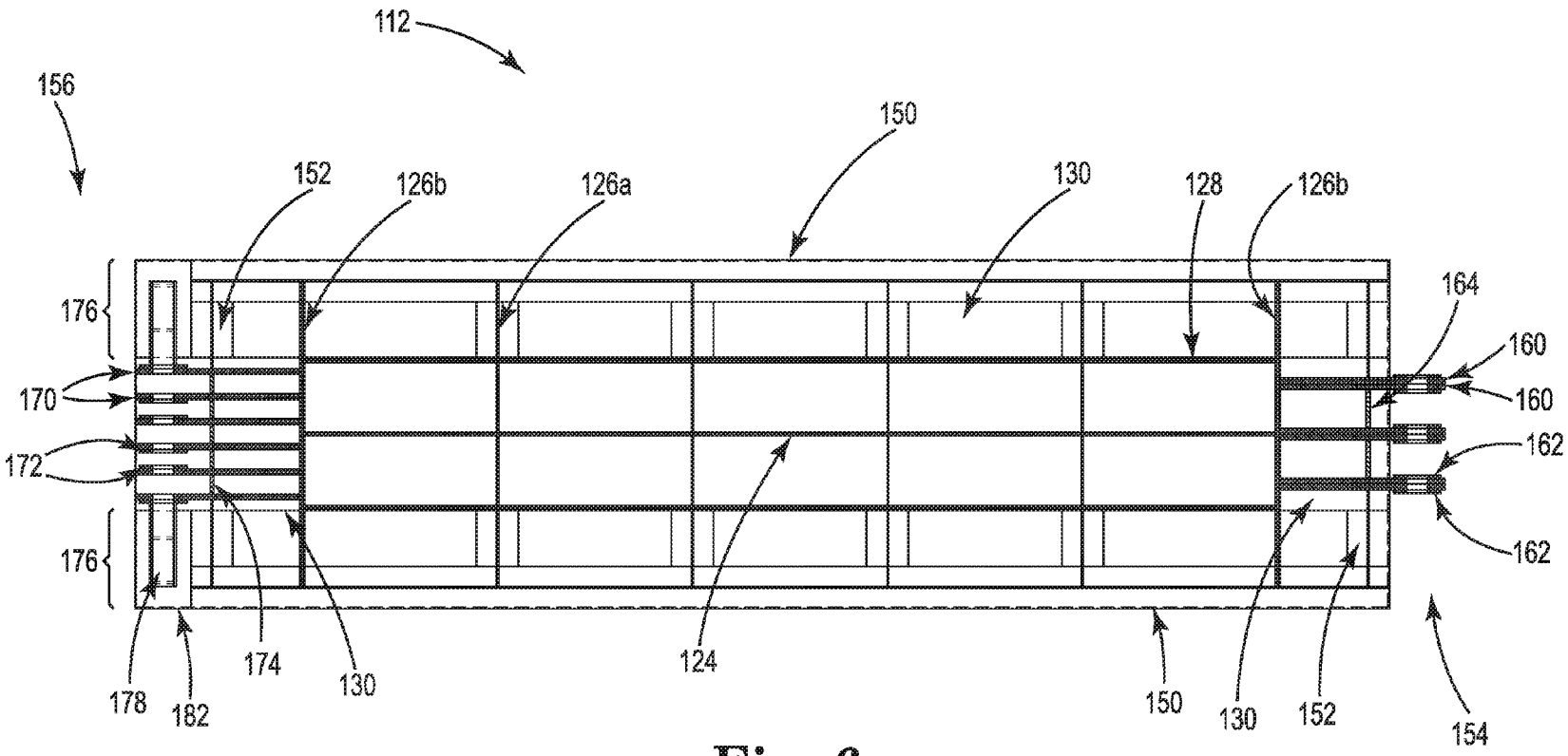
FIG. 6 is an overhead view of a base layer of a rail segment of the present disclosure, according to one or more embodiments.
Figure 7A:
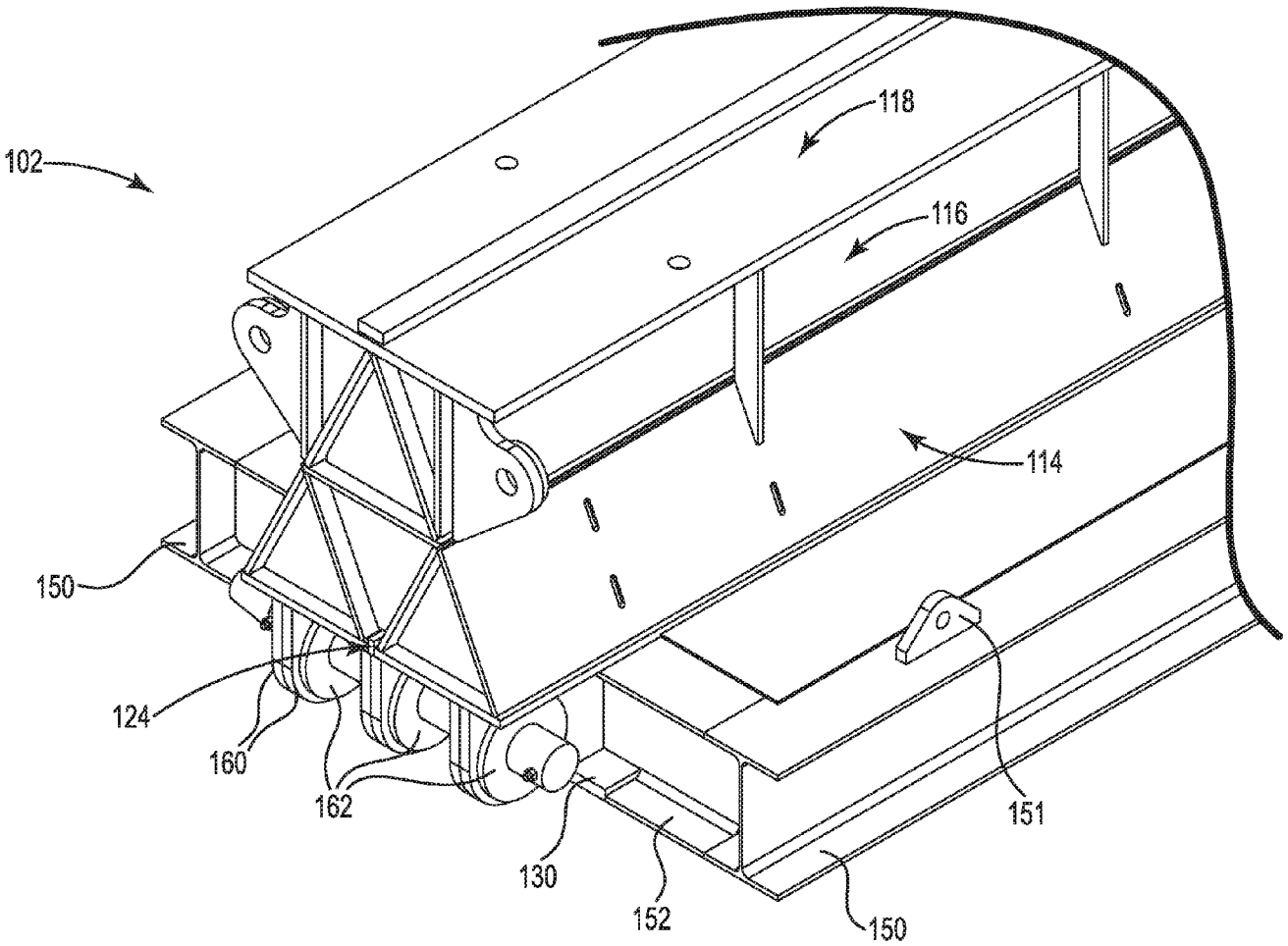
FIG. 7A is a protruding end view of a rail segment of the present disclosure, according to one or more embodiments.
Figure 8A:
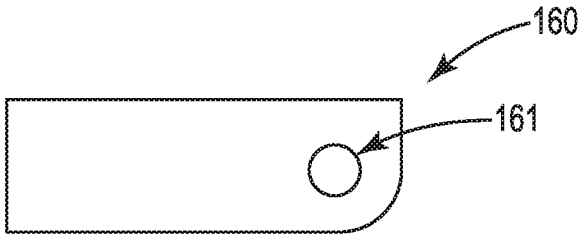
FIG. 8A is a side view of a protruding connector lug of the present disclosure, according to one or more embodiments.

As shown in FIG. 3A, the base layer 112 may have a protruding connector 154 configured to couple to a receiving connector 156 of an adjacent segment 102. The protruding connector 154 may extend from the spine portion 124 and/or an outer rib portion 126*b*. FIG. 6 illustrates an overhead view of the base layer 112 with protruding connector 154 and receiving connector 156. Additionally, FIG. 7A illustrates a protruding connector 154 of a segment 102. As shown in FIGS. 6 and 7A, the protruding connector 154 may have a plurality of lugs 160 extending from a rib 126*b*. In some embodiments, the lugs 160 may be arranged in immediately adjacent pairs, as shown in FIG. 6. In alternative embodiments, a thicker lug may be used. A protruding connector 154 may have three pairs of lugs 160, for example. In other embodiments, a protruding connector 154 may have any suitable number of lugs 160. The lugs 160 may generally extend beyond the length of the outer beam portions 150, cross beam portions 152, and/or lower plate 130. FIG. 8A shows a lug 160 of the protruding connector 154. The lug 160 may have any suitable length, width, and thickness, and generally may be sized such that it may extend beyond the edge of the lower plate 130 so as to couple to the receiving connector 156 of an adjacent segment 102. For example, in some embodiments, each lug 160 may have a length of between about 10 and about 200 centimeters. Moreover, each lug 160 may have a width of between about 10 and about 100 centimeters. Each lug 160 may have an opening 161 configured to receive a bolt, pin, or other device. As additionally shown in FIG. 6, each pair of lugs 160 may be surrounded by a pair of donuts 162. That is, each lug 160 may have at least one reinforcing ring or donut 162 arranged over the opening 161. Additionally, in some embodiments, spacers 164 may be arranged between the pairs of lugs 160, as shown in FIG. 6. The spacers 164 may be aligned with cross beam portions 152 in some embodiments. The spacers 164 may generally maintain separation between the pairs of lugs 160.

Figure 7B:
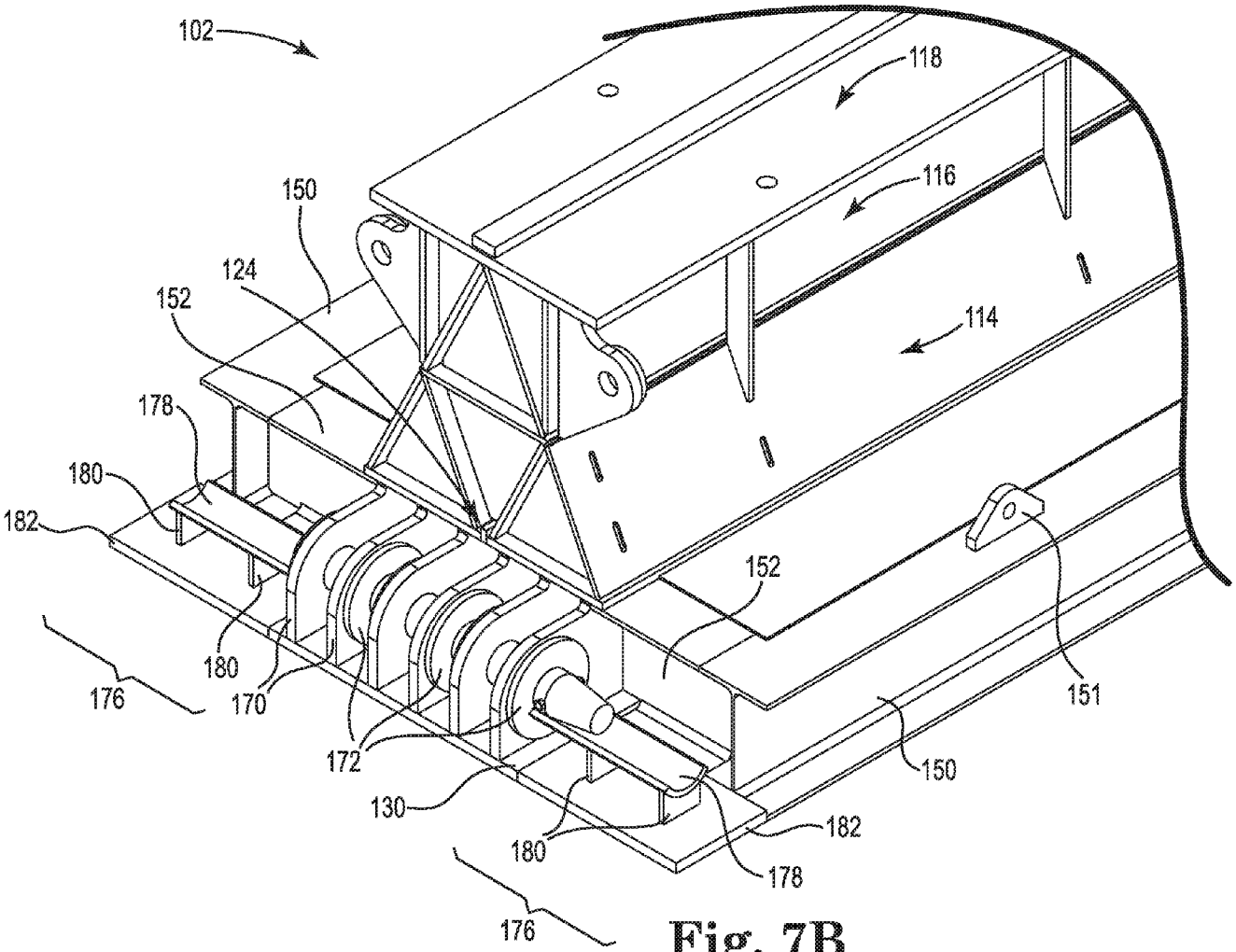
FIG. 7B is a receiving end view of a rail segment of the present disclosure, according to one or more embodiments.
Figure 8B:
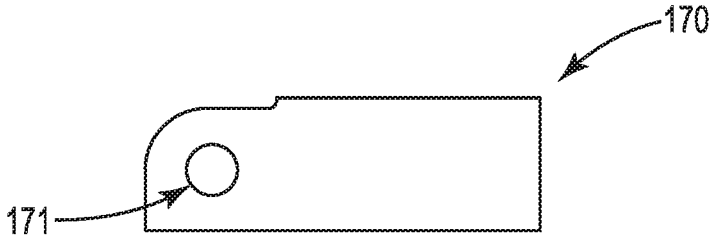
FIG. 8B is a side view of a receiving connector lug of the present disclosure, according to one or more embodiments.

With continued reference to FIG. 6, the receiving connector 156 may be configured to couple to a protruding connector 154 of an adjacent segment 102. Additionally, FIG. 7B shows a receiving connector 156 of a segment 102. The receiving connector 156 may extend from the spine portion 124 and/or outer rib portion 126*b*. The receiving connector 156 may have a plurality of lugs 170. The lugs 170 may be spaced at intervals and configured to couple to corresponding lugs 160 of a protruding connector 154. For example, a pair of lugs 170 may be spaced so as to receive a pair of lugs 160 between them. The receiving connector 156 may have three pairs of lugs 170 in some embodiments. In other embodiments, the receiving connector 156 may have any suitable number of lugs 170. The lugs 170 may extend from a rib portion 126*b* and may be arranged on the lower plate 130. In some embodiments, an edge of the lugs 170 may be generally flush with an edge of the lower plate 130. As shown in FIG. 7B, the lugs 170 may be arranged such that they extend beyond the first and second intermediate layers 114, 116. In this way, the lugs 170 may be clear to receive lugs 160. FIG. 8B shows a lug 170 of the receiving connector 156. The lug 170 may have any suitable length, width, and thickness, and generally may be sized such that it may extend beyond the first and second intermediate layers 114, 116 so as to couple to the protruding connector 154 of an adjacent segment 102. The lug 170 may have an opening 171 configured to receive a bolt, pin, or other device. As additionally shown in FIG. 5A, each lug 170 may have at least one reinforcing ring or donut 172 arranged over the opening 171. Additionally, in some embodiments, spacers 174 may be arranged between the lugs 170, as shown in FIG. 6. The spacers 174 may be aligned with cross beam portions 152 in some embodiments. The spacers 174 may generally maintain separation between the pairs of lugs 170.

As additionally shown in FIGS. 6 and 7B, in some embodiments, the receiving connector 156 may have a pair of pin holding structures 176 configured to support a pin, bolt, or other device positioned through the openings 161, 171 of lugs 160 and lugs 170 when two adjacent segments 102 are coupled together. Each pin holding structure 176 may have a pin holding member 178, supported by one or more pin holding supports 180 and a pin holding plate 182. The pin holding member 178 may be a curved plate configured to receive a rounded pin or bolt, for example. In other embodiments, the pin holding member 178 may have any suitable shape. The pin holding member 178 may be arranged adjacent to and beneath the opening 171 of an outermost lug 170, such that a pin, bolt, or other device passed through the opening 171 may be generally arranged on or supported by the pin holding member 178. Pin holding plates 182 may be arranged adjacent to the lower plate 130, and may extend outward such that a side edge of the pin holding plate may be generally flush with an outer edge of the outer beam portion 150. Pin holding supports 180 may extend upward from the pin holding plate 182 to support the pin holding member 178.

Figure 10:
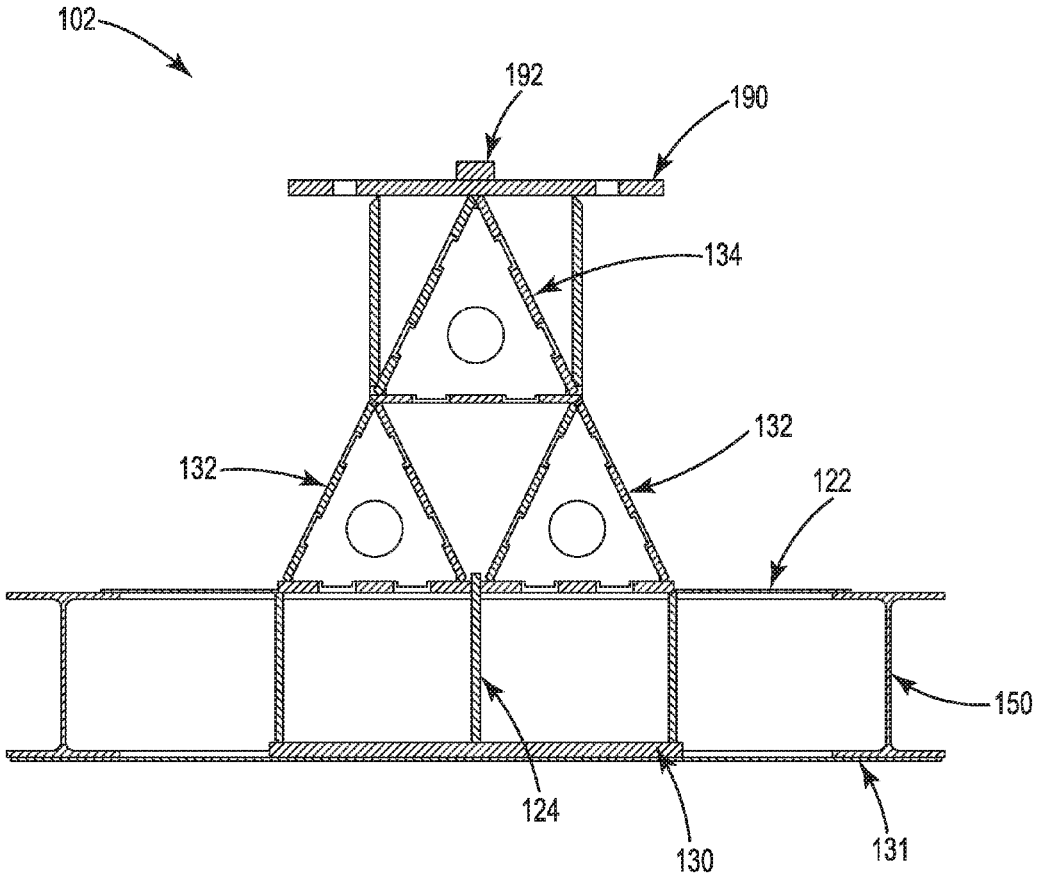
FIG. 10 is a cross sectional view of a rail segment of the present disclosure, according to one or more embodiments.

In some embodiments, the base layer 112 may include a bearing plate 131, as shown for example in the cross sectional view of the segment 102 of FIG. 10. The bearing plate 131 may be a relatively thin plate extending beneath the full length and width of the segment 102. In other embodiments, the bearing plate 131 may extend less than or more than the length and width of the segment 102. The bearing plate 131 may have a thickness of between 6 millimeters and 25 millimeters in some embodiments. The bearing plate 131 may generally act to transfer loading from the segment 102 into the ground.

Figure 3B:
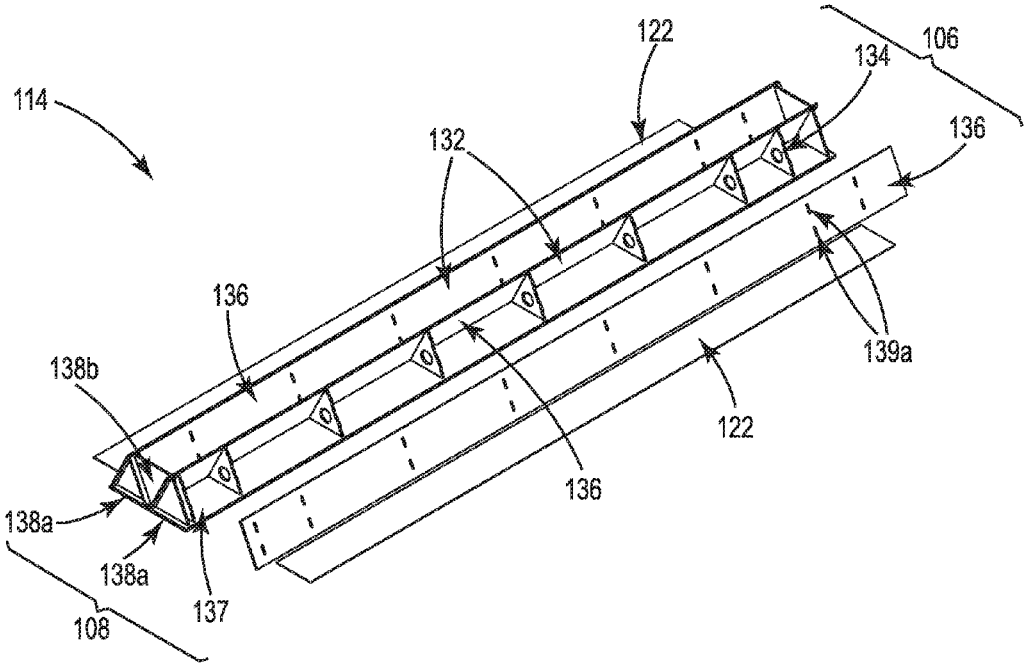
FIG. 3B is an exploded view of a first intermediary layer of a rail segment of the present disclosure according to one or more embodiments.

Referring now to FIG. 3B, the first intermediary layer 114 may be arranged atop or generally adjacent to the base layer 112. The intermediary layer 114 may have a pair of triangular support structures 132 in some embodiments. Each triangular support structure 132 may have an elongated shape, extending the length or a substantial portion of the length of the segment 102. For example, the triangular support structure 132 may have a length of between about 3 to about 20 meters in some embodiments. Particularly, the triangular support structure 132 may have a length of between about 5 and about 15 meters in some embodiments. More particularly, the triangular support structure 132 may have a length of between about 8 and about 10 meters in some embodiments. The triangular support structure 132 may have a triangular cross sectional shape. As shown in FIG. 3, the triangular support structure 132 may generally be composed of a plurality of internal gussets or stiffness brackets 134 housed by two side panels 136, a bottom panel 137, and two end caps 138.

Each triangular support structure 132 may have a plurality of internal brackets 134. In some embodiments, a triangular support structure 132 may have between 1 and 12 brackets 134, for example. The brackets 134 may be spaced within the triangular support structure 132 in various arrangements. For example, as shown in FIG. 3, the brackets 134 may be arranged with non-uniform spacing therebetween in some embodiments. Spacing between each bracket 134 and the next bracket or end cap 138 may be between about 10 centimeters to about 200 centimeters in some embodiments. In other embodiments, spacing between each bracket and the next bracket or end cap 138 may be between less than 1 and up to about 10 meters. Each triangular support structure 132 may have any suitable number of brackets 134. In some embodiments, each triangular support structure 132 may have 8 brackets, for example. In still other embodiments, a triangular support structure 132 may have no internal brackets 134. It may be appreciated that, while the brackets 134 may have unsymmetrical spacing, within the triangular support structure 132, when the triangular support structure is positioned over the base layer 112, the brackets may be symmetrically distributed along the length of the segment 102.

Figure 9A:
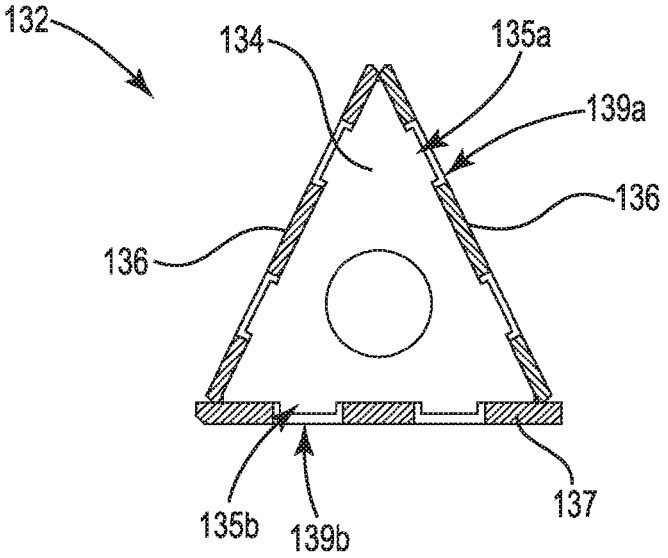
FIG. 9A is a cross sectional view of a triangular support structure of the present disclosure, according to one or more embodiments.

FIG. 9A illustrates a cross sectional view of a triangular support structure 132. As shown, an internal bracket 134 may be arranged between the two side panels 136 and bottom panel 137. In some embodiments, each triangular support structure 132 may have a plurality of internal brackets 134 arranged internally throughout its length. The internal brackets 134 may be configured to stiffen side panels 136 so as to mitigate buckling due to compression loading. The internal brackets 134 may additionally act as assembly jigs for assembly or welding of the triangular support structures 132. Each internal bracket 134 may have a generally triangular shape. The length of each side of the triangle may be between about 20 and about 100 centimeters in some embodiments. Particularly, the length of each side of the triangle may be between about 40 and about 60 centimeters in some embodiments. In some embodiments, the lengths of the three sides of the triangular shaped bracket 134 may be different. Generally, the side lengths of the bracket 134 may be sized to correspond with the widths of the side panels 136 and bottom panel 134. Each bracket 134 may have a thickness of between less than 1 and up to about 10 centimeters in some embodiments. In some embodiments, each bracket may have an opening, such as a circular opening, at or near the center of the bracket configured to reduce weight of the support structure 132. As additionally shown in FIG. 9A, each bracket 134 may be configured to couple to the side panels 136 and bottom panel 137. For example, each bracket 134 may have one or more protrusions 135*a*, 135*b* on each side of its triangular shape. The protrusions 135*a* may be sized to fit within corresponding openings or cutouts of the side panels 136, and similarly protrusions 135*b* may be sized to fit within corresponding openings or cutouts of the bottom panel 137, as shown in FIG. 9A. In some embodiments, each bracket 134 may have two protrusions 135 on each side of its triangular shape.

As shown in FIG. 3B, the side panels 136 may be arranged on each of two angled sides of the triangular support structure 132. Similarly, the bottom panel 137 may be arranged on a bottom side of the triangular support structure 132. The side panels 136 and bottom panel 137 may have an elongated shape, extending the length or a substantial portion of the length of the segment 102. For example, the side panels 136 and bottom panel 137 may each have a length of between about 3 to about 20 meters in some embodiments. Particularly, the side panels 136 and bottom panel 137 may each have a length of between about 5 and about 15 meters in some embodiments. More particularly, the side panels 136 and bottom panel 137 may each have a length of between about 8 and about 10 meters in some embodiments. The side panels 136 and bottom panel 137 may each have a thickness of between less than 1 and up to about 10 centimeters in some embodiments. In some embodiments, each of the two side panels 136 and the bottom panel 137 may have the same or similar dimensions. In other embodiments, the dimensions of the three elements may differ. For example, as shown in FIG. 9A, the bottom panel 137 may have a larger thickness than the side panels 136 in some embodiments.

As mentioned above, the side panels 136 and bottom panel 137 may have cutouts or openings 139*a*, 139*b* to receive the protrusions 135*a*, 135*b* of the internal brackets 134. As shown in FIGS. 3B and 9A, each side panel 136 may have a pair of openings 139*a* for each bracket 134 and arranged along the side panel so as to correspond with the spacing of the bracket within the triangular support structure 132. Similarly, the bottom panel 137 may have a pair of openings 139*b* for each bracket 134 and arranged along the bottom panel so as to correspond with the spacing of the bracket.

Each triangular support structure 132 may have a pair of end caps 138*a*. Each end cap 138*a* may be arranged between the two side panels 136 and bottom panel 137 at the lengths' end of the three panels, as shown in FIG. 5. The end caps 138*a* may have a generally triangular shape, corresponding with the triangular shape formed by the three panels 136, 137. In some embodiments, the end caps 138*a* may be inset within the triangular support structure 132, such that the three panels 136, 137 extend beyond the end cap, as shown in FIG. 3B. In other embodiments, the end cap 138*a* may cover over the ends of the three panels 136, 137, or may be flush with the ends of the panels, for example.

Figure 11:
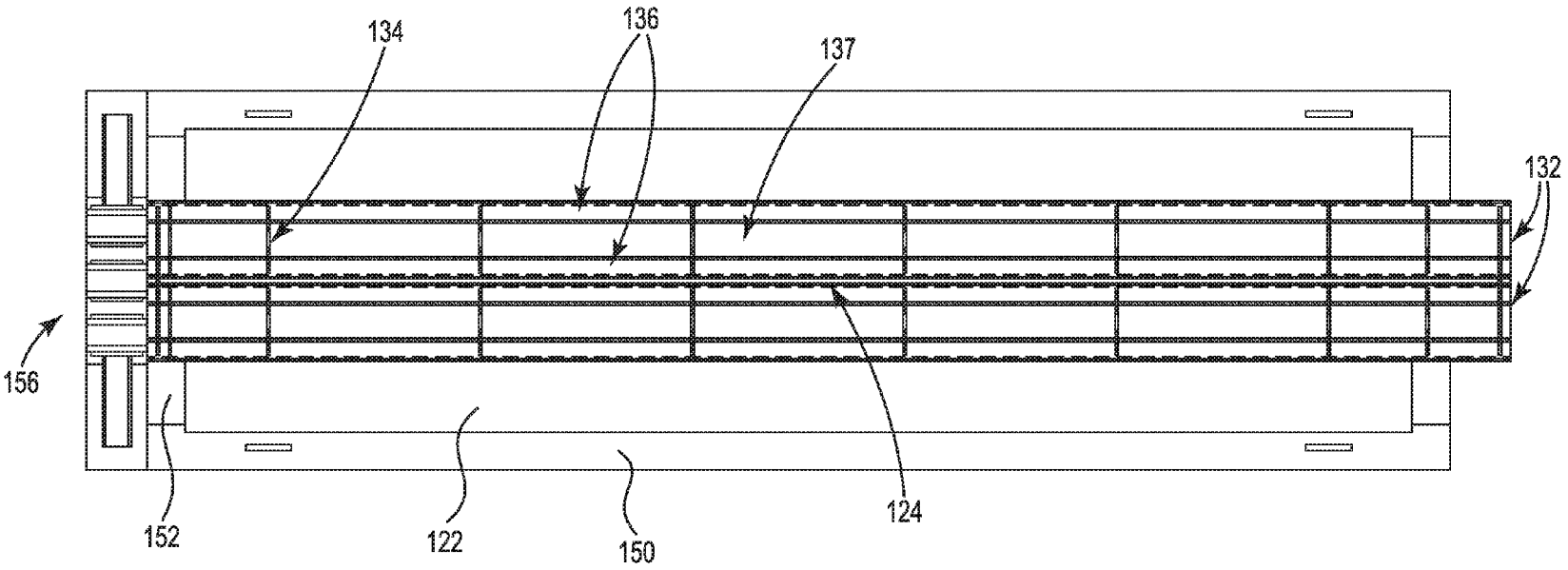
FIG. 11 is an overhead view of a base layer and first intermediary layer of a rail segment of the present disclosure, according to one or more embodiments.

The two triangular support structures 132 of the first intermediary layer 114 may be arranged on the base layer 112, such that the rib portions 126 may support the triangular support structures, as shown for example in the cross sectional view of FIG. 10. The two triangular support structures 132 may be arranged on opposing sides of the spine portion 124 in some embodiments. As shown in FIG. 10, the spine portion 124 may extend between the two triangular support structures 132 in some embodiments. FIG. 11 illustrates an overhead view of the first intermediary layer 114 arranged over the base layer 112. As shown, the first intermediary layer 114 may be arranged over the base layer 112 such that the receiving connector 156 remains exposed from an overhead view. FIG. 11 further illustrates the spacing of the brackets 134 between outermost edges of the segment 102, which may be symmetrical spacing in some embodiments.

As shown in FIG. 3B, in some embodiments, an end cap 138*b* may be arranged between the two triangular support structures 132. Particularly, each end cap 138*b* may have a triangular shape similar to end caps 138*a*, and may be arranged between a side panel 136 of a first triangular support structure 132 and a side panel of a second triangular support structure at each of a protruding end 106 and a receiving end 108 of the support structures. The end caps 138*b* may have any suitable thickness. The end cap 138*b* may help to maintain a proper distance between the two triangular support structures 132.

It may be appreciated that end caps 138*a*, 138*b* may be recessed or inset at the ends of triangular support structures 132, such that the ends of the side panels 136 and bottom panel 137 extend outward beyond the end caps. This may be seen, for example, in FIGS. 2A and 2B. Recessed or inset end caps 138*a*, 138*b* may allow for the ends caps to be coupled to the support structures 132 by fillet welds in some embodiments, which may provide for faster and/or easier assembly. However, in other embodiments, the end caps 138*a*, 138*b* may be arranged flush with the ends of the triangular support structures 132, or may be sized so as to be arranged over the ends of the triangular support structures.

As additionally shown in FIG. 3B, the first intermediary layer 114 may have a pair of cover plates 122. Each cover plate 122 may extend from a point at which a side panel 136 meets the bottom panel 137 of a triangular support structure. The cover plate 122 may have an elongated shape and may be generally arranged over the rib portions 126 on a side of the spine portion 124. The cover plate 122 may generally be configured to provide a protective cover over portions of the ribs 126 that may extend beyond the width of the triangular support structures 132, as shown for example in FIG. 11. In some embodiments, each cover plate 122 may additionally be arranged over at least a portion of the cross beam portions 152 at each end of the segment 102 and/or may be arranged over at least a portion of a beam portion 150. Each cover plate 122 may have a length configured to be arranged between two cross beam portions 152. For example, in some embodiments, each cover plate 122 may have a length of between about 3 and about 20 meters. Further, each cover plate 122 may have a width configured to extend between a triangular support structure 132 and the beam portion 150. For example, each cover plate 122 may have a width of between about 10 and about 100 centimeters in some embodiments. In other embodiments, each cover plate 122 may have any suitable length and width. Each cover plate 122 may further have any suitable thickness.

Figure 3C:
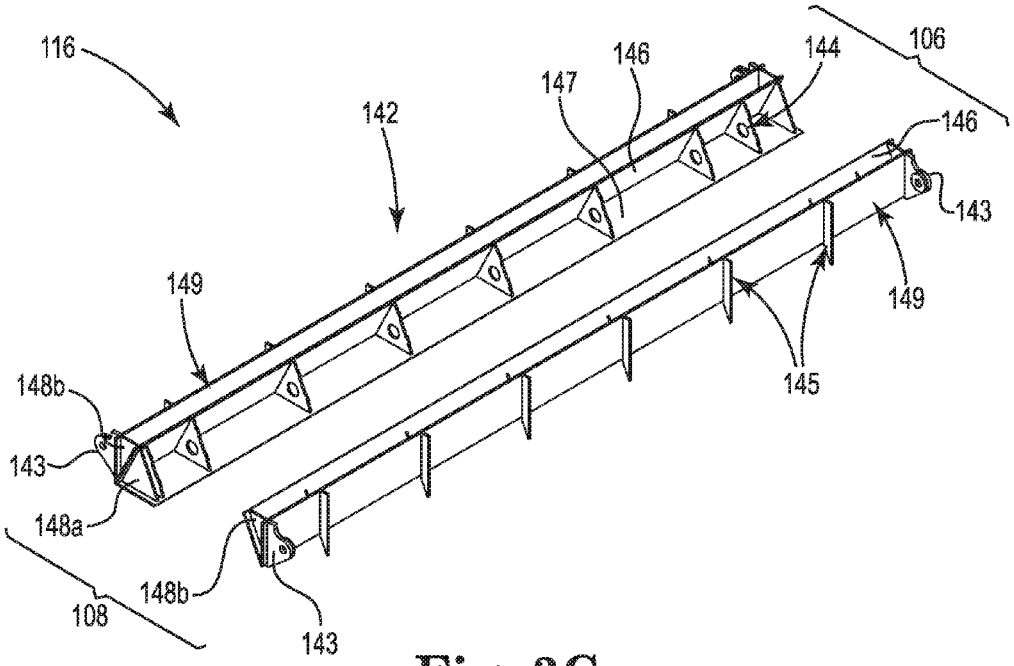
FIG. 3C is an exploded view of a second intermediary layer of a rail segment of the present disclosure, according to one or more embodiments.

Referring now to FIG. 3C, the second intermediary layer 116 may have a triangular support structure 142. The triangular support structure 142 may have an elongated shape, extending the length or a substantial portion of the length of the segment 102. For example, the triangular support structure 142 may have a length of between about 3 to about 20 meters in some embodiments. Particularly, the triangular support structure 142 may have a length of between about 5 and about 15 meters in some embodiments. More particularly, the triangular support structure 142 may have a length of between about 8 and about 10 meters in some embodiments. In some embodiments, the length of the triangular support structure 142 may be the same or similar to that of triangular support structures 132 of the first intermediary layer 114. Similar to the triangular support structures 132 discussed above, the triangular support structure 142 may have a triangular cross sectional shape. As shown in FIG. 3, the triangular support structure 142 may generally be composed of a plurality of internal brackets 144 housed by two side panels 146, a bottom panel 147, and two end caps 148. In addition, one or more upper lugs 143 and a plurality of roller assembly supports 145 may couple to the triangular support structure 142 via a pair of outer panels 149.

Each triangular support structure 142 may have a plurality of internal brackets 144 configured to stiffen the triangular support structure against buckling and/or provide an assembly jig. In some embodiments, a triangular support structure 142 may have between 1 and 12 brackets 144, for example. The brackets 144 may be spaced within the triangular support structure 142 in various arrangements. In some embodiments, the brackets 144 may be spaced similarly to brackets 134 of the first intermediary layer 114. That is, for example, while the brackets 144 may have asymmetrical spacing within the triangular support structure 142, as shown in FIG. 3C, when the triangular support structure is positioned over the first intermediary layer 114, the brackets may be symmetrically distributed along the length of the segment 102.

Figure 9B:
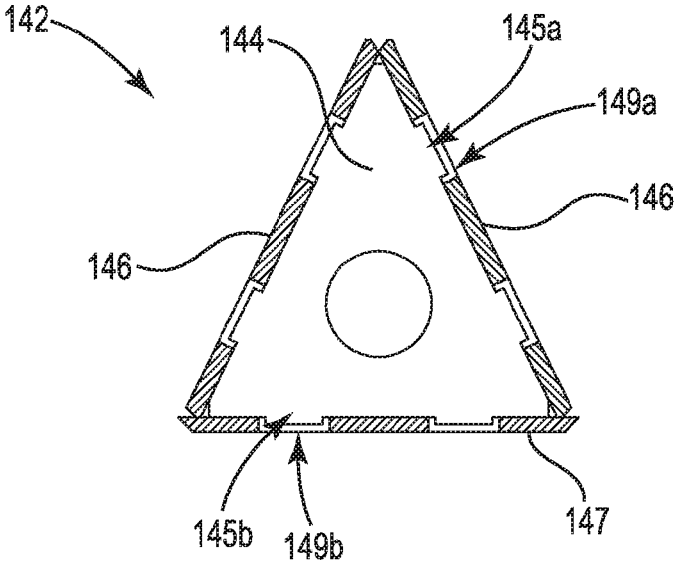
FIG. 9B is a cross sectional view of a triangular support structure of the present disclosure, according to one or more embodiments.

FIG. 9B illustrates a cross sectional view of a triangular support structure 142. As shown, an internal bracket 144 may be arranged between the two side panels 146 and bottom panel 147. The internal brackets 144 may be similar to internal brackets 134 described above. For example, the internal brackets 144 may each have a triangular shape with any suitable side length and thickness. Moreover, each bracket 144 may have one or more protrusions and may be configured to couple to the side panels 146 and bottom panel 147. In some embodiments, the brackets 144 of the second intermediary layer 116 may be larger than the brackets 134 of the first intermediary layer 114.

As shown in FIG. 3C, the side panels 146 may be arranged on each of two angled sides of the triangular support structure 142. Similarly, the bottom panel 147 may be arranged on a bottom side of the triangular support structure 142. The side panels 146 and bottom panel 147 may be similar to side panels 136 and bottom panel 137 described above with respect to the first intermediary layer 114. The side panels 146 and bottom panel 147 may have any suitable length and thickness. In some embodiments, the side panels 146 and bottom panel 147 may have the same or similar length as side panels 136 and bottom panel 137. Further, in some embodiments, the side panels 146 and bottom and bottom panel 147 may each have larger widths than side panels 136 and bottom panel 137. In this way, the triangular support structure 142 may have a larger width than support structure 132 in some embodiments. Moreover, the side panels 146 and bottom panel 147 may have a plurality of cutouts or openings to receive the protrusions of the internal brackets 144. The arrangement of the openings may correspond with the spacing of the brackets 144.

Each triangular support structure 142 may have a pair of end caps 148*a*. Each end cap 148*a* may be arranged between the two side panels 146 and bottom panel 147 at the lengths' end of the three panels, as shown in FIG. 3C. The end caps 148*a* may be generally similar to end caps 138*a*, having a triangular shape and any suitable size. In some embodiments, end caps 148*a* may be larger than end caps 138*a*, to correspond with the wider side panels 146 and bottom panel 147.

The triangular support structure 142 of the second intermediary layer 116 may be arranged on the first intermediary layer 114, such that the triangular support structure 142 is arranged over the end caps 138*b*. The triangular support structure 142 may be at least partially supported by upper points of the two lower triangular support structures 132, as shown for example in the cross sectional view of FIG. 10.

As shown in FIG. 3C, the second intermediary layer 116 may have a pair of outer panels 149. Each outer panel 149 may have an elongated shape and may extend along the length of the triangular support structure 142. A width of each outer panel 149 may extend from a point where a side panel 146 meets the bottom panel 147 of the triangular support structure 142, as shown for example in FIG. 10. The outer panels 149 may extend upward from this point to the rail assembly guide 118. The outer panels 149 may generally be configured to provide additional support to the rail assembly guide 118. Each outer panel 149 may have a length of between about 3 and about 20 meters in some embodiments. The length of the outer panels 149 may be similar to or the same as that of the triangular support structure 142 in some embodiments. In other embodiments, the outer panels 149 may have any suitable length. Each outer panel 149 may have a width of between about 10 and about 100 centimeters in some embodiments. The width of the outer panels 149 may generally be suitable to extend between an uppermost point of the triangular support structures 132 and the rail assembly guide 118. Further, each outer panel 149 may have any suitable thickness. As additionally shown in FIG. 3C, a pair of triangular end caps 148*b* may be arranged between each outer panel 149 and the triangular support structure 142. That is, for example, at each of the protruding end 106 and receiving end 108, an end cap 148*b* may be arranged between each outer panel 149 and the triangular support structure 142. The end caps 148*b* may generally be configured to couple the outer panels 149 to the triangular support structure 142 and/or to maintain a distance between the outer panels and triangular support structure.

It may be appreciated that end caps 148*a*, 148*b* may be recessed or inset at the ends of triangular support structures 142, such that the ends of the side panels 146 and bottom panel 147 extend outward beyond the end caps. Recessed or inset end caps 148*a*, 148*b* may allow for the ends caps to be coupled to the support structures 142 by fillet welds in some embodiments, which may provide for faster and/or easier assembly. However, in other embodiments, the end caps 148*a*, 148*b* may be arranged flush with the ends of the triangular support structures 142, or may be sized so as to be arranged over the ends of the triangular support structures.

As additionally shown in FIG. 3C, a pair of upper lugs 143 may be arranged at each end 106, 108 of the second intermediary layer 116. Particularly, an upper lug 143 may couple to each of the protruding 106 and receiving 108 ends of each outer panel 149. The upper lugs 143 may have any suitable shape and thickness. The upper lugs 143 may be sized and arranged such that when two segments 102 are coupled together via opposing protruding and receiving connectors 154, 156, the upper lugs of the opposing segments may be aligned. Each upper lug 143 may have an opening configured to receive a bolt, pin, or other device. As additionally shown in FIG. 3C, each upper lug 143 may have at least one donut arranged about the opening.

As additionally shown in FIG. 3C, the second intermediary layer 116 may have a plurality of roller assembly supports 145 configured to act as stiffeners for the roller assembly guide 118. A plurality of roller assembly supports 145 may extend outward from each outer panel 149, for example. The length of the roller assembly supports 145 may generally extend between a side panel 136 of the triangular support structures 132 and the roller assembly guide 118. The roller assembly supports 145 may generally be configured to provide additional support to the roller assembly guide 118. Any suitable number of roller assembly supports 145 may be arranged along the length of each outer panel 149 between the upper lugs 143. For example, in some embodiments, six roller assembly supports 145 may be arranged between the upper lugs 143. In other embodiments, more or fewer roller assembly supports 145 may be arranged along the length of each outer panel 149.

Figure 12:
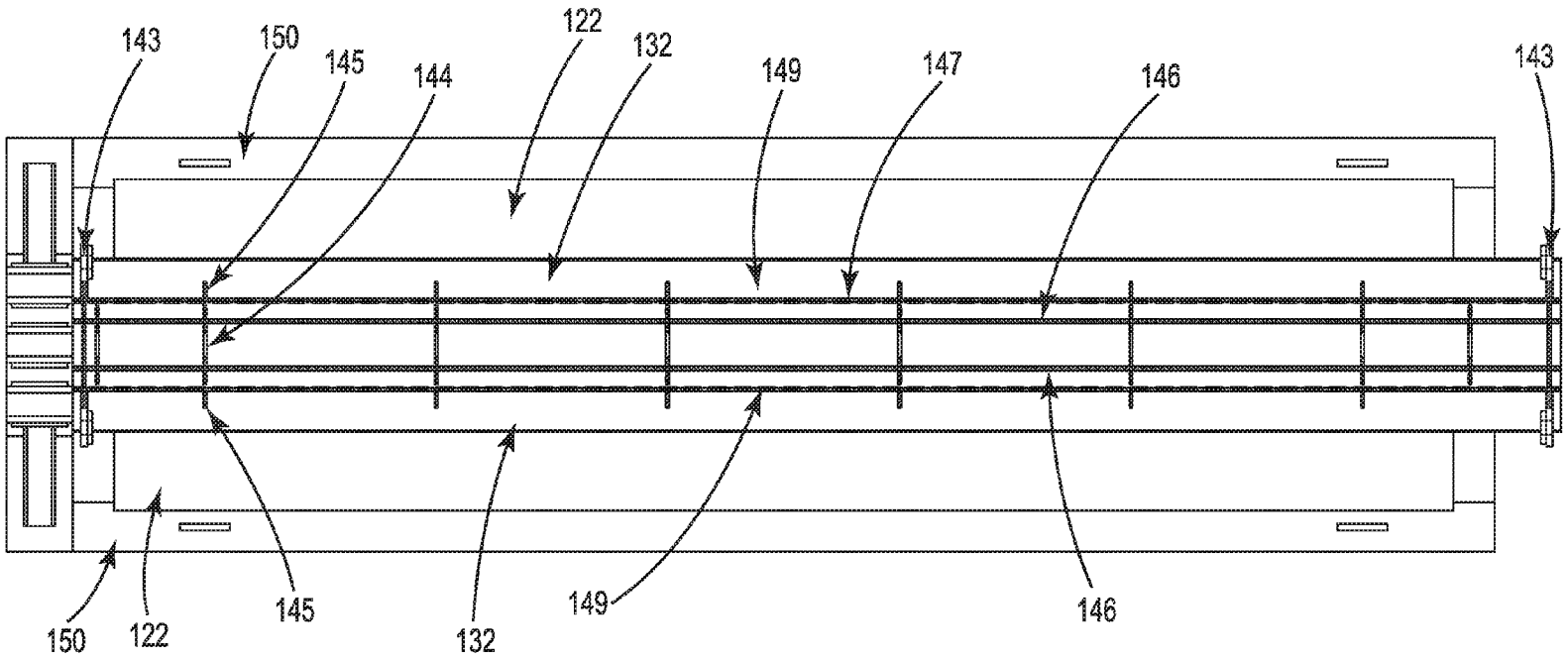
FIG. 12 is an overhead view of a base layer, first intermediary layer, and second intermediary layer of a rail segment of the present disclosure, according to one or more embodiments.
Figure 13:
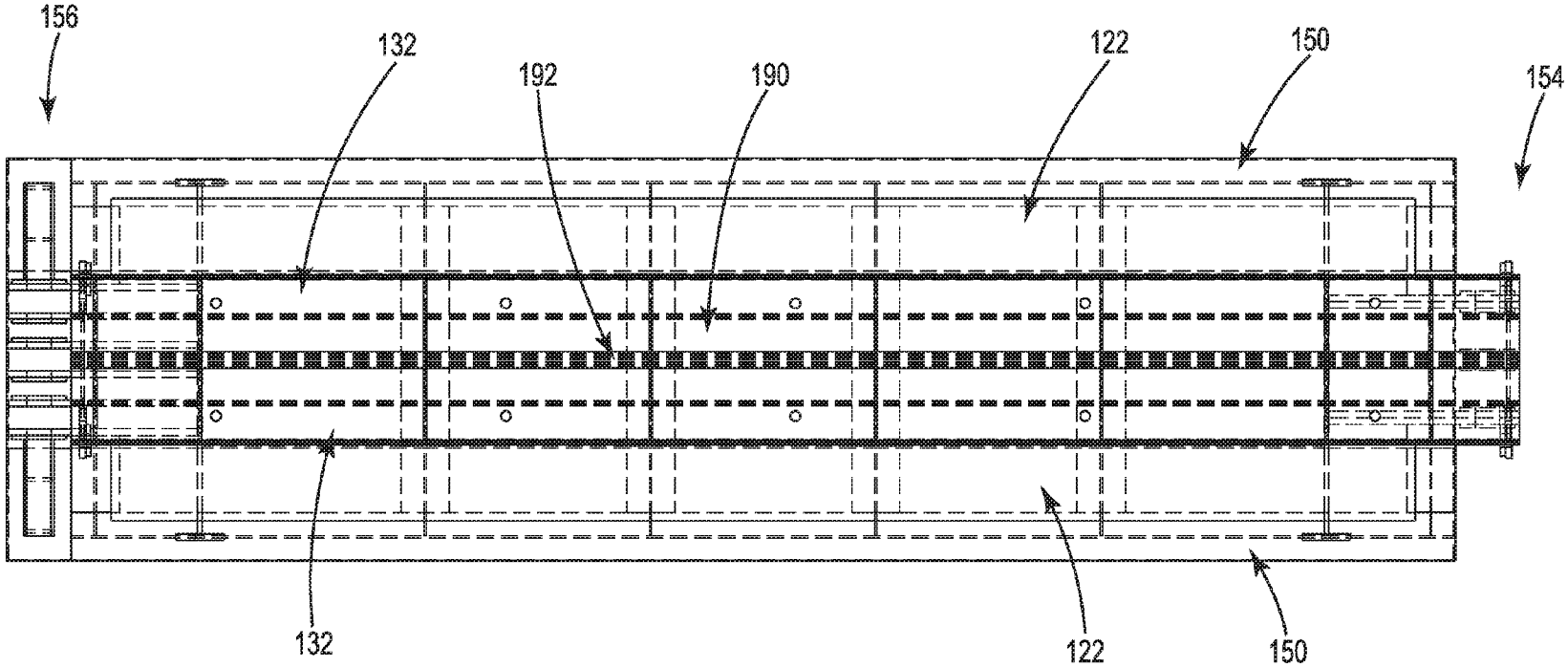
FIG. 13 is an overhead internal view of a rail segment of the present disclosure, according to one or more embodiments.

FIG. 12 illustrates an overhead view of the second intermediary layer 116 arranged over the first intermediary layer 114 and base layer 112. As shown, the second intermediary layer 116 may generally be centered over the first intermediary layer 114. FIG. 12 illustrates the arrangement of the brackets 144 within the triangular support structure 142. As shown, the spacing of the brackets 144 may be symmetrical between the outermost edges of the segment 102. As may additionally be seen in FIG. 12, the rail assembly supports 145 may be aligned with at least some of the brackets 144.

Figure 3D:
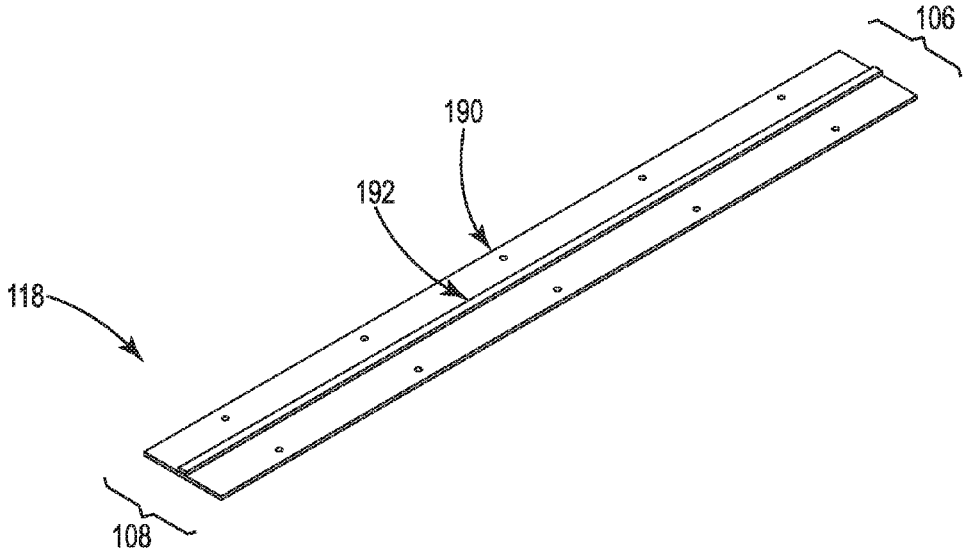
FIG. 3D is a perspective view of a rail assembly guide of a rail segment of the present disclosure, according to one or more embodiments.

Turning now to FIG. 3D, the roller assembly guide 118 may be arranged over the second intermediary layer 116. For example, as shown in FIG. 10, the roller assembly guide 118 may be arranged over and generally supported by a top point of the triangular support structure 142, outer panels 149, and/or roller assembly supports 145. The roller assembly guide 118 may extend over the segment 102 to allow a drilling rig to roll over or be positioned on the segment. As shown in FIG. 3D, the roller assembly guide 118 may include a plate portion 190 and a rail portion 192. Together, the plate portion 190 and rail portion 192 may operate to position a roller assembly of a drilling rig on the rail segment 102.

The plate portion 190 may have an elongated shape, extending the length or a substantial portion of the length of the segment 102. For example, the plate portion 190 may have a length of between about 3 to about 20 meters in some embodiments. Particularly, the plate portion 190 may have a length of between about 5 and about 15 meters in some embodiments. More particularly, the plate portion 190 may have a length of between about 8 and about 10 meters in some embodiments. The plate portion 190 may have any suitable width to accommodate a rail assembly of a drilling rig. For example, in some embodiments, the plate portion 190 may have a width of between about 50 and about 200 centimeters. Particularly, the plate portion 190 may have a width of between about 75 and about 125 centimeters in some embodiments. The plate portion 190 may have any suitable thickness.

The rail portion 192 may be a notch extending from the plate portion 190 and may be configured to engage with a groove or other element of a roller assembly, so as to position the roller assembly on the plate portion. The rail portion 192 may be arranged along a longitudinal axis of the plate portion 190. The rail portion 192 may have an elongated shape, and may have any suitable length. In some embodiments, the rail portion 192 may have the same length as the plate portion 190 so as to guide a rail assembly along the length of the plate portion. In other embodiments, the rail portion 192 may have a different length. The rail portion 192 may extend upward from the plate portion 190. In some embodiments, the rail portion 192 may have a height extending from the plate portion 190 of distance of between about 10 and about 200 millimeters. Particularly, the rail portion 192 may have a height extending between about 25 and about 75 millimeters from the plate portion 190 in some embodiments. The rail portion 192 may have a width of between about 5 and about 50 centimeters in some embodiments. Particularly, the rail portion 192 may have a width of between about 5 and about 20 centimeters in some embodiments. Generally, the rail portion 192 may have any suitable width and height suitable for engaging with a rail assembly of a drilling rig. It may be appreciated that in some embodiments, a railroad rail may be used in place of the plate portion 190 and/or rail portion 192.

The rail segment 102 may generally provide for three structural loading points in some embodiments. Rails of the present disclosure may be configured to transport and/or support various equipment, including a drilling rig having a movement system including rollers and jacks, and mud system equipment having rollers. The rail portion 192 may provide a loading point for mud system rollers, drilling rig jacks, and/or other equipment in some embodiments. Two outer structural loading points may be provided on the plate portion 190 above each of the outer panels 149. These outer structural loading points may provide loading points for drilling rig rollers, drilling rig jacks, and/or other equipment.

As mentioned, rail segments 102 of the present disclosure may be configured to couple to one another in a continuous line, forming a rail 100. It may be appreciated that connections 104 between the rail segments 102 may be moment resistant connections that may transfer bending, shear, and/or other forces experienced by a rail segment to adjacent rail segments. This may allow loads on the rail segments 102 to be better distributed along the rail 100, such that individual segments may be less likely to experience excessive loading. The moment resisting connection 104 between adjacent segments may be achieved by configuring a portion of the connection to be in tension and a portion of the connection to be in compression when one or more of the segments experiences loading.

Figure 14A:
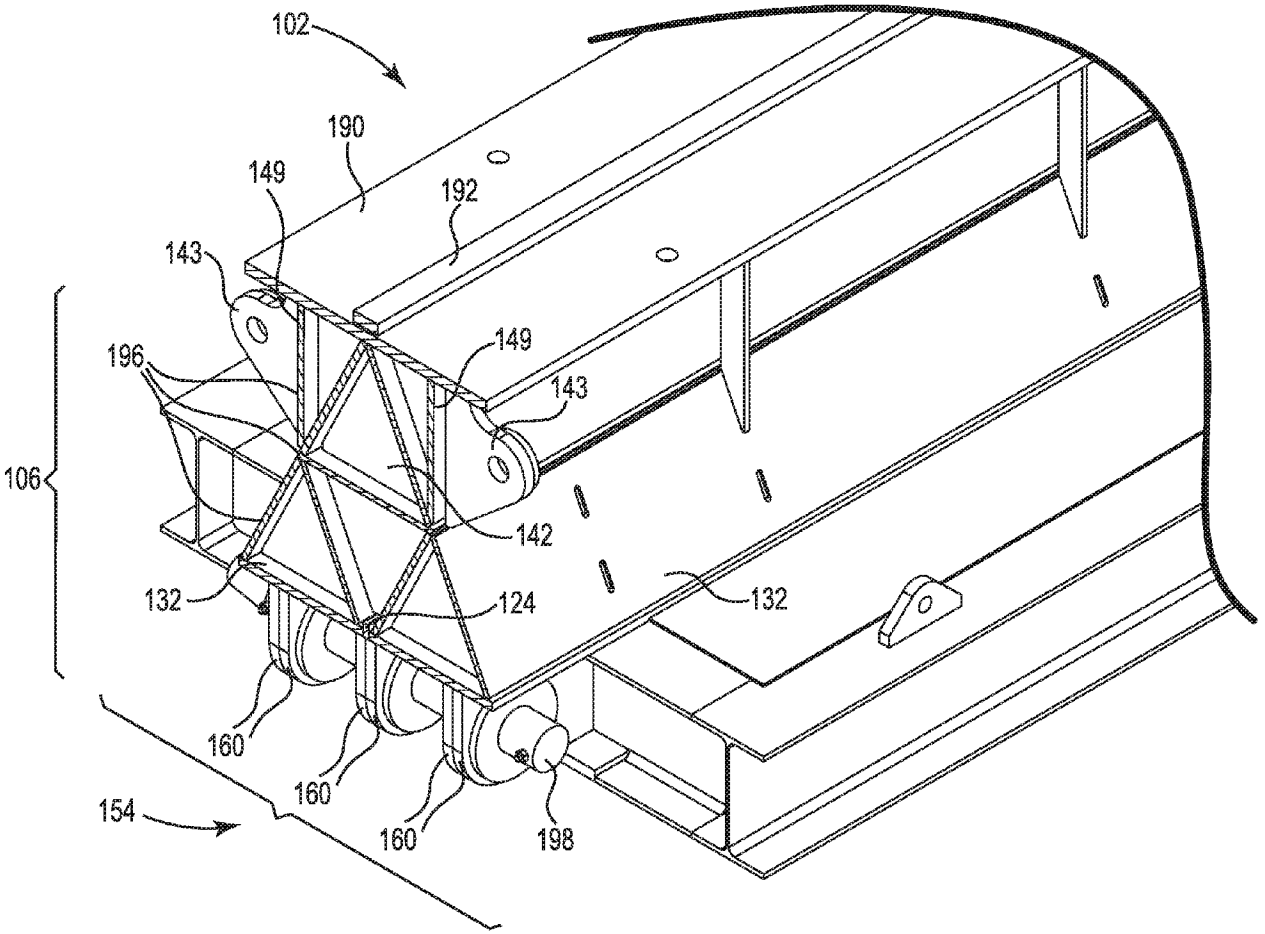
FIG. 14A is a protruding end view of a rail segment of the present disclosure, according to one or more embodiments.
Figure 14B:
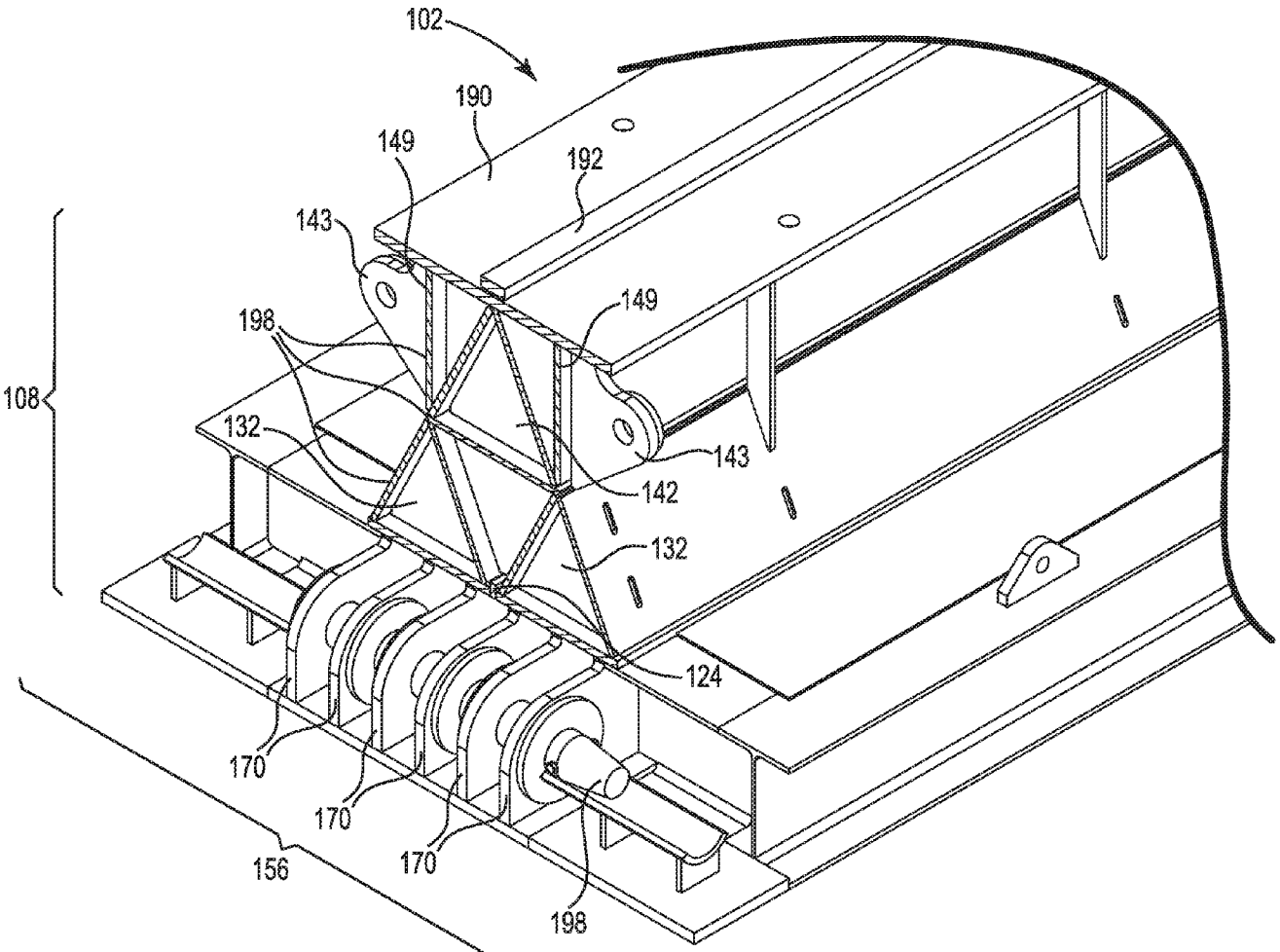
FIG. 14B is a receiving end view of a rail segment of the present disclosure, according to one or more embodiments.
Figure 15:
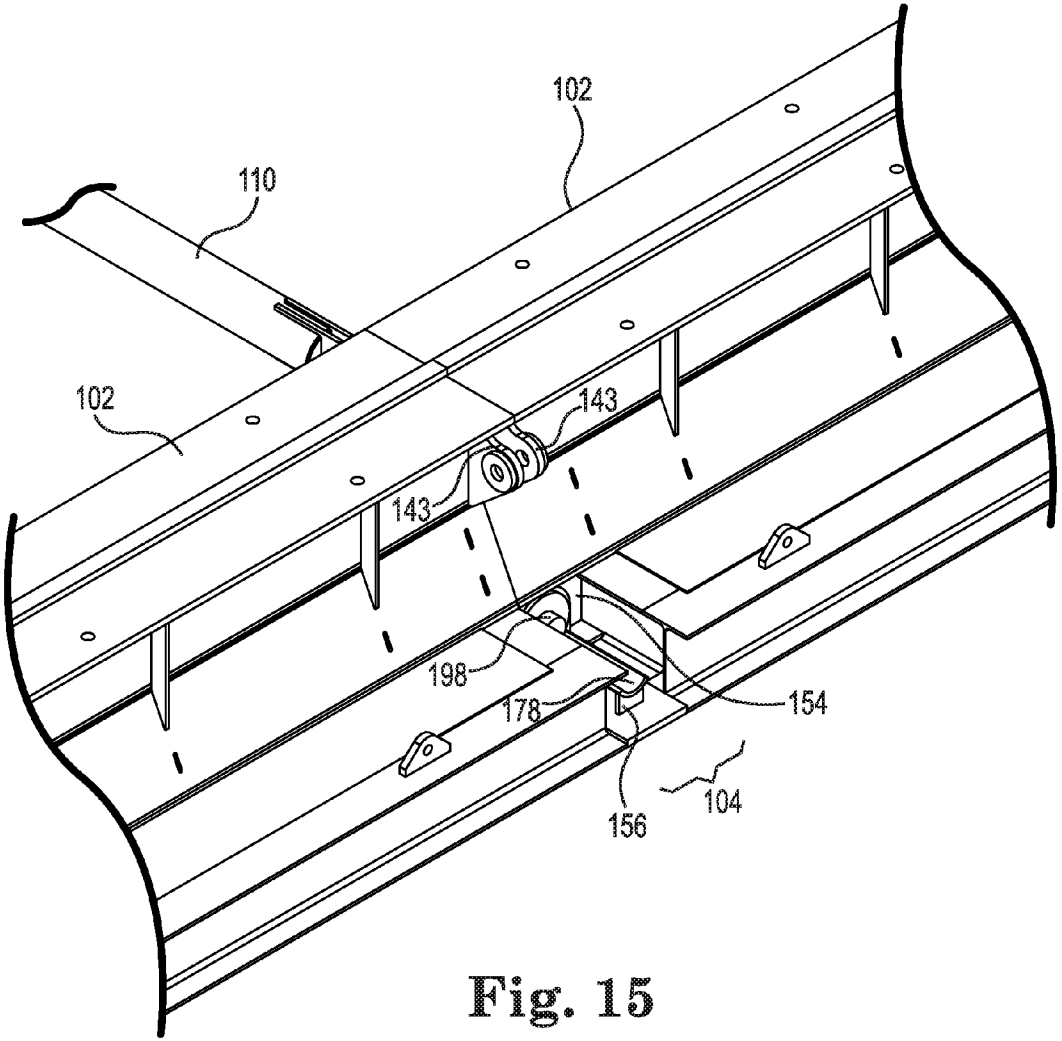
FIG. 15 is a perspective view of a connection between two rail segments of the present disclosure, according to one or more embodiments.

FIGS. 14A and 14B illustrate the protruding end 106 and receiving end 108, respectively, of rail segment 102. As described above, the protruding end 106 may have a protruding connector 154 and a pair of upper lugs 143 configured to couple to a receiving end 108 of an adjacent segment 102. Similarly, the receiving end 108 may have a receiving connector 156 and a pair of upper lugs 143 configured to couple to a protruding end 106 of an adjacent segment 102. Additionally, protruding end 106 may have a contact face or surface 196 that contacts an adjacent segment 102 when the segments are coupled together. Similarly, receiving end 108 may have a contact face or surface 198 that contacts an adjacent segment 102 when the segments are coupled together. Together, the connectors 154, 156, upper lugs 143, and contact surfaces 196, 198 of adjacent segments 102 may act to couple the segments together. FIG. 15 shows a protruding end 106 of one segment 102 coupled with a receiving end 108 of an adjacent segment at a moment resisting connection 104.

Figure 16:
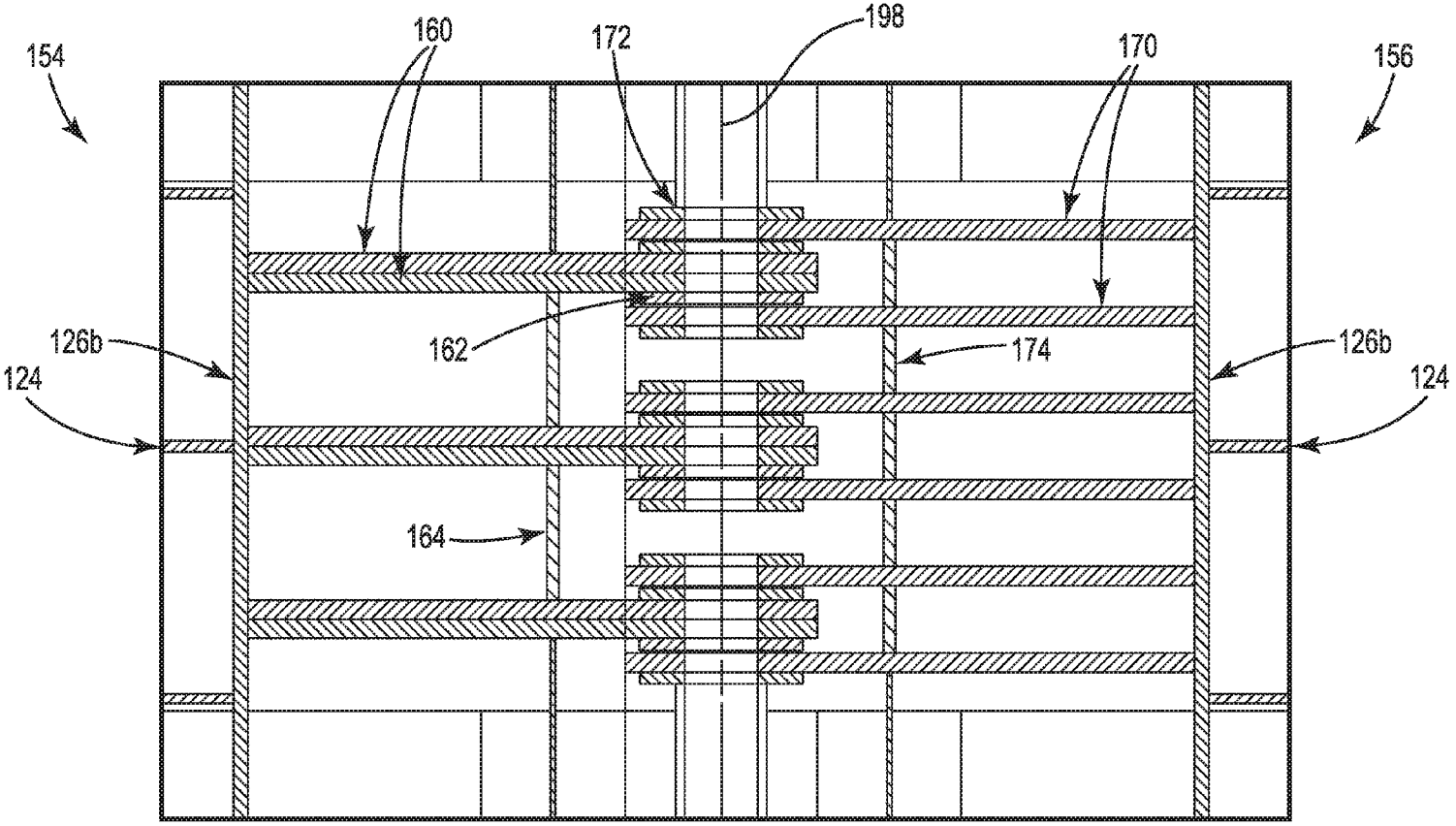
FIG. 16 is an overhead cross sectional view of a connection between two rail segments of the present disclosure, according to one or more embodiments.

Two segments 102 may couple together via the protruding connector 154 of one segment 102 and the receiving connector 156 of an adjacent segment. Specifically, the connecting lugs 160 of the protruding connector 154 may be configured to fit between the connecting lugs 170 of the receiving connector 156 of an adjacent segment 102, as shown for example in FIG. 16. For example, where the connecting lugs 160 and 170 are each arranged in pairs, each pair of connecting lugs 160 on the protruding connector 154 may fit between each pair of connecting lugs 170 on the receiving end 156, as shown. In this way, the lugs 160 of the protruding connector 154 may be arranged over the lower plate 130 of the adjacent segment 102. In some embodiments, a pin 198 may be positioned through lugs 160 and 170 to couple the two segments 102. In other embodiments, a bolt, screw, or other device may be arranged through the lugs 160, 170 to couple the segments 102. Ends of the pin 198 protruding from the lugs 160, 170 may be arranged on the pin holding member 178 of the receiving connector 156.

As additionally shown in FIG. 15, when the protruding connector 154 and receiving connector 156 of adjacent segments 102 are coupled, upper lugs 143 of the two segments may be aligned. A pin, bolt, screw, or other device may be positioned adjacent upper lugs 143 of adjacent segments 102 to couple the lugs together. Moreover, in some embodiments, a crossbar 110 may be coupled to the rail 100 via the upper lugs 143 of adjacent segments 102. For example, the crossbar 110 may have a lug that may be arranged between upper lugs 143 of adjacent segments 102. The pin, bolt, screw, or other device positioned through adjacent upper lugs 143 may additionally be positioned through a lug of the crossbar 110.

As mentioned, each end 106, 108 may have a contact surface 196, 198, respectively. A protruding end contact surface 196 may be in communication with a receiving end contact surface 198 of an adjacent segment 102 when the two segments are coupled together via the upper lugs 143 and connectors 154, 156. As shown in FIG. 14A, contact surface 196 of the protruding end 106 may include an end surface of the roller assembly guide plate portion 190 and rail portion 192, triangular support structure 142 and outer panels 149, and triangular support structures 132 and spine portion 124. In other embodiments, the contact surface 196 may include more, fewer, or different surfaces. Each end surface comprising the contact surface 196 may generally be arranged on a same vertical plane. Similarly, as shown in FIG. 14B, contact surface 198 of the receiving end 108 may include an end surface of the roller assembly guide plate portion 190 and rail portion 192, triangular support structure 142 and outer panels 149, and triangular support structures 132 and spine portion 124. In other embodiments, the contact surface 198 may include more, fewer, or different surfaces. Each end surface comprising the contact surface 198 may generally be arranged on a same vertical plane. When two segments 102 are coupled together via the connectors 154, 156 and/or upper pugs 143, the receiving end contact surface 198 of one segment may abut the protruding end contact surface 196 of the other segment.

The connection formed between adjacent segments 102 by the connectors 154, 156 and upper lugs 143 may be a moment resisting connection, which may transfer at least a portion of loads experienced by one rail segment to adjacent segments. The moment resisting connection may be configured such that, when a force acts on a rail segment 102, the connection between that segment and an adjacent segment comprises both a tension connection and a compression connection. That is, the protruding end 106 and receiving end 108 may be configured such that, in response to loading on the rail 100, coupled connectors 154, 156 may experience tension forces, while contact surfaces 196, 198 may experience compression forces. The opposing tension and compression forces on the connection may allow bending moments and shear forces to pass from one segment 102 to an adjacent segment through the connection. In this way, when a segment 102 experiences forces from, for example, loading from a drilling rig or wind loading, the forces on the segment may be distributed to adjacent segments via the moment resisting connections. It may be appreciated that such moment resisting connections may mitigate deformation, beam deflection, shearing, or sinking of individual segments 102 due to loading forces.

Figure 17A:
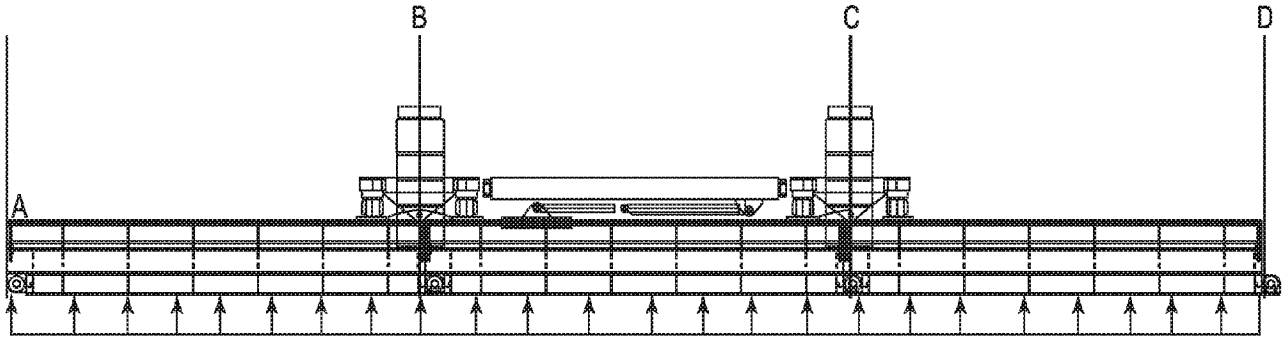
FIG. 17A is a free body diagram of a rail of the present disclosure supporting a drilling rig, according to one or more embodiments.
Figure 17B:
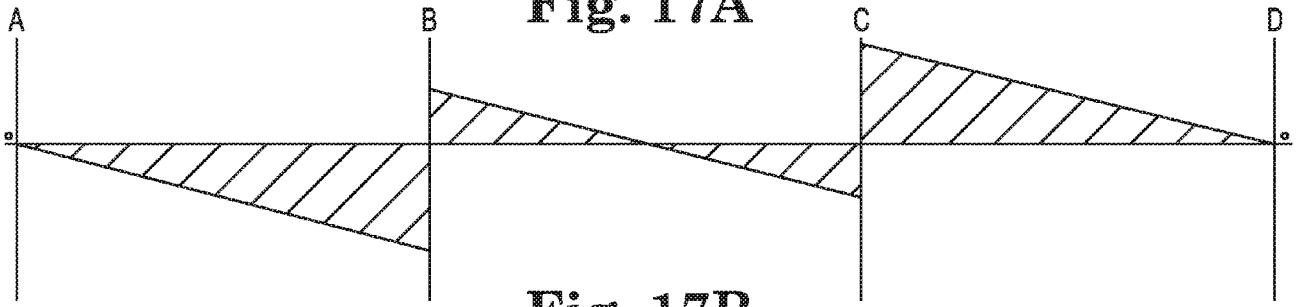
FIG. 17B is a shear force diagram of the rail of FIG. 17A, according to one or more embodiments.
Figure 17C:
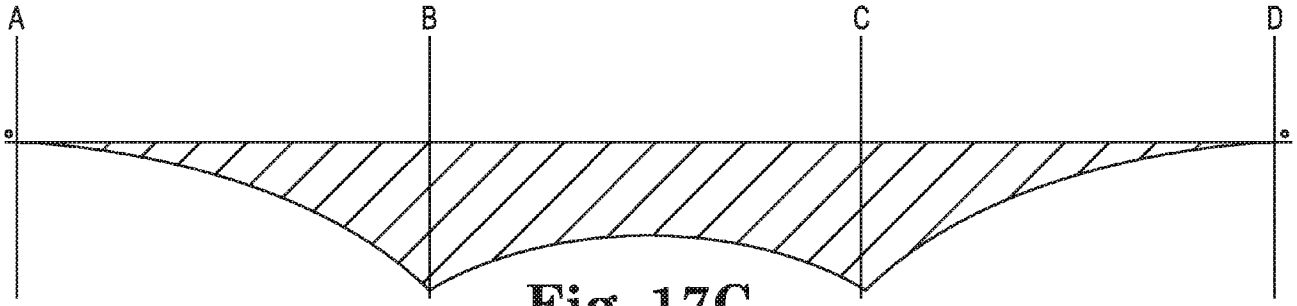
FIG. 17C is a bending moment diagram of the rail of FIG. 17A, according to one or more embodiments.

For example, FIG. 17 illustrates a free body diagram and internal reaction forces within a series of rail segments in response to vertical loading from a drilling rig. FIG. 17A shows a free body diagram of a rail 400 experiencing loading from a drilling rig 410 and an opposing ground reaction. The rail 400 may be one of a pair of rails supporting the drilling rig 410. The rail 400 may have a plurality of rail segments 402 joined at connection points 404. The drilling rig 410 may have two rail assemblies 412 contacting each rail 400, such that loading from the weight of the rig or from drilling operations passes to each rail 400 via the rail assemblies. The drilling rig 410 may be positioned at generally any point along the rail 400. As shown in FIG. 17A, the rail assemblies 412 may be arranged over or generally aligned with the connection points 404 between segments 402 in some embodiments. It may be appreciated that when the rail assemblies 412 are positioned over the connection points 404, the connection points may experience more internal compression, tension, bending, and shear forces than when the rail assemblies are arranged differently on the segments 402. As shown in FIG. 17A, in response to the vertical forces from the rig 410, the rail 400 may additionally experience ground reaction forces distributed across the full length of the three segments 402. FIG. 17B is a shear force diagram of internal shear forces experienced by the segments 402, and corresponding with the free body diagram of FIG. 17A. As shown, the internal shear forces of each segment 402 may be highest at the points where the rail assemblies 412 are arranged on the rail 400, and may be particularly high on the segments 402 adjacent to the segment over which the rig 410 is arranged. FIG. 17C is a bending moment diagram of internal bending moments experienced by the segments 402, and corresponding to the free body diagram of FIG. 17A. As shown, the internal bending moments of each segment 402 may be highest at the points where the rail assemblies 412 are arranged on the rail 400. It may be appreciated with respect to FIG. 17 that a rail 400 may include more than three segments 402. Where the rail 400 has more than three segments 402, the compression, tension, bending, and shear forces experienced by the rail would be distributed among more than three segments via the connection points 404. That is, for example, the shear and bending moment forces shown in FIGS. 17B and 17C with respect to loading on a rail 400 having three segments 402 would be reduced with more segments connected.

The moment resistant connections formed between segments of the present disclosure may be configured to withstand the internal vertical shear and bending forces described above with respect to FIG. 17. Particularly, bending moments at the connections between segments may be resisted by tension on the interlocking lugs of the two segments connected by a shear pin, and compression on the two abutting contact surfaces. Moreover, shear forces at the connections between segments may be resisted by the shear pin connecting the interlocking lugs and by friction between the two abutting contact surfaces. In this way, it may be appreciated that the shear pin passing through the connector lugs of two adjoined segments may be subject to horizontal shear from bending moments, as well as vertical shear due to internal shear forces of the segments.

Additionally, a rail segment of the present disclosure may have a cross sectional shape configured to resist deflection. In response to loading from a drilling rig, for example, and opposing ground reaction forces, a rail segment or multiple segments in a rail may have a tendency to bend or deflect. By providing moment resistant connections between adjacent segments, loading on the segments from a drilling rig, for example, may be distributed among multiple rail segments, thus reducing the opposing ground reaction forces on each segment, and thereby reducing the potential for deflection. Moreover, due to the cross sectional shape design, a rail segment of the present disclosure may have a higher moment of inertia than that of conventional rail segments. For example, a major axis moment of inertia for a rail segment of the present disclosure may be between about 70 billion $mm^4$ and about 80 billion $mm^4$ in some embodiments. In other embodiments, a major axis moment of inertia for a rail segment may be higher or lower. With a higher moment of inertia, a rail segment of the present disclosure may provide for less deflection or bending in response to loading.

Figure 18:
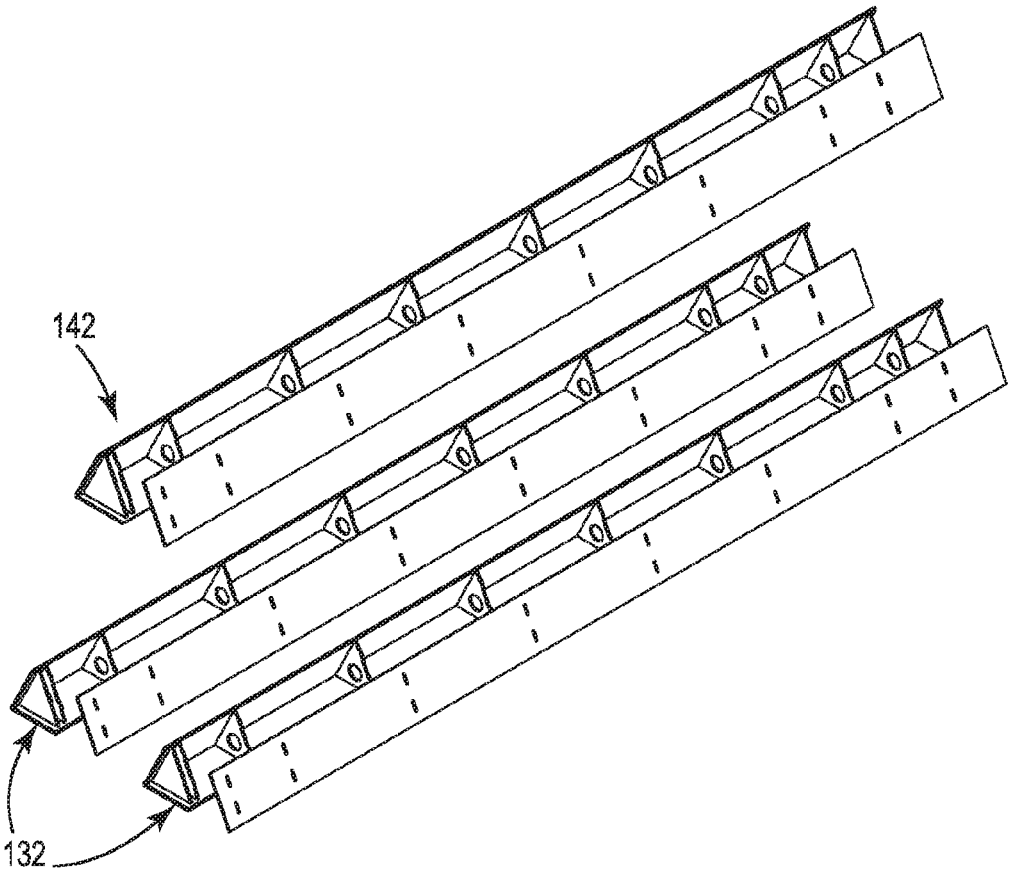
FIG. 18 is a perspective view of three triangular support structure of a rail segment of the present disclosure, according to one or more embodiments.
Figure 19:
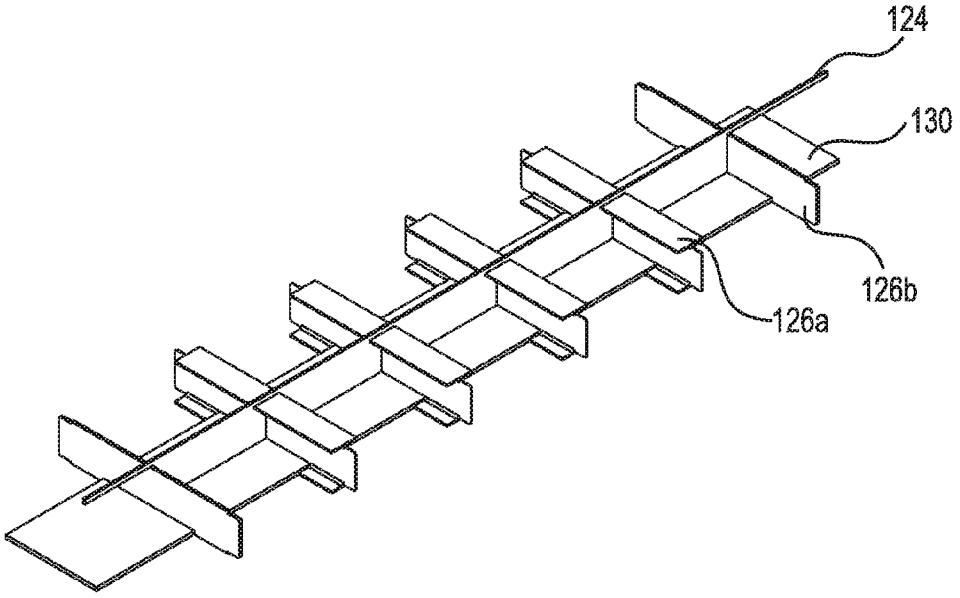
FIG. 19 is a perspective view of a portion of a base layer of a rail segment of the present disclosure, according to one or more embodiments.
Figure 20:
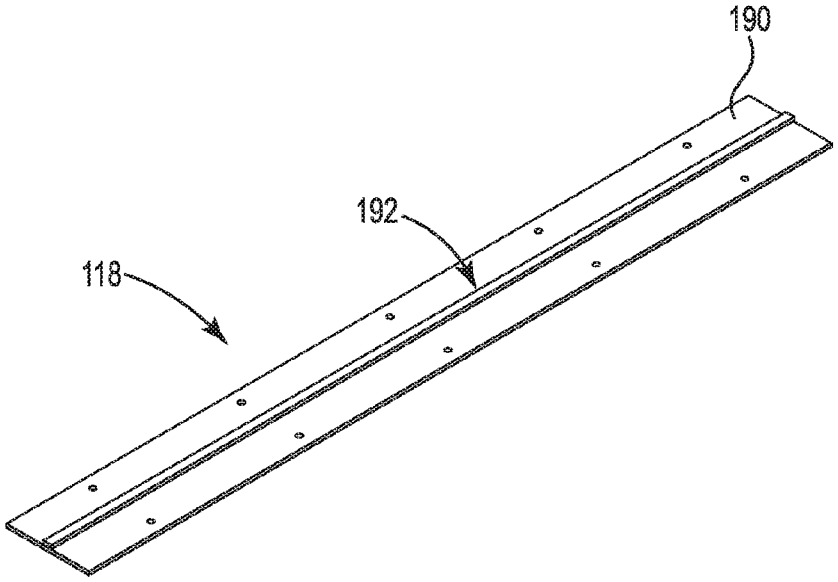
FIG. 20 is a perspective view of a rail assembly guide of a rail segment of the present disclosure, according to one or more embodiments.
Figure 21:
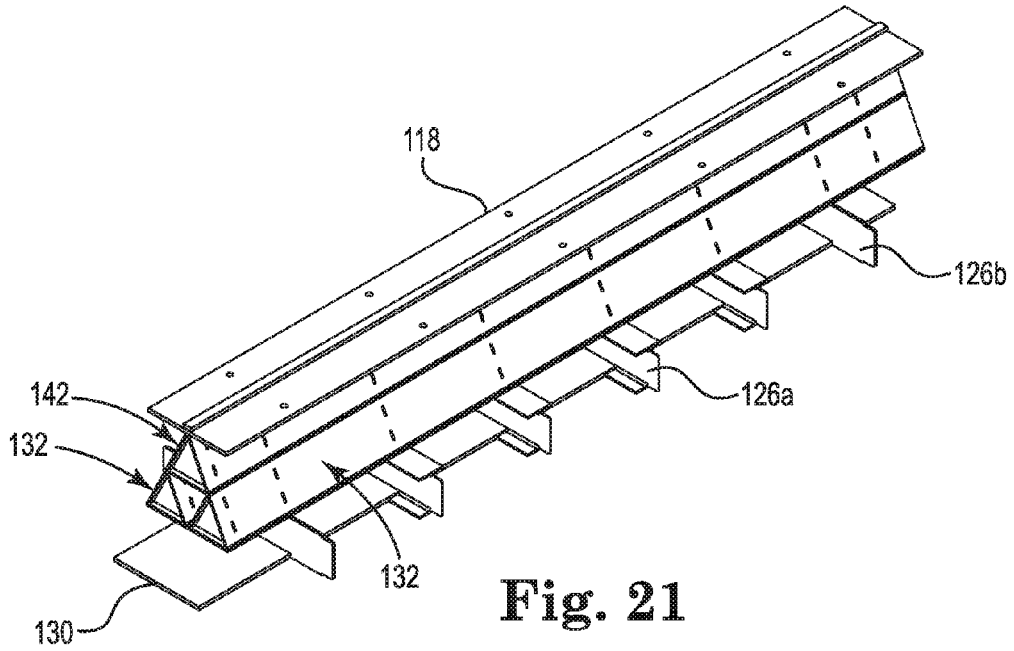
FIG. 21 is a perspective view of the components of FIGS. 14-16 assembled together, according to one or more embodiments.
Figure 22:
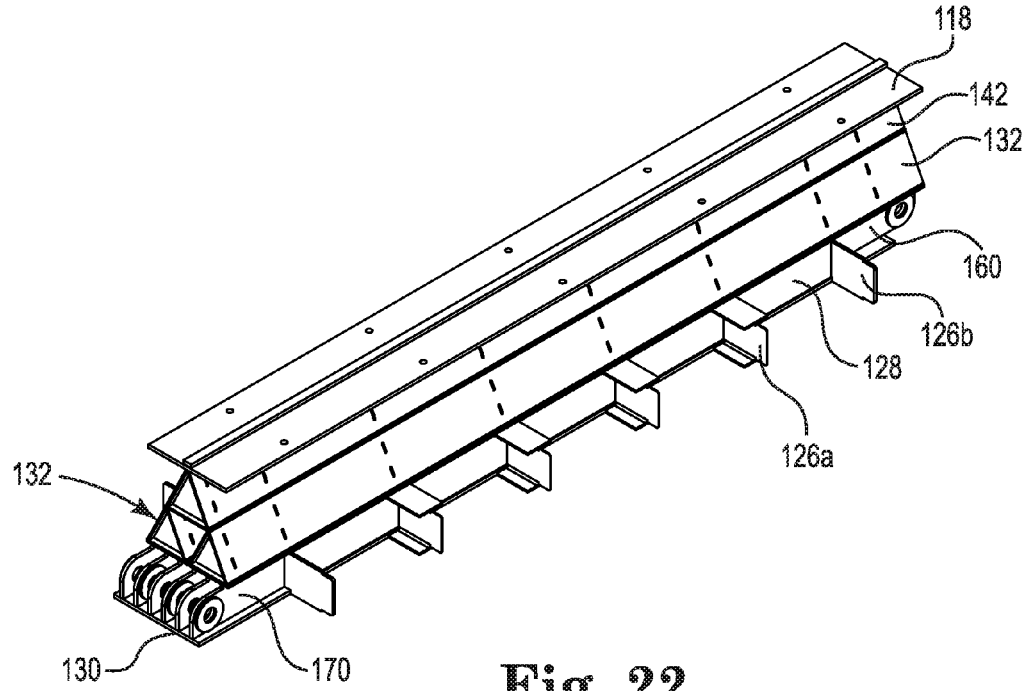
FIG. 22 is a perspective view of the elements of FIG. 17, and additionally protruding connector lugs and receiving connector lugs, according to one or more embodiments.
Figure 23:
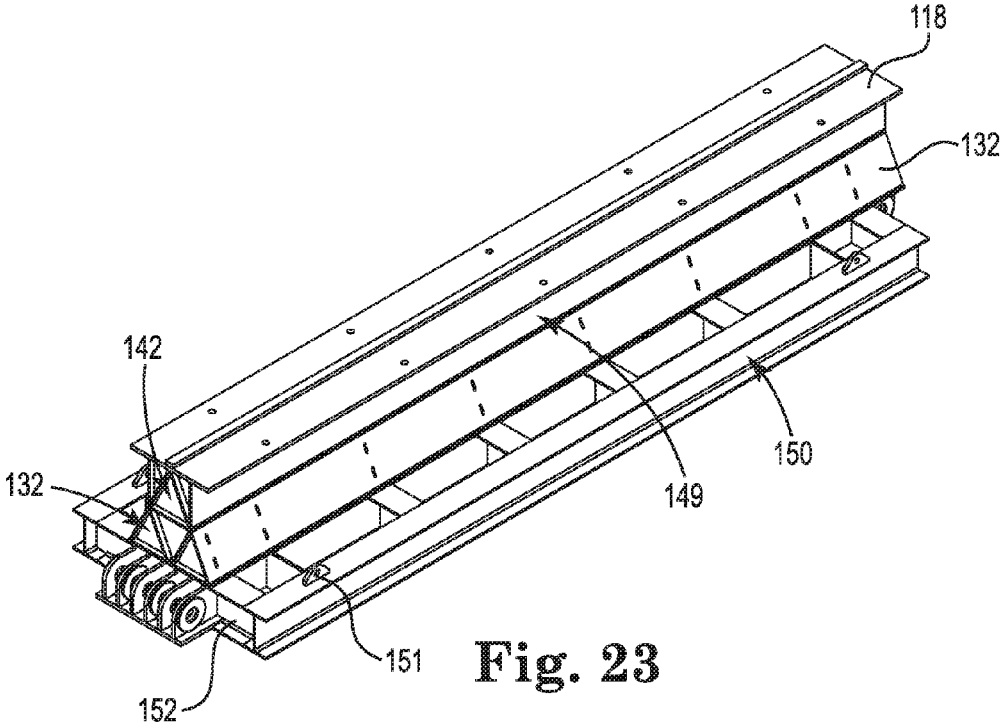
FIG. 23 is a perspective view of the elements of FIG. 18, and additionally outer beam portions, cross beam portions, outer panels, end caps, and lugs, according to one or more embodiments.
Figure 24:
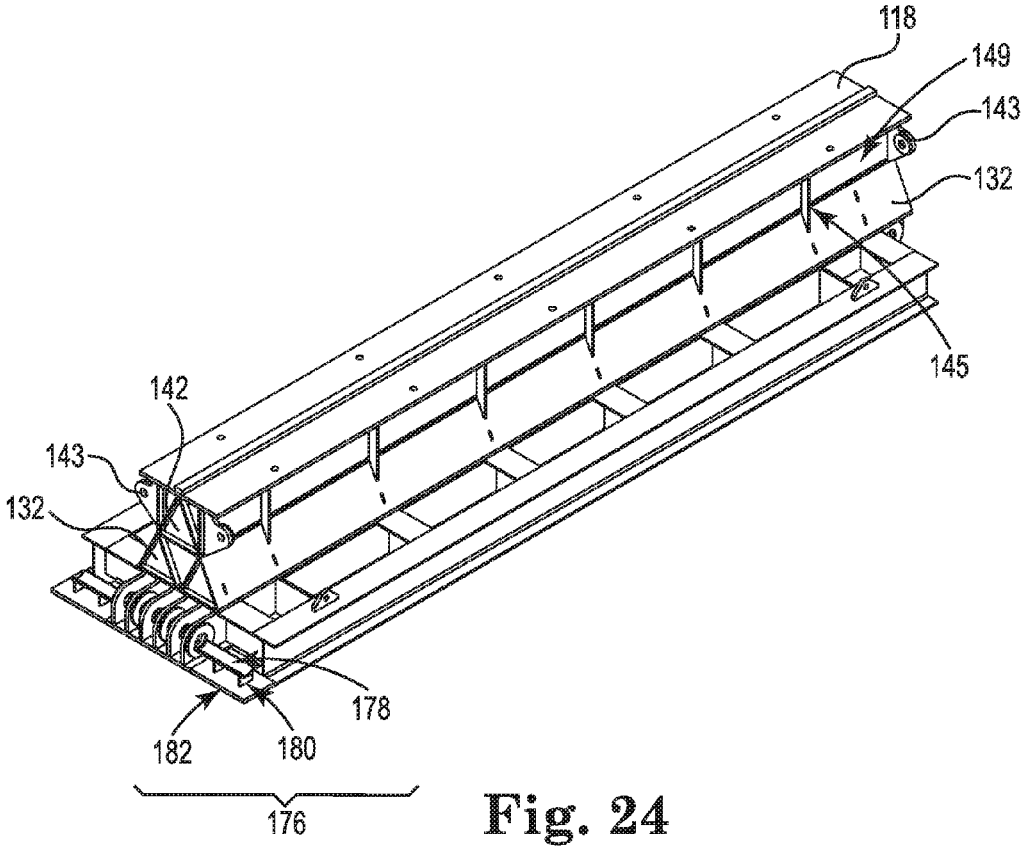
FIG. 24 is a perspective view of the elements of FIG. 19, and additionally upper lugs, roller assembly supports, and pin holding assemblies, according to one or more embodiments.
Figure 25:
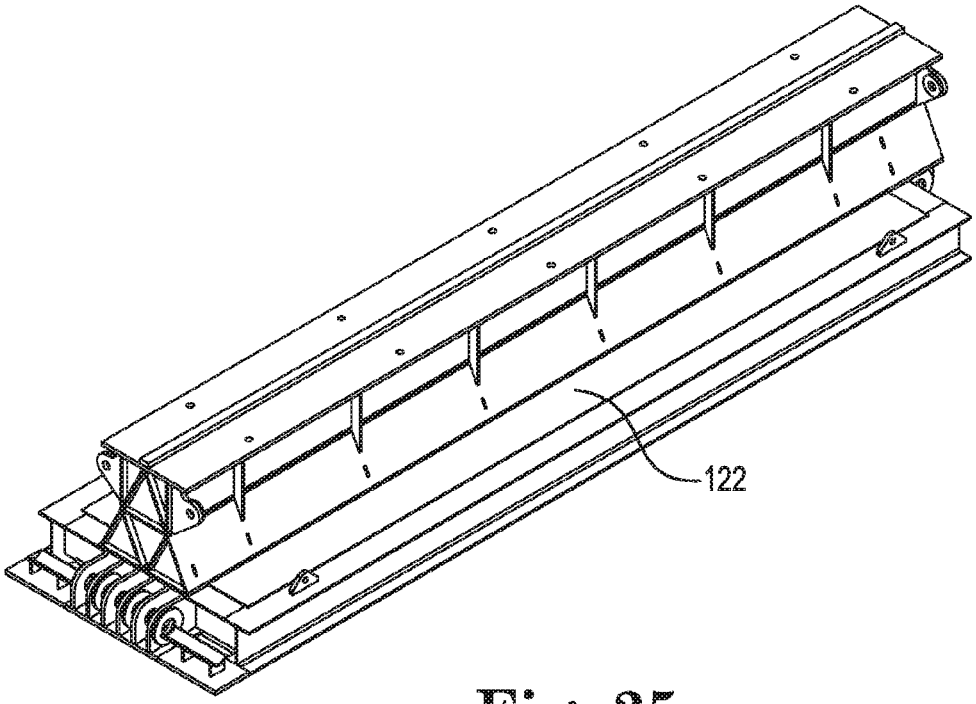
FIG. 25 is a perspective view of the elements of FIG. 20, and additionally cover plates, according to one or more embodiments.

Turning now to FIGS. 18-25, a series of steps for assembling a rail segment 102 of the present disclosure is shown. As shown in FIG. 18, the triangular support structures 132, 142 of each of the first and second intermediary layers 114, 116 may be assembled. That is, for each of two triangular support structures 132, the plurality of brackets 134 may be arranged between side panels 136, bottom panel 137, and end caps 138*a*. Similarly, to form triangular support structure 142, the plurality of brackets 144 may be arranged between side panels 146, bottom panel 147, and end caps 148*a*. As shown in FIG. 19, a portion of the base layer 112 may be assembled. Specifically, the spine portion 124 and plurality of rib portions 126 may be arranged over lower plate 130. As shown in FIG. 20, the roller assembly guide 118 may be assembled by coupling the rail portion 192 to the plate portion 190. As shown in FIG. 21, the portion of the base layer 112 from FIG. 19, triangular support structures 132, 142, and roller assembly guide 118 may be assembled together. That is, the triangular support structures 132 may be arranged over the spine portion 124 and rib portions 126. End caps 138*b* may be arranged between the triangular support structures 132. The triangular support structure 142 may be arranged over triangular support structures 132. The roller assembly guide 118 may be arranged over triangular support structure 142. As seen in FIG. 22, the protruding connector lugs 160 and receiving connector lugs 170 may be arranged on the segment 102. Specifically, the connectors lugs 160, 170 may be arranged over the lower plate 130, as described above. FIG. 23 shows the addition of outer beam portions 150, cross beam portions 152, outer panels, end caps 148*b*, and lugs 151. The outer beam portions 150 may be arranged adjacent to or about the rib portions 126, and the cross beam portions 152 may be arranged between the outer beam portions 150 and lower plate 130. Outer panels 149 may be arranged beneath the roller assembly guide 118, and end caps 148*b* may be positioned between the outer panels and triangular support structure 142. Lugs 151 may be arranged on the outer beam portions 150. As shown in FIG. 24, the upper lugs 143 and roller assembly supports 145 may be coupled to the outer panels 149. An upper lug 143 may be arranged on each of the protruding end 106 and receiving end 108 of each outer panel 149. Roller assembly supports 145 may be arranged beneath the roller assembly guide 118. As additionally shown in FIG. 24, a pin holding member 178, pin holding supports 180, and pin holding plate 182 may be arranged on either side of the receiving connector 156. As shown in FIG. 25, cover plates 122 may be added to the segment 102 and arranged over the rib portions 126. In some embodiments, welding may be used to assemble the elements of the segment 102. Additionally or alternatively, screws, bolts, or other coupling mechanisms may be used to assemble the elements of the segment 102.

It may be appreciated that particular elements of the configuration of the segment 102 may provide for reduced manufacturing and/or production time in assembling the segment. Specifically, the triangular support structures 132, 142 may provide relatively inherently stiff support capable of resisting buckling, as compared with other shapes. The triangular support structures 132, 142 may require fewer stiffeners, less welding. A rail segment 102 having triangular support structures 132, 134 may additionally be constructed using at least some automated welding in some embodiments, and additionally or alternatively may be assembled using a jig. In some embodiments, a rail segment 102 of the present disclosure may be assembled in about one third less fabrication time, as compared with other rail segments.

Figure 37:
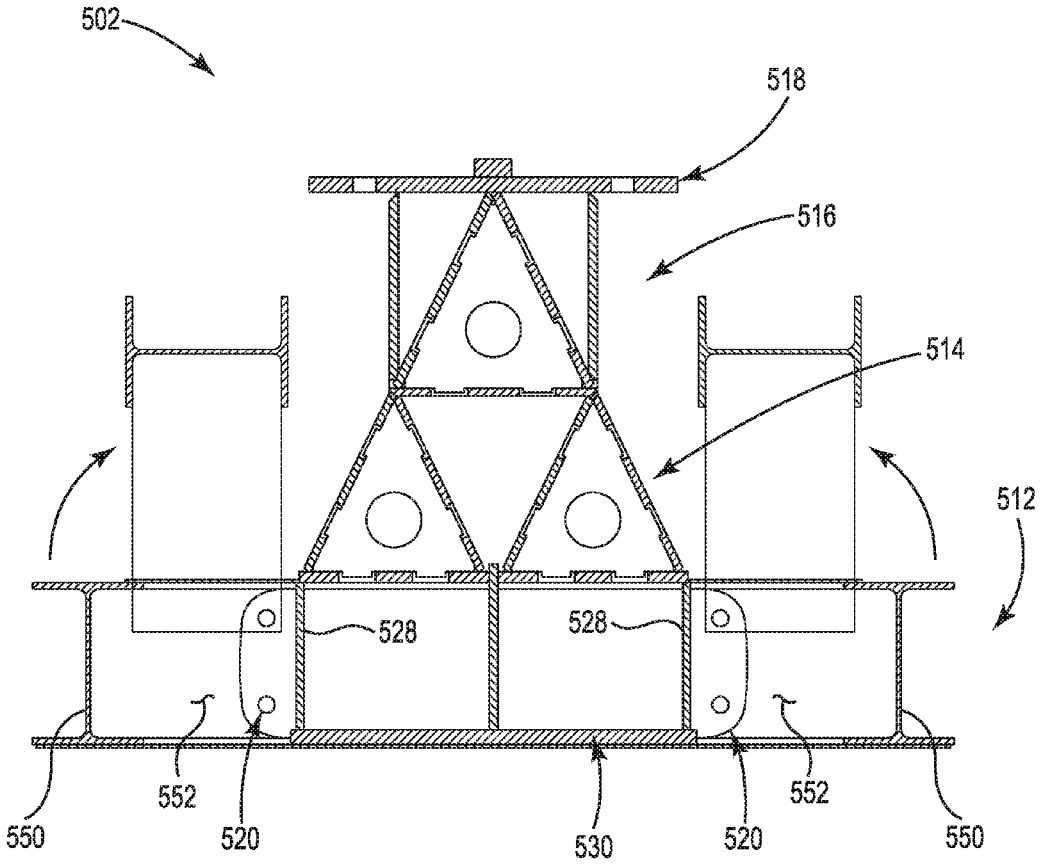
FIG. 37 is a cross sectional view of a hinged rail segment of the present disclosure, according to one or more embodiments.

In some embodiments, a rail segment of the present disclosure may have one or more pivotable and/or removable components, which may facilitate compliance with standard or required shipping, trucking, or transporting dimensions. For example, FIG. 37 illustrates a cross sectional view of a rail segment 502 of the present disclosure. The rail segment 502 may have a base layer 512, first intermediary layer 514, second intermediary layer 516, and roller assembly guide 518. In some embodiments, a portion of the base layer 512 and/or other layers of the segment may be configured to pivot and/or be readily removable from the segment 502. For example, in some embodiments, the base layer 512 may have a pair of hinges 520, as shown in FIG. 37. The hinges 520 may extend from each of two sides of the segment 502 and extend outward from a width of the segment. Each hinge 520 may extend outward from an internal panel 528, lower plate portion 530, or other component of the base layer 512, for example. Other components of the base layer 512 may be coupled to the base layer via the hinges 520. For example, outer beam portions 550 and cross beam portions 552 may couple to the base layer 512 at the hinges 520 via one or more bolts, screws, pins, or other connectors. In some embodiments, the base layer 512 may have more than one pair of hinges 520. For example, a pair of hinges 520 may extend from the base layer 512 at a location along the length of the segment 502 near a protruding end connector, while a second pair of hinges may extend at a location along the length near the receiving end connector. In other embodiments, hinges 520 may be spaced along the length of the base layer 512, for example. The hinges 520 may generally allow components of the base layer 512 and/or other components of the segment 502 to be readily removable and/or pivotable. For example, the outer beam portions 550, cross beam portions 552, and/or other elements may pivot upward about a pivot point of the hinges 520, as shown in FIG. 37. Additionally or alternatively, the outer beam portions, cross beam portions 552, and/or other elements may be readily removable, due to removable screws, bolts, pins or other connectors at the hinges 520. In this way, the outer beam portions 550, cross beams 552, and/or other components connected via the hinges 520 may be removed or pivoted to allow for easier shipping, trucking, or transporting of the segment. For example, where the segment 502, including outer beam portions 550 and other components extends to a width of approximately 12 meters, and each hinged portion has a width of approximately 4 meters, the hinged portions may be removed or pivoted in order to reduce the shipping width of the segment 502 to approximately 4 meters.

Figure 26A:
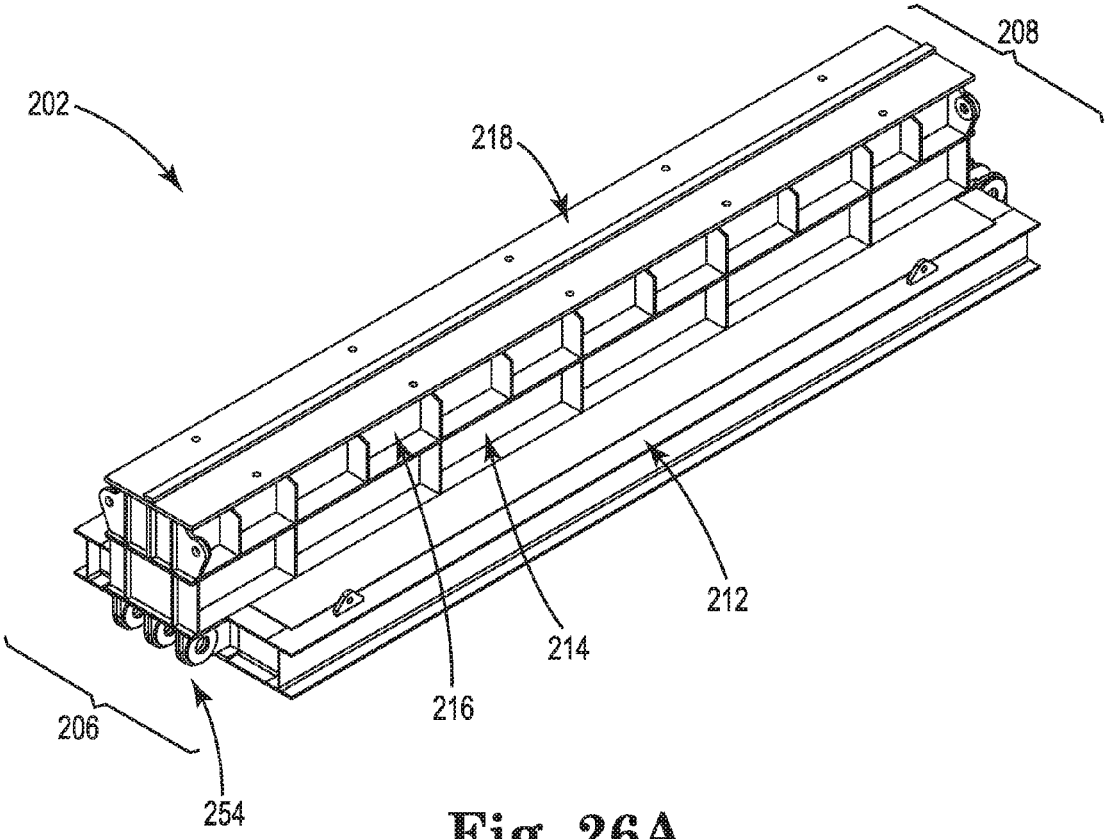
FIG. 26A is a perspective view of a rail segment of the present disclosure, according to one or more embodiments.
Figure 26B:
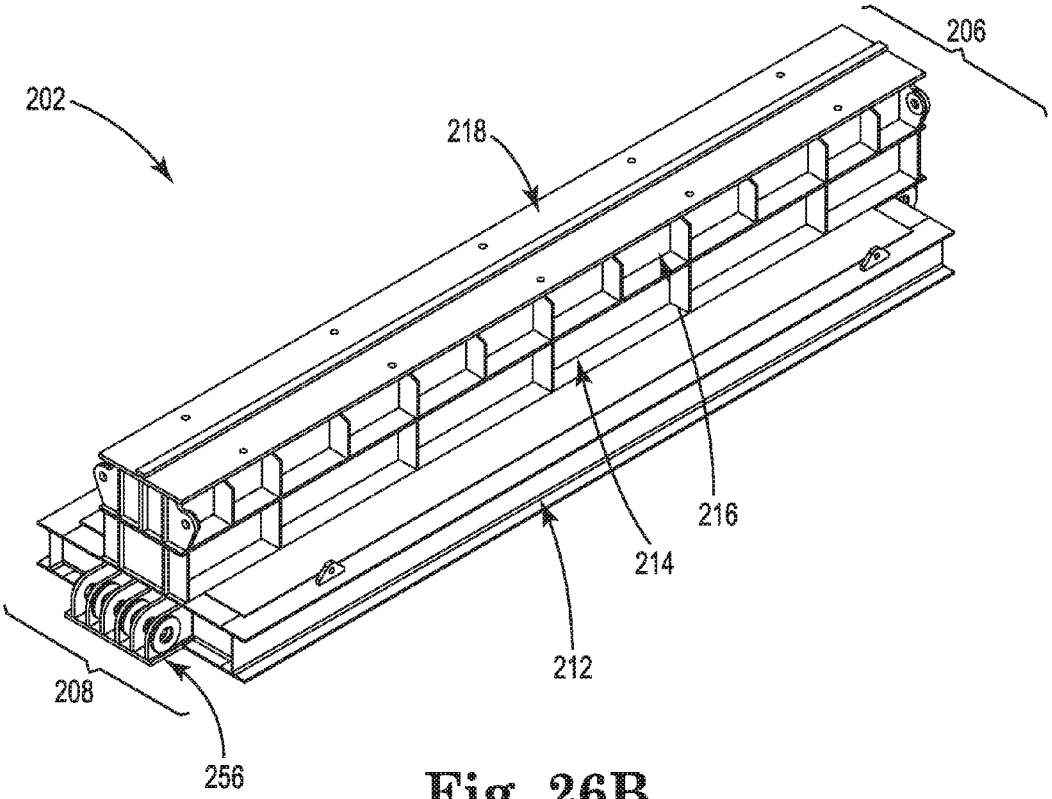
FIG. 26B is another perspective view of the rail segment of FIG. 25A, according to one or more embodiments.

Turning now to FIGS. 26A and 26B, another rail segment 202 of the present disclosure is shown. A plurality of rail segments 202 may be arranged in a continuous line and coupled together to form a rail of the present disclosure. The rail segment 202 may have features similar to that of the rail segment 102 described above. Particularly, the rail segment 202 may have a protruding end 206 having a protruding connector 254 and a receiving end 208 having a receiving connector 256. The segment 202 may further generally have a base layer 212, a first intermediary layer 214, a second intermediary layer 216, and a roller assembly guide 218. The base layer 212 may generally be arranged on the ground surface, a pad surface, or other surface on which the rail segment 202 is arranged. The base layer 212 may generally be configured to provide a supporting base for the segment 202 to transfer a load acting on the segment to the ground surface or other surface. The first and second intermediary layers 214, 216 may be arranged between the base layer 212 and the roller assembly guide 218, and may be configured to transfer a load acting on the roller assembly guide to the base layer. The roller assembly guide 218 may be configured to accommodate a roller assembly of a drilling rig assembly, such that the drilling rig assembly may be guided along the rail segment 202. The layered components of the segment 202 may be more clearly seen in FIGS. 27A-27D, for example.

Figure 27A:
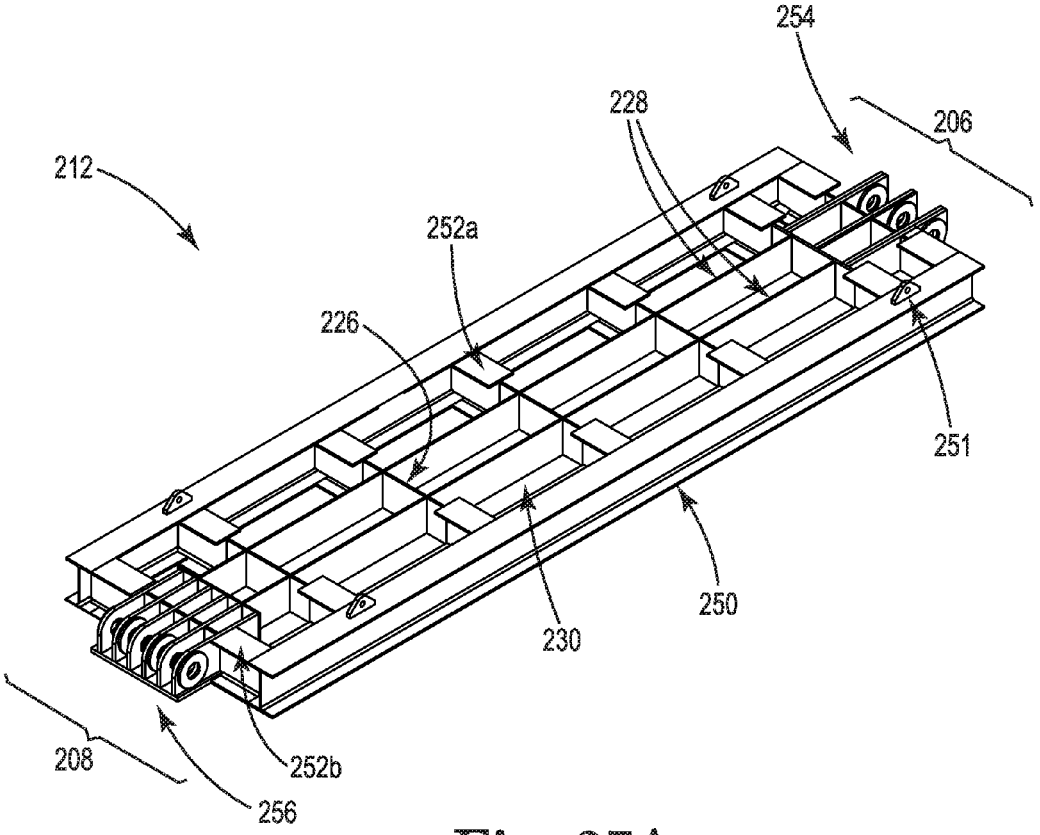
FIG. 27A is an exploded view of a base layer of a rail segment of the present disclosure, according to one or more embodiments.

Referring to FIG. 27A, the base layer 212 may have a lower plate portion 230, a plurality of rib portion 226, a plurality of internal panel portions 228, a pair of outer beam portions 250, a plurality of cross beam portions 252, a protruding connector 254, and a receiving connector 256.

The lower plate portion 230 may have an elongated shape, extending the length or a substantial portion of the length of the segment 202. For example, the lower plate portion 230 may have a length of between about 3 to about 20 meters in some embodiments. Particularly, the lower plate portion 230 may have a length of between about 5 and about 15 meters in some embodiments. More particularly, the lower plate portion 230 may have a length of between about 8 and about 10 meters in some embodiments. In some embodiments, the lower plate portion 230 may be similar to lower plate portion 130 discussed above with respect to segment 102. The lower plate portion 230 may be aligned with a longitudinal axis of the segment 202 in some embodiments, and may be configured to be positioned on the ground, pad, or other surface on which the segment is arranged. The lower plate portion 230 may have a width of between about 50 and about 200 centimeters. Particularly, the lower plate 230 may have a width of between about 75 and about 125 centimeters in some embodiments. The lower plate 230 may have any suitable thickness.

A plurality of rib portions 226 may generally be arranged along the length of the lower plate 230. The rib portions 226 may be arranged such that their lengths extend across at least a portion of the width of the lower plate 230. Each rib portion 226 may have a length of between less than 1 and up to about 3 meters in some embodiments. In some embodiments, the length of each rib portion 226 may be substantially the same as the width of the lower plate 230. Each rib portion 226 may have a width extending upward from the lower plate 230. The width of each rib portion 226 may be between about 200 and about 600 centimeters in some embodiments. In some embodiments, the segment 202 may have a pair of outer ribs 226*b* arranged nearest protruding 206 and receiving 208 ends of the lower plate 230, and one or more inner ribs 226*a* arranged between the two outer ribs. The ribs 226 may generally have any suitable thickness, and in some embodiments, the outer ribs 226*b* may have a greater thickness than the inner ribs 226*a*.

Figure 28:
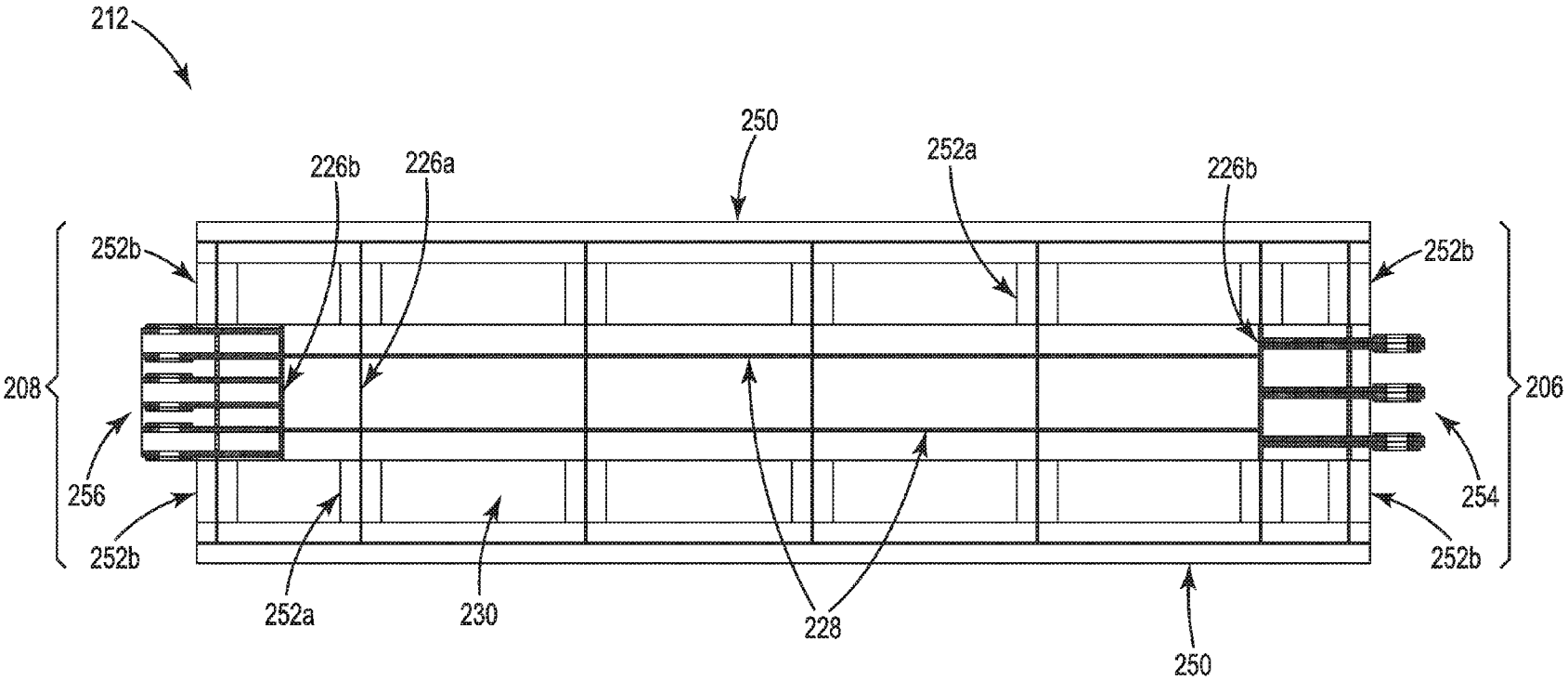

FIG. 28 shows an overhead view of the base layer 212 with inner ribs 226*a* and outer ribs 226*b*. The segment 202 may have any suitable number of rib portions 226. For example, in some embodiments, the segment may have two outer rib portions 226*b*, and three inner rib portions 226*a*. In other embodiments, the segment 202 may have more or fewer outer 226*b* and/or inner 226*a* rib portions. Spacing between adjacent rib portions 226 may vary. Generally, the two outer rib portions 226*b* may be arranged so as to provide support for the connectors 254, 256. Inner rib portions 226*a* may be arranged so as to provide evenly spaced support for upper layers of the segment 202. In some embodiments, a distance of between less than 1 and up to about 2 meters may span between adjacent rib portions 226.

Figure 29A:
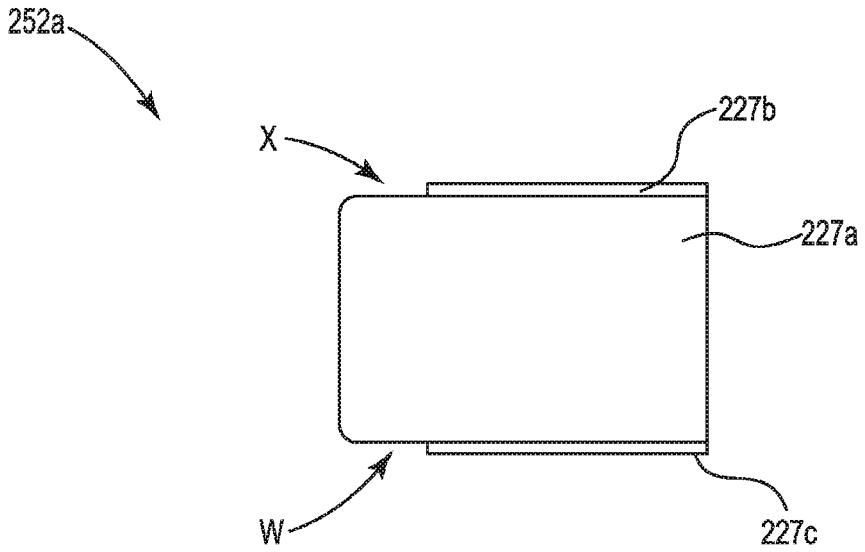
FIG. 29A is a side view of an inner cross beam portion of a rail segment of the present disclosure, according to one or more embodiments.
Figure 29B:
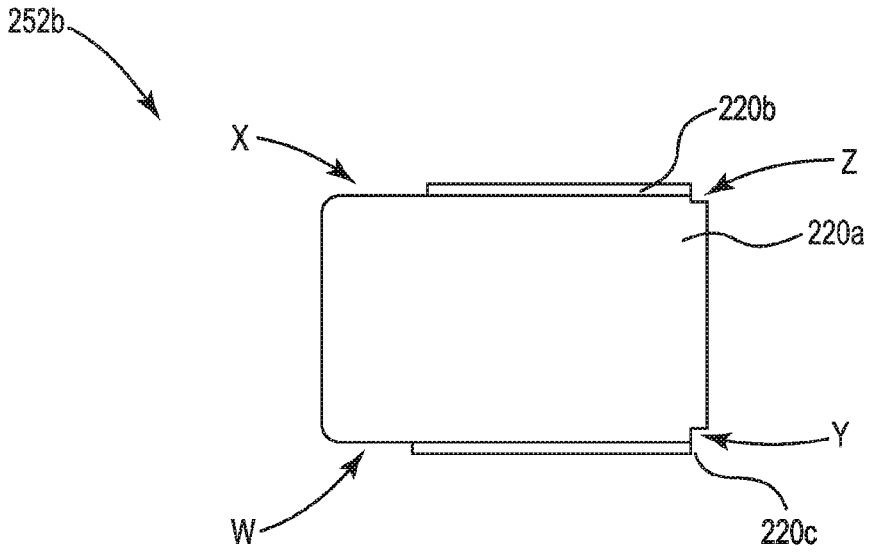
FIG. 29B is a side view of an outer cross beam portion of a rail segment of the present disclosure, according to one or more embodiments.

With continued reference to FIGS. 27A and 28, in some embodiments, a plurality of cross beams portions 252. Inner cross beam portions 252*a* may extend between a rib portion 226 and an outer beam portion 250. Outer cross beam portions 252*b* may extend between connectors 154, 156 and an outer beam portion 150. FIGS. 29A and 29B show an inner cross beam 252*a* and an outer cross beam 252*b*, respectively.

The inner cross beams 252*a* may generally be arranged in pairs, such that an inner cross beam extends from each end of a rib portion 226. In this way, at least some of the rib portions 226 may be arranged between a pair of inner cross beams 252*a*. Each inner cross beam 252*a* may have a length of between about 10 and about 100 centimeters in some embodiments. Generally, the inner cross beams 252*a* may have any length suitable to extend between the rib portions 226 and the outer beam portion 250. Each inner cross beam 252*a* may have a width arranged along a same plane as the width of its rib portion 226 and extending between about 200 and about 600 centimeters in some embodiments. As shown in FIG. 29A, in some embodiments, the inner cross beams 252*a* may have a wide flange shape with a center beam portion 227*a*, upper flange 227*b*, and lower flange 227*c*. In some embodiments, an inner cross beam 252*a* may have one or more notches or cutouts to accommodate the lower plate 230, outer beam portions 250, and/or other components. For example, as shown in FIG. 29A, the inner cross beam 252*a* may have a cutout (W) of the lower flange 227*c* and a cutout (X) of the upper flange 227*b*. The cutouts W, X may be configured to accommodate the outer beam portion 250. That is, for example, where the outer beam portion 250 comprises a similar wide flange shape, as described below, a portion of the flanges 227*b*, 227*c* of the inner cross beam 252*a* may be cut out to allow the center portion 227*a* to be positioned under the flanges of the outer beam portion 250. In other embodiments, one or more inner cross beams 252*a* may have different cutouts or notches to accommodate other components. Further, in still other embodiments, one or more inner cross beams 252*a* may have a different shape, such as a flat bar shape or channel or other beam shape.

Similarly, the outer cross beams 252*b* may generally be arranged in pairs, such that an outer cross beam extends from each side of a connector 254, 256. Each outer cross beam 252*b* may extend between a connector 254, 256 and an outer beam portion 250. Each outer cross beam 252*b* may have a length of between about 10 and about 100 centimeters in some embodiments. Generally, the outer cross beams 252*b* may have any length suitable to extend between the connector 254, 256 and the outer beam portion 250. Each outer cross beam 252*b* may have a width parallel to the widths of the inner cross beams 252*a* and extending between about 200 and about 600 centimeters in some embodiments. As shown in FIG. 29B, in some embodiments, the outer cross beams 252*b* may have a wide flange shape with a center beam portion 220*a*, upper flange 220*b*, and lower flange 220*c*. Similar to the inner cross beams 252*a*, the outer cross beams 252*b* may have one or more notches or cutouts to accommodate the lower plate 230, outer beam portions 250, and/or other components. For example, as with the inner cross beam 252*a*, the outer cross beams 252*b* may have cutouts (W) and (X) in the lower 220*c* and upper 220*b* flanges for accommodating the outer beam portion 250. Further, in some embodiments, the outer cross beams 252*b* may have a cutout (Y) in the lower flange 220*c* and a cutout (Z) in the upper flange 220*b*, so as to accommodate positioning around the lower plate 230 and first intermediary layer 214. Specifically, the center portion 220*a* may be configured to abut the connector 254, 256, while the lower flange 220*c* abuts the lower plate 230, and the upper flange 220*b* abuts the first intermediary layer 214. In other embodiments, one or more outer cross beams 252*b* may have different cutouts or notches to accommodate other components. Further, in still other embodiments, one or more outer cross beams 252*b* may have a different shape, such as a wide flange, channel, or other beam shape.

With continued reference to FIG. 27A, the base layer 212 may additionally have a plurality of internal panels 228 arranged between the ribs 126. For example, an internal panel 228 may extend between two adjacent ribs 226. The internal panels 228 may be arranged in two rows, such that two internal panels extend between each adjacent pair of ribs 226. The length of the internal panels 228 may be generally perpendicular to the lengths of the rib portions 226. The width of the internal panels 228 may extend upward from the lower plate 230. Each internal panel 228 may have any suitable length, and may generally have a length configured to be arranged between two adjacent rib portions 226. For example, in some embodiments, each internal panel 228 may have a length of between less than 1 and up to about 3 meters. It may be appreciated that the internal panels 228 may have differing lengths. For example, as shown in FIG. 26A, panels extending from an outer rib 226*b* nearest the receiving connector 256 may have a shorter length than other panels, to accommodate spacing between the ribs. Each internal panel 228 may have any suitable width. For example, in some embodiments, each internal panel 228 may have a width of between about 10 and about 100 centimeters. The internal panels 228 may generally help to stabilize the base layer 212 and/or support other layers.

With continued reference to FIG. 27A, the base layer 212 may additionally have a pair of outer beam portions 250 arranged along two edges of the base layer, extending between the protruding end 206 and receiving end 208. Each outer beam portion 250 may have a length extending the length or a substantial portion of the length of the segment 202. For example, the outer beam portion 250 may have a length of between about 3 to about 20 meters in some embodiments. Particularly, the outer beam portion 250 may have a length of between about 5 and about 15 meters in some embodiments. More particularly, the outer beam portion 250 may have a length of between about 8 and about 10 meters in some embodiments. In some embodiments, the outer beam portions 250 may have a wide flange cross sectional shape. In this way, the flanges of outer beam portion 250 may be configured to fit over or around the cutouts of the cross beams 252, as discussed above, such that an upper surface of the outer beam portion 250 may generally align with an upper surface of the cross beams 252. In other embodiments, the outer beam portions 250 may have any suitable cross sectional shape, such as a channel or other beam shape. In some embodiments, one or more lugs 251 may be arranged on the outer beam portions 250.

Figure 30A:
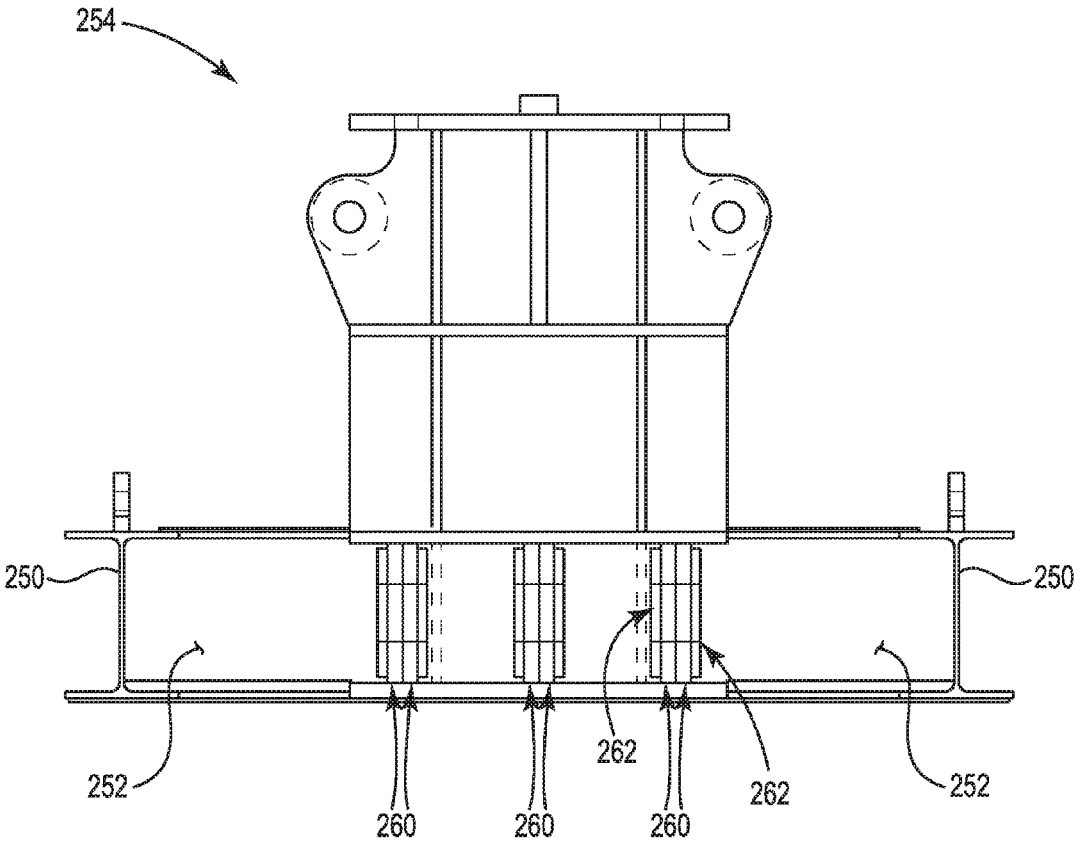
FIG. 30A is an end view of a protruding end of a rail segment of the present disclosure, according to one or more embodiments.
Figure 31A:
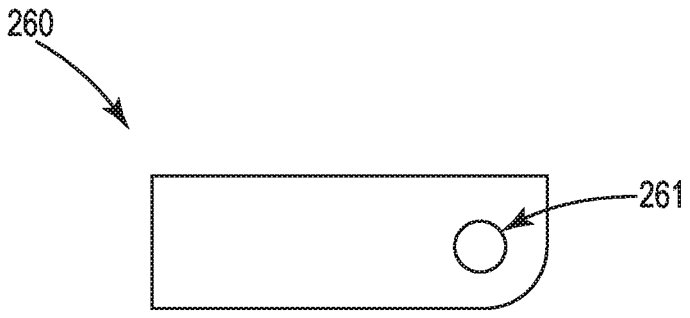
FIG. 31A is a side view of a protruding connector lug of a rail segment of the present disclosure, according to one or more embodiments.

As shown in FIG. 27A, the base layer 212 may have a protruding connector 254 configured to couple to a receiving connector 256 of an adjacent segment 202. The protruding connector 254 may extend from an outer rib portion 226*b*, as shown in the overhead view of FIG. 28. Additionally, FIG. 29A illustrates the protruding connector 254 of segment 202. Generally the protruding connector 254 may be similar to protruding connector 154 of segment 102, as discussed above. That is, as shown in FIGS. 28 and 30A, the protruding connector 254 may have a plurality of lugs 260 extending from a rib 226*b*. The lugs 260 may be arranged in, for example, three pairs, and may generally extend beyond the length of the outer beam portions 250, cross beam portions 252, and/or lower plate 230. FIG. 31A shows a lug 260 of the protruding connector 254. The lug 260 may have any suitable length, width, and thickness, and generally may be sized such that it may extend beyond the edge of the lower plate 230 so as to couple to the receiving connector 256 of an adjacent segment 202. Each lug 260 may have an opening 261 configured to receive a bolt, pin, or other device. As additionally shown in FIGS. 28 and 30A, each pair of lugs 260 may be surrounded by a pair of donuts 262. Additionally, in some embodiments, spacers may be arranged between the pairs of lugs 260 and/or between pairs of lugs and outer cross beam portions 252*b*, as shown in FIG. 28.

Figure 30B:
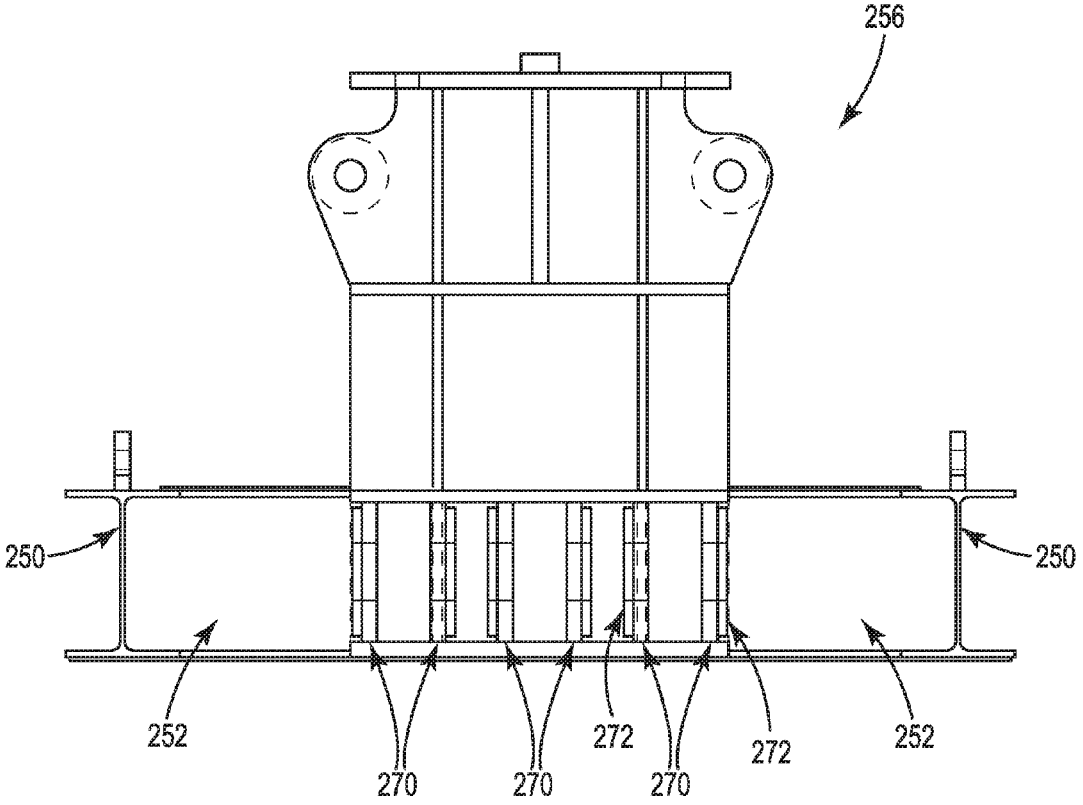
FIG. 30B is an end view of a receiving end of a rail segment of the present disclosure, according to one or more embodiments.
Figure 31B:
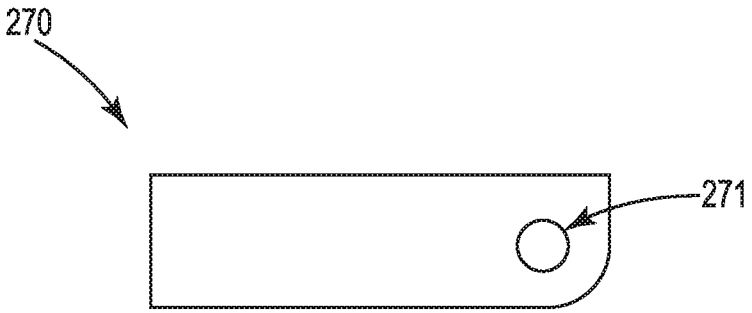
FIG. 31B is a side view of a receiving connector lug of a rail segment of the present disclosure, according to one or more embodiments.

With continued reference to FIG. 28, the receiving connector 256 may be configured to couple to a protruding connector 254 of an adjacent segment 202. Additionally, FIG. 30B shows a receiving connector 256 of a segment 202. The receiving connector 256 may extend from an outer rib portion 226*b*. Generally, the receiving connector 256 may be similar to receiving connector 156 of segment 102, discussed above. That is, as shown in FIGS. 28 and 30B, the receiving connector 256 may have a plurality of lugs 270 extending from a rib 226*b*. The lugs 270 may be spaced so as to receive a pair of lugs 260 between each corresponding pair of lugs 270. The lugs 270 may extend from a rib portion 226*b* and may be arranged on the lower plate 230. In some embodiments, an edge of the lugs 270 may be generally flush with an edge of the lower plate 230. As shown in FIG. 30B, the lugs 270 may be arranged such that they extend beyond the first and second intermediate layers 214, 216. In this way, the lugs 270 may be clear to receive lugs 260. FIG. 31B shows a lug 270 of the receiving connector 256. The lug 270 may have any suitable length, width, and thickness, and generally may be sized such that it may extend beyond the first and second intermediate layers 214, 216 so as to couple to the protruding connector 254 of an adjacent segment 202. The lug 270 may have an opening 271 configured to receive a bolt, pin, or other device. As additionally shown in FIG. 30B, each lug 270 may have at least one donut 272 arranged over the opening 271. Additionally, in some embodiments, spacers 274 may be arranged between the lugs 270, as shown in FIG. 28.

Figure 27B:
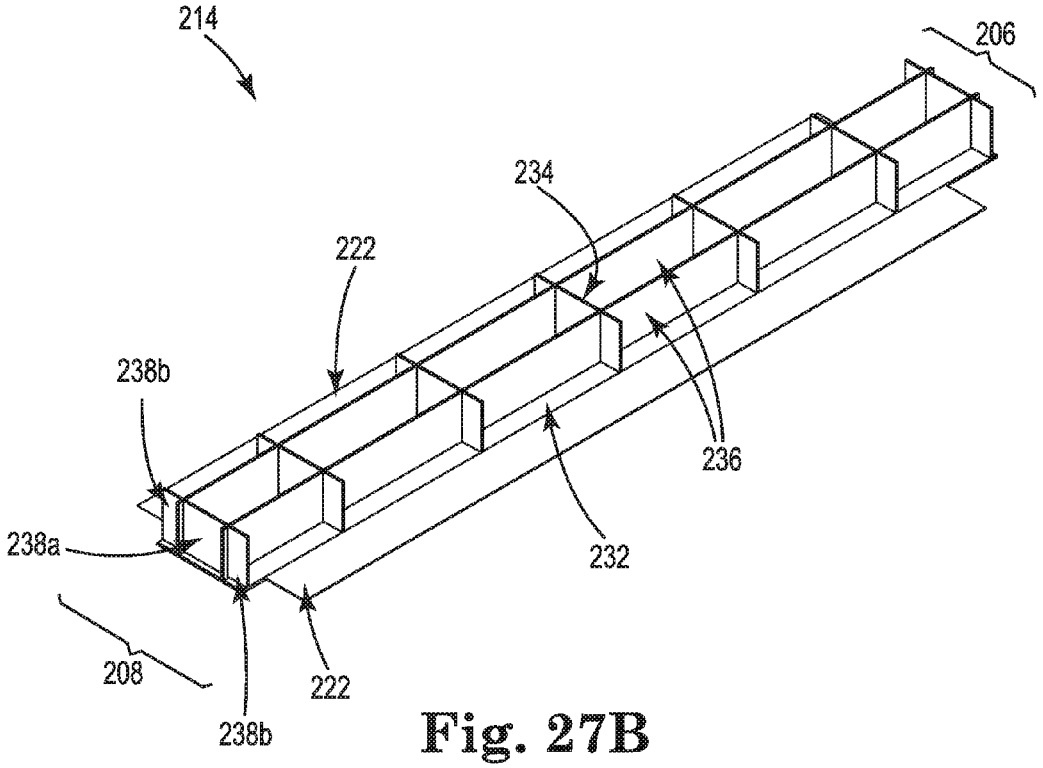
FIG. 27B is an exploded view of a first intermediary layer of a rail segment of the present disclosure according to one or more embodiments.

Referring now to FIG. 27B, the first intermediary layer 214 may be arranged atop or generally over to the base layer 212. The first intermediary layer 214 may have a base plate portion 232, a plurality of rib portions 234, a plurality of internal plate portions 236, a pair of end caps 238, and a pair of cover plates 222.

The base plate portion 232 may have an elongated shape, extending the length or a substantial portion of the length of the segment 202. For example, the base plate 232 may have a length of between about 3 to about 20 meters in some embodiments. Particularly, the base plate 232 may have a length of between about 5 and about 15 meters in some embodiments. More particularly, the base plate 232 may have a length of between about 8 and about 10 meters in some embodiments. The base plate 232 may be configured to be arranged over the rib portions 226 and internal panels 228 of the base layer 212. In some embodiments, the width of the base plate 232 may extend between upper flanges inner cross beams 252*a*, for example. The base plate 232 may be aligned with a longitudinal axis of the segment 202 in some embodiments The base plate 232 may have a width of between about 50 and about 200 centimeters. Particularly, the base plate 232 may have a width of between about 75 and about 125 centimeters in some embodiments. The base plate 232 may have any suitable thickness. It may be appreciated that in some embodiments, the baseplate 232 may have substantially similar dimensions to lower plate 230.

Figure 32:
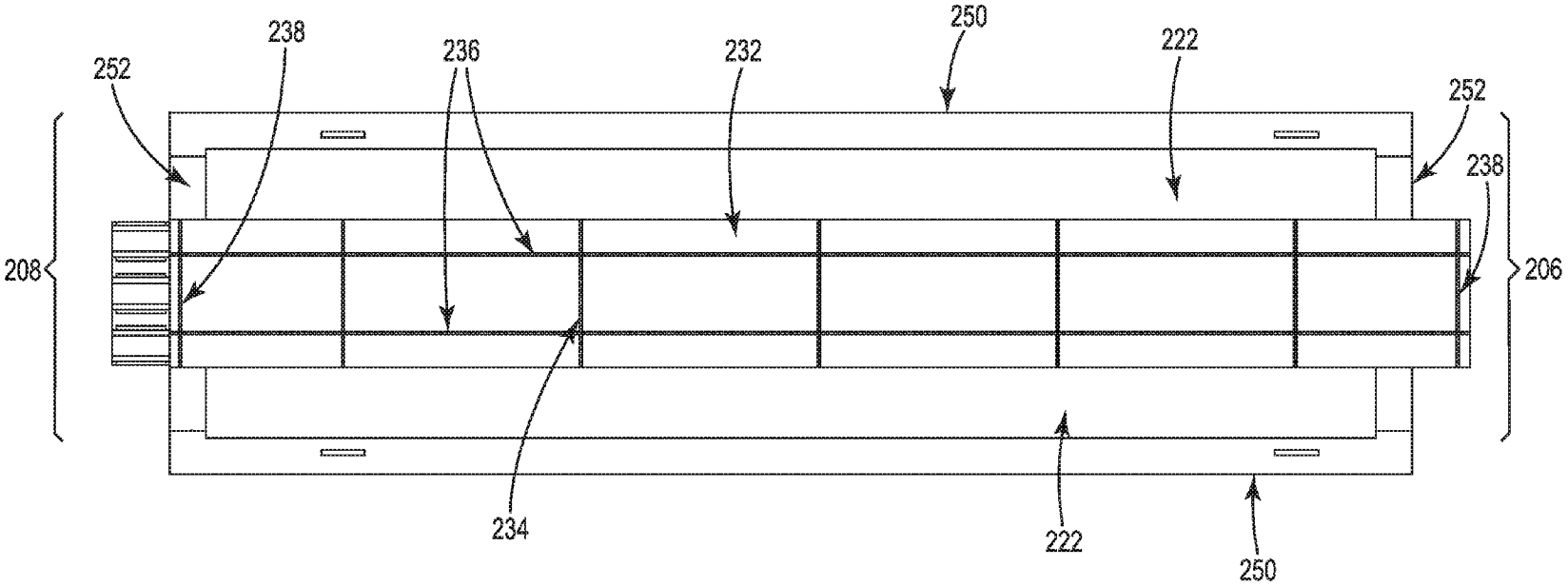
FIG. 32 is an overhead view of a base layer and a first intermediary layer of a rail segment of the present disclosure, according to one or more embodiments.

A plurality of rib portions 234 may be arranged on the base plate 232. The rib portions 234 may be arranged such that their lengths extend across at least a portion of the width of the base plate 232. Each rib portion 234 may have a length of between less than 1 and up to about 3 meters in some embodiments. In some embodiments, the length of each rib portion 234 may be substantially the same as the width of the base plate 232. Moreover, in some embodiments, the rib portions 234 may have substantially similar lengths as rib portions 226. Each rib portion 234 may have a width extending upward from the base plate 232. The width of each rib portion 234 may be between about 30 and about 70 centimeters in some embodiments. The ribs 234 may generally have any suitable thickness. FIG. 32 shows an overhead view of the first intermediary layer 214 arranged over the base layer 212. The segment 202 may have any suitable number of rib portions 234. For example, in some embodiments, the segment 202 may have 5 ribs 234. In other embodiments, the segment 202 may have more or fewer ribs 234. Spacing between adjacent rib portions 226 may vary. In some embodiments, a distance of between less than 1 and up to about 2 meters may span between adjacent rib portions 234. In some embodiments, the ribs 234 may be spaced so as to align with at least some of the rib portions 226 below.

With continued reference to FIG. 27B, the first intermediary layer 214 may additionally have a plurality of internal panels 236 arranged between the ribs 234. For example, an internal panel 236 may extend between two adjacent ribs 234. The internal panels 236 may be arranged in two rows, such that two internal panels extend between each adjacent pair of ribs 234. The length of the internal panels 236 may be generally perpendicular to the lengths of the rib portions 234. The width of the internal panels 236 may extend upward from the base plate 232. Each internal panel 236 may have any suitable length, and may generally have a length configured to be arranged between two adjacent rib portions 234. For example in some embodiments, each internal panel 236 may have a length of between less than 1 and up to about 3 meters. It may be appreciated that the internal panels 236 may have differing lengths. For example, end panels nearest the protruding 206 and receiving 208 ends of the base plate 232 may have a shorter length than other internal panels. In some embodiments, at least some of the internal panels 236 may have lengths substantially similar to internal panels 228 below. In this way, internal panels 236 of the first intermediary layer 214 may be configured to align with at least some of the internal panels 228 of the base layer 212. Each internal panel 236 may have any suitable width. For example, in some embodiments, each internal panel 236 may have a width of between about 30 and about 70 centimeters. The internal panels 236 may generally help to stabilize the first intermediary layer 214 and/or support other layers.

The first intermediary layer 214 may additionally have a pair of end caps 238 arranged at each of the protruding 206 and receiving 208 ends of the first intermediary layer. Each end cap 238 may be divided into multiple segments, such as three segments, in some embodiments. For example, one segment 238*a* may be arranged between two internal panels 236 at each of a protruding end 206 and receiving end 208 of the base plate 232. Additionally, in some embodiments, a pair of segments 238*b* may be aligned with each segment 238*a* on the base plate 232, and arranged on opposing sides of the internal panels 236, as shown in FIG. 27B. The combined length of the three segments 238*a*, 238*b* may be substantially similar to that of a rib portion 234. Moreover, the end caps 238 may have a width extending from the base plate 232 that may be substantially similar to the width of a rib portion 234. As shown in FIG. 32, the end caps 238 may be configured to align with the spacers of the protruding 254 and receiving 256 connections below.

It may be appreciated that end caps 238*a*, 238*b* may be recessed or inset at the ends of the base plate 232 and internal panels 236, such that the ends of the base plate and internal panels extend outward beyond the end caps. This may be seen, for example, in FIGS. 26A and 26B. Recessed or inset end caps 238*a*, 238*b* may allow for the ends caps to be coupled to the first intermediary layer 214 by fillet welds in some embodiments, which may provide for faster and/or easier assembly. However, in other embodiments, the end caps 238*a*, 238*b* may be arranged flush with the ends of the base plate 232 and internal panels 236, or may be sized so as to be arranged over the ends of the base plate and internal panels.

The first intermediary layer may additionally have a pair of cover plates 222. Each cover plate 222 may extend from the base plate 232. The cover plate 222 may have an elongated shape and may be generally arranged over adjacent inner cross beam portions 252*a*. The cover plate 222 may generally be configured to provide a protective cover over internal portions of the base layer 212 structure that may extend beyond the width of the first intermediary layer 214, as shown for example in FIGS. 26A and 26B. In some embodiments, each cover plate 222 may additionally be arranged over at least a portion of the outer cross beam portions 252*b* at each end of the segment 202 and/or may be arranged over at least a portion of an outer beam portion 250. Each cover plate 222 may have a length configured to be arranged between two outer cross beam portions 252*b*. For example, in some embodiments, each cover plate 222 may have a length of between about 3 and about 20 meters. Further, each cover plate 222 may have a width configured to extend between the base plate 232 and the outer beam portion 250. For example, each cover plate 222 may have a width of between about 10 and about 100 centimeters in some embodiments. In other embodiments, each cover plate 222 may have any suitable length and width. Each cover plate 222 may further have any suitable thickness.

Figure 27C:
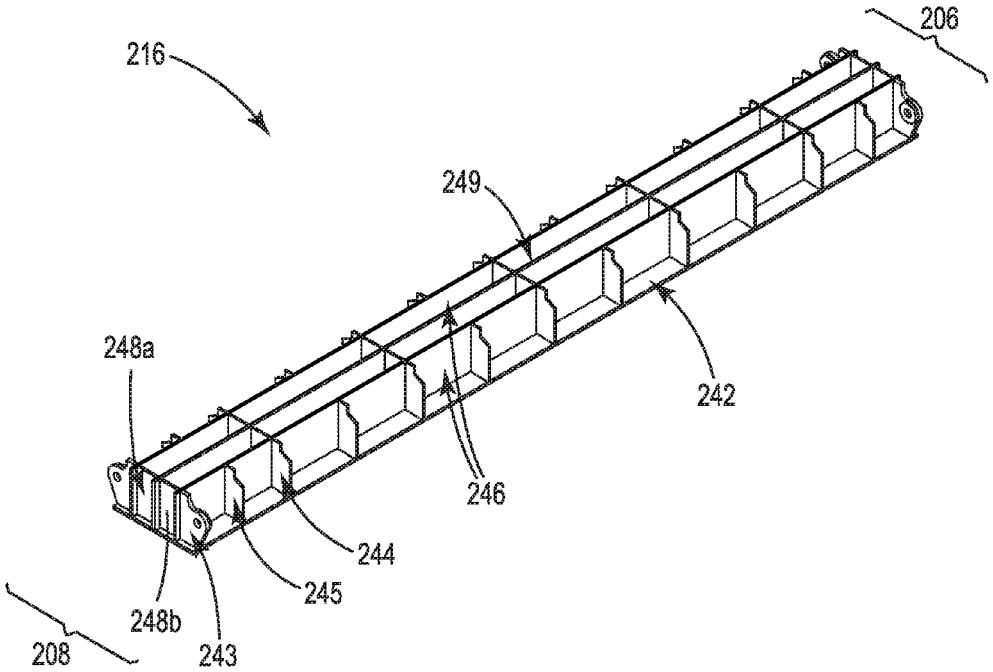
FIG. 27C is an exploded view of a second intermediary layer of a rail segment of the present disclosure, according to one or more embodiments.

Referring now to FIG. 27C, the second intermediary layer 216 may be arranged atop or generally over the first intermediary layer 214. The second intermediary layer 216 may have a base plate portion 242, a spine portion 249, plurality of rib portions 244, a plurality of internal plate portions 246, a plurality of roller assembly supports 245, a pair of end caps 248, and a plurality of upper lugs 243.

The base plate portion 242 may have an elongated shape, extending the length or a substantial portion of the length of the segment 202. For example, the base plate 242 may have a length of between about 3 to about 20 meters in some embodiments. Particularly, the base plate 242 may have a length of between about 5 and about 15 meters in some embodiments. More particularly, the base plate 242 may have a length of between about 8 and about 10 meters in some embodiments. The base plate 242 may be configured to be arranged over the rib portions 234 and internal panels 236 of the first intermediary layer 214. The base plate 242 may be aligned with a longitudinal axis of the segment 202 in some embodiments. The base plate 232 may have a width of between about 50 and about 200 centimeters. Particularly, the base plate 242 may have a width of between about 75 and about 125 centimeters in some embodiments. The base plate 242 may have any suitable thickness. It may be appreciated that in some embodiments, the baseplate 242 may have substantially similar dimensions to base plate 232.

A spine portion 249 may be arranged down a longitudinal axis of the base plate 242. The spine portion may have a length extending the length of the base plate 242, and a width extending upward from the base plate. The spine portion 249 may have any suitable thickness.

Figure 33:
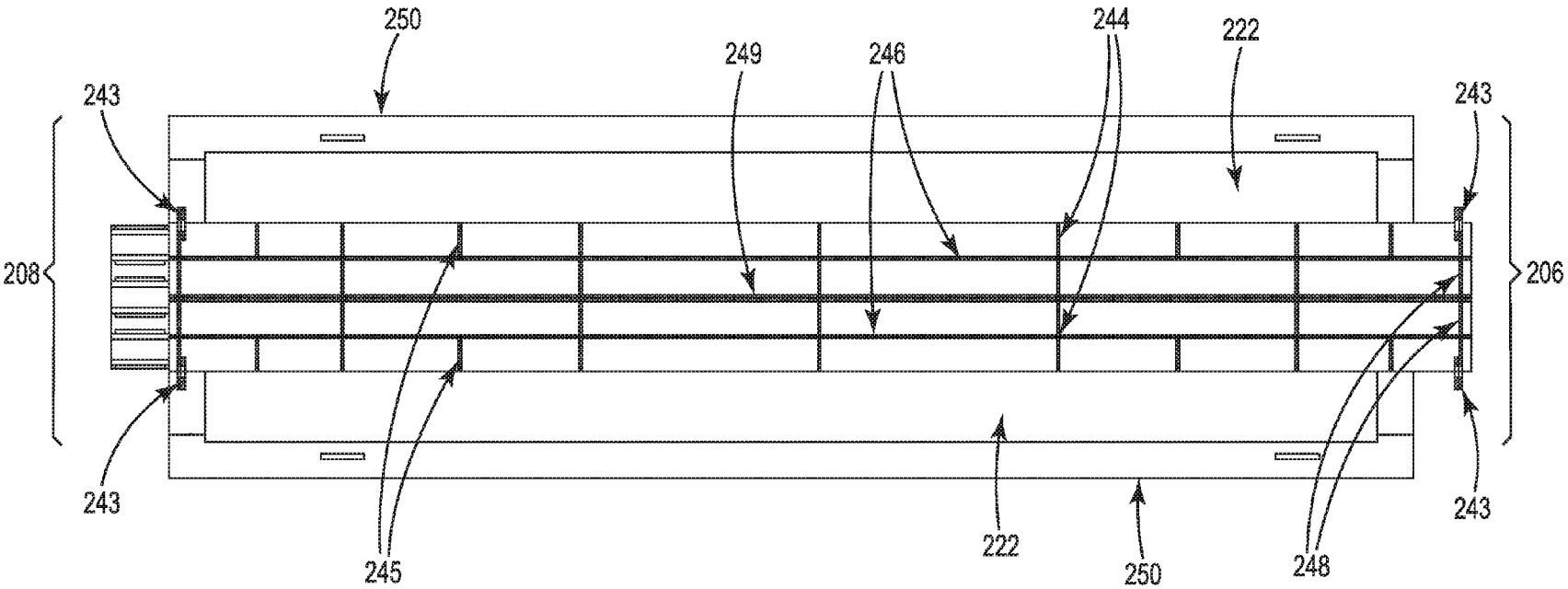
FIG. 33 is an overhead view of a base layer, a first intermediary layer, and a second intermediary layer of a rail segment of the present disclosure, according to one or more embodiments
Figure 34A:
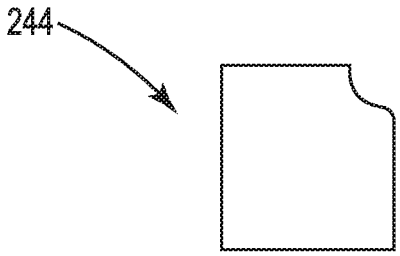
FIG. 34A is a side view of a rib portion of a rail segment of the present disclosure, according to one or more embodiments.

A plurality of rib portions 244 may be arranged on the base plate 242 and may extend from the spine portion 249. It may be appreciated that the rib portions 244 may be arranged in pairs, such that two rib portions 244 arranged on either side of the spine portion 249 align with one another. Each rib portion 244 may have a length of between about 10 and about 100 centimeters in some embodiments. In some embodiments, the combined length of each aligned pair of rib portions 244 may be substantially similar to the lengths of rib portions 234. Each rib portion 244 may have a width extending upward from the base plate 242. The width of each rib portion 244 may be between about 30 and about 70 centimeters in some embodiments. The ribs 244 may generally have any suitable thickness. FIG. 33 shows an overhead view of the second intermediary layer 216 arranged over the first intermediary layer 214 and base layer 212. The segment 202 may have any suitable number of rib portions 244. For example, in some embodiments, the segment 202 may have 5 pairs of ribs 244. In other embodiments, the segment 202 may have more or fewer ribs 244. Spacing between adjacent pairs of ribs 244 may vary. In some embodiments, a distance of between less than 1 and up to about 2 meters may span between adjacent ribs 244 on a same side of the spine portion 249. In some embodiments, the ribs 244 may be spaced so as to align with at least some of the rib portions 234 below. FIG. 34A shows a side view of a rib portion 244, according to some embodiments. As shown in FIG. 34A, in some embodiments, one or more rib portions 244 may have a notch or cutout on an upper surface.

With continued reference to FIG. 27C, the second intermediary layer 216 may additionally have a plurality of internal panels 246 arranged between the ribs 244. For example, an internal panel 246 may extend between two adjacent ribs 244. The internal panels 246 may be arranged in two rows parallel to the spine portion 249, with one row arranged on either side of the spine portion. The length of the internal panels 246 may be generally perpendicular to the lengths of the rib portions 244. The width of the internal panels 246 may extend upward from the base plate 242. Each internal panel 246 may have any suitable length, and may generally have a length configured to be arranged between two adjacent rib portions 244. For example in some embodiments, each internal panel 246 may have a length of between less than 1 and up to about 3 meters. It may be appreciated that the internal panels 246 may have differing lengths. For example, end panels nearest the protruding 206 and receiving 208 ends of the base plate 242 may have a shorter length than other internal panels. In some embodiments, at least some of the internal panels 246 may have lengths substantially similar to internal panels 236 below. In this way, internal panels 246 of the second intermediary layer 216 may be configured to align with at least some of the internal panels 236 of the first intermediary layer 214. Each internal panel 246 may have any suitable width. For example, in some embodiments, each internal panel 246 may have a width of between about 30 and about 70 centimeters. The internal panels 246 may generally help to stabilize the second intermediary layer 216 and/or support the roller assembly guide 218.

Figure 34B:
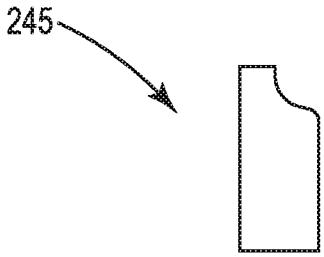
FIG. 34B is a side view of a rail assembly support of a rail segment of the present disclosure, according to one or more embodiments.

As additionally shown in FIG. 27C, the second intermediary layer 216 may have a plurality of roller assembly supports 245. A roller assembly support 245 may extend outward from each internal panel 246, for example. The length of the roller assembly supports 245 may generally extend between the base plate 242 and the roller assembly guide 218. The roller assembly supports 245 may generally be configured to provide additional support to the roller assembly guide 218. Any suitable number of roller assembly supports 245 may be arranged along the length of each internal panel 246. As shown in FIG. 33, a roller assembly support may generally extend from at or near the longitudinal center of each internal panel 246. FIG. 34B illustrates a side view of a roller assembly support 245 according to some embodiments. As shown, the roller assembly supports 245 may have a similar shape to the rib portions 244 with a notch or cutout in an upper surface.

The second intermediary layer 216 may additionally have a pair of end caps 248 arranged at each of the protruding 206 and receiving 208 ends of the second intermediary layer. Each end cap 248 may be divided into multiple segments, such as two segments, in some embodiments. The two segments 248*a*, 248*b* may be aligned and arranged on opposing sides of the spine portion 249 at each of a protruding end 206 and receiving end 208 of the base plate 242. The combined length of each segment 248*a*, 248*b* may generally be configured to extend between an internal panel 246 and the spine portion 249. Moreover, the end caps 248 may have a width extending from the base plate 242 that may be substantially similar to the width of a rib portion 244. As shown in FIG. 33, the end caps 248 may be configured to align with the spacers of the protruding 254 and receiving 256 connectors below.

It may be appreciated that end caps 248*a*, 248*b* may be recessed or inset at the ends of the base plate 242 and internal panels 246, such that the ends of the base plate and internal panels extend outward beyond the end caps. Recessed or inset end caps 248*a*, 248*b* may allow for the ends caps to be coupled to the second intermediary layer 216 by fillet welds in some embodiments, which may provide for faster and/or easier assembly. However, in other embodiments, the end caps 248*a*, 248*b* may be arranged flush with the ends of the base plate 242 and internal panels 246, or may be sized so as to be arranged over the ends of the base plate and internal panels.

As additionally shown in FIG. 27C, a pair of upper lugs 243 may be arranged at each end 206, 208 of the second intermediary layer 216. Particularly, an upper lug 243 may extend from an internal panel 246 on each side of the spine portion 249 at each of the protruding 206 and receiving 208 ends. The upper lugs 243 may have any suitable shape and thickness. The upper lugs 243 may be sized and arranged such that when two segments 202 are coupled together via opposing protruding and receiving connectors 254, 256, the upper lugs of the opposing segments may be aligned. Each upper lug 243 may have an opening configured to receive a bolt, pin, or other device. As additionally shown in FIG. 27C, each upper lug 143 may have at least one donut arranged about the opening.

Figure 27D:
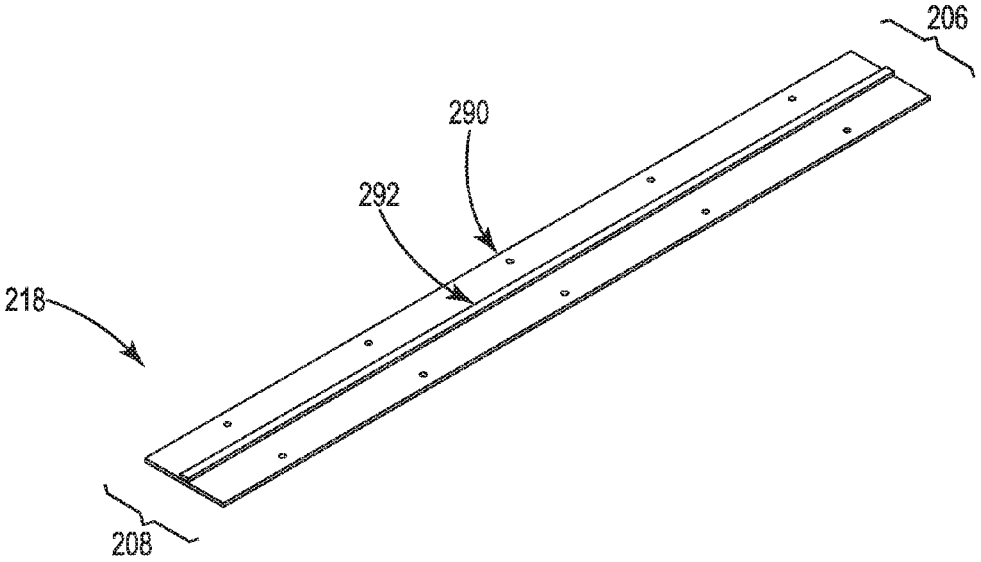
FIG. 27D is a perspective view of a rail assembly guide of a rail segment of FIG. 28 is an overhead view of a base layer of a rail segment of the present disclosure, according to one or more embodiments.

Referring now to FIG. 27D, the roller assembly guide 218 may be arranged atop or generally over the second intermediary layer 216. The roller assembly guide 218 may extend over the segment 202 to allow a drilling rig to roll over or be positioned on the segment. As shown in FIG. 27D, the roller assembly guide 218 may include a plate portion 290 and a rail portion 292. Together, the plate portion 290 and rail portion 292 may operate to position a roller assembly of a drilling rig on the rail segment 202.

Figure 35:
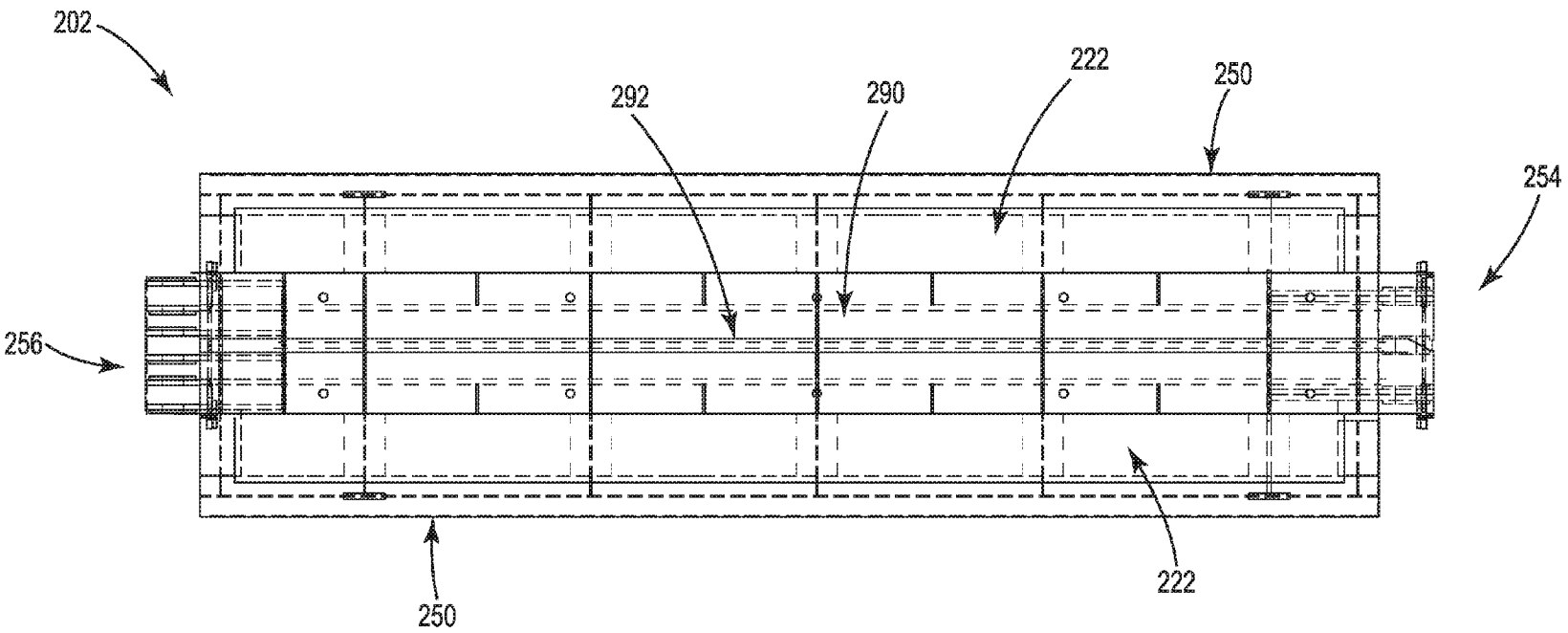
FIG. 35 is an overhead internal view of a rail segment of the present disclosure, according to one or more embodiments.

The plate portion 290 may have an elongated shape, extending the length or a substantial portion of the length of the segment 202. For example, the plate portion 290 may have a length of between about 3 to about 20 meters in some embodiments. Particularly, the plate portion 290 may have a length of between about 5 and about 15 meters in some embodiments. More particularly, the plate portion 290 may have a length of between about 8 and about 10 meters in some embodiments. The plate portion 290 may generally be arranged over and aligned with a longitudinal axis of the second intermediary layer 216, as shown for example in FIG. 35. The plate portion 290 may have any suitable width to accommodate a rail assembly of a drilling rig. For example, in some embodiments, the plate portion 290 may have a width of between about 50 and about 200 centimeters. Particularly, the plate portion 290 may have a width of between about 75 and about 125 centimeters in some embodiments. The plate portion 290 may have any suitable thickness.

The rail portion 292 may be a notch extending from the plate portion 290 and may be configured to engage with a groove or other element of a roller assembly, so as to position the roller assembly on the plate portion. The rail portion 292 may be arranged along a longitudinal axis of the plate portion 290. The rail portion 292 may have an elongated shape, and may have any suitable length. In some embodiments, the rail portion 292 may have the same length as the plate portion 290 so as to guide a rail assembly along the length of the plate portion. In other embodiments, the rail portion 292 may have a different length. The rail portion 292 may extend upward from the plate portion 290. In some embodiments, the rail portion 292 may have a height extending from the plate portion 290 of distance of between about 10 and about 200 millimeters. Particularly, the rail portion 292 may have a height extending between about 25 and about 75 millimeters from the plate portion 290 in some embodiments. The rail portion 292 may have a width of between about 5 and about 50 centimeters in some embodiments. Particularly, the rail portion 292 may have a width of between about 5 and about 20 centimeters in some embodiments. Generally, the rail portion 292 may have any suitable width and height suitable for engaging with a rail assembly of a drilling rig.

It may be appreciated that two segments 202 may be coupled together similarly to segments 102, described above. That is, the lugs 270 of a receiving connector 256 may be arranged about the lugs of a protruding connector 254, and a pin, bolt, or other device may be positioned through the openings 261, 261 of the lugs. Moreover, upper lugs 243 on the adjacent segments 202 may be aligned such that a pin or other device may be positioned through the openings to couple the lugs together. The connection may additionally include aligned contact faces surfaces, similar to contact surfaces 196, 198 described above, and configured to abut. Specifically, a contact surface of the segment 202 may include end surfaces of base plates 232, 242, plate portion 290, internal panels 236, 246, and spine portion 249. The contact surface of a receiving end 208 of a first segment 202 may be aligned with and abut the contact surface of a protruding end 206 of a second segment when the segments are coupled together.

The connection formed between adjacent segments 202 by the connectors 254, 256 and upper lugs 243 may be a moment resisting connection, which may transfer at least a portion of loads experienced by one rail segment to adjacent segments. The moment resisting connection may be configured such that, when a force acts on a rail segment 202, the connection between that segment and an adjacent segment comprises both a tension connection and a compression connection. That is, the protruding end 206 and receiving end 208 may be configured such that, in response to loading on the rail, coupled connectors 254, 256 may experience tension forces, while aligned contact surfaces may experience compression forces. The opposing tension and compression forces on the connection may allow bending moments and shear forces to pass from one segment 202 to an adjacent segment through the connection. In this way, when a segment 202 experiences forces from, for example, loading from a drilling rig or wind loading, the forces on the segment may be distributed to adjacent segments via the moment resisting connections. It may be appreciated that such moment resisting connections may mitigate deformation, beam deflection, shearing, or sinking of individual segments 102 due to loading forces.

It may be appreciated that a rail segment 202 of the present disclosure may provide various manufacturing benefits over other rail segment designs. For example, a segment 202 may generally have small components and thus may be assembled without the need for heavy lift cranes or other heavy lift equipment. In some embodiments, a rail segment 202 may be constructed by a manufacturer with less manufacturing experience and may be constructed without a jig.

It may further be appreciated that lateral loading from, for example, wind loading may act differently on different rail segments of the present disclosure. For example, lateral loading may act on triangular support structures 132, 142 with respect to segment 102 described above. However, with respect to segment 202, lateral loading may act on stiffeners 234.

In some embodiments, different rail segments of the present disclosure may be coupled together to form a continuous rail. For example a rail segment 102, as shown in FIGS. 2A and 2B may be coupled with a moment resistant connection to a rail segment 202, as shown in FIGS. 26A and 26B. The protruding connector of one of the two segments 102, 202 may be coupled with the receiving end of the other of the two segments. The connection formed between the two segments may be substantially as described above. That is, the protruding and receiving lugs of the opposing connectors may interlock and may be joined by a shear pin. The two opposing faces may butt against one another, and upper lugs may be coupled together. The resulting connection between the two segments 102, 202 may be a moment resistant connection capable of withstanding internal vertical shear and bending forces. In some embodiments, where two differing segments 102, 202 are coupled, the end caps 138, 148, 238, 248 of the two segments may be arranged such that they are not recessed. That is, for example, end caps 138 and 148 of segment 102 may be flush with or arranged over the ends of the triangular support structures 132, 142. Similarly, the end caps 238, 248 of segment 202 may be flush with or arranged over the ends of the base plates 232, 242 and internal panels 236, 246. Flush or covering end caps of the two segments 102, 202 may allow the segments to have abutting contact surfaces despite their differing cross sectional shapes and/or geometries.

Figure 38A:
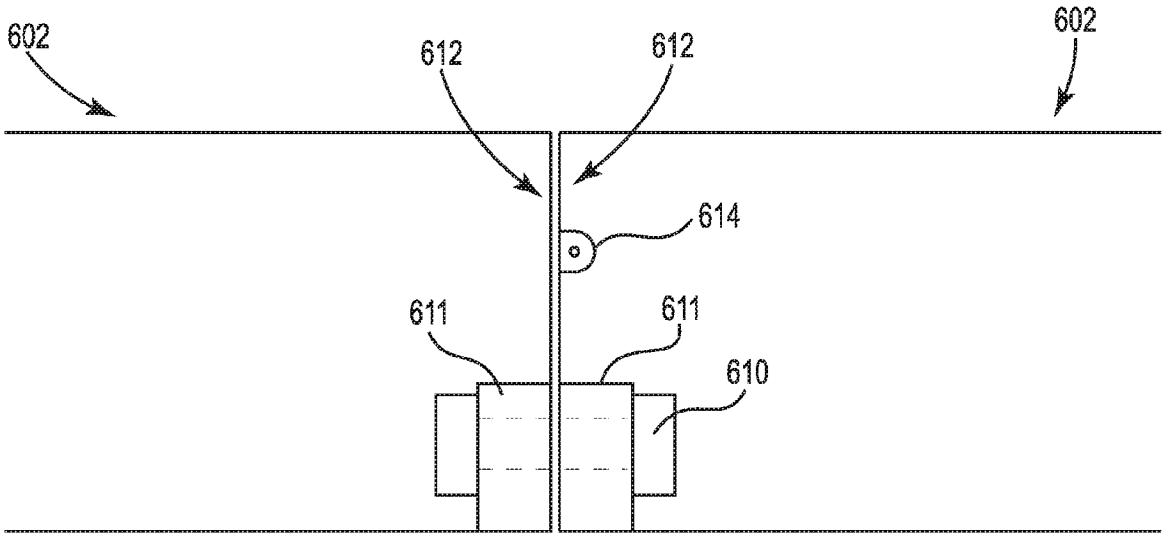
FIG. 38A is a side view of two segments coupled with a barbell connector of the present disclosure, according to one or more embodiments.
Figure 38B:
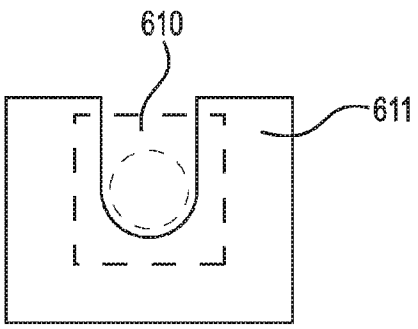
FIG. 38B is a cross sectional view the barbell connector of FIG. 38A, according to one or more embodiments.
Figure 39:
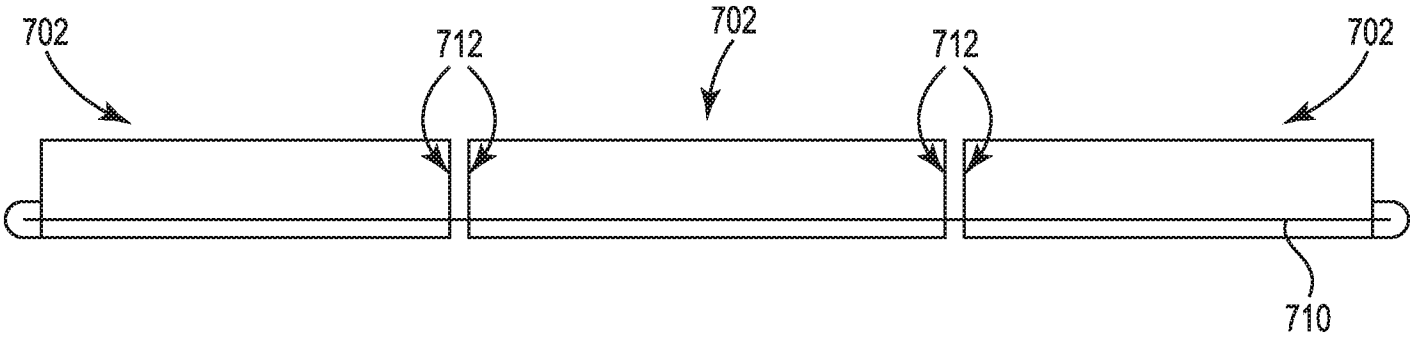
FIG. 39 is a side view of three segments coupled together with a cable connector of the present disclosure, according to one or more embodiments.

Further, in some embodiments, rail segments of the present disclosure may be coupled together with various mechanisms to form moment resistant connections. For example, instead of or in addition to the interlocking lug and pin connectors described above, adjacent segments may have a bolted connection in tension or in shear, or a pipe and hook mechanism. That is, for example, two adjacent segments may form a moment resistant connection via the bolted connection or pipe and hook mechanism, in combination with opposing abutment faces and upper lugs, as described above. In other embodiments, the interlocking lugs and pin may be replaced with or supplemented with a barbell connector. As shown for example in FIG. 38A, a barbell-shaped connector 610 may extend between two adjacent segments 602 to couple the segments together. The barbell connector 610 may be arranged on a lower portion of the segments 602, nearest the ground surface, and may be configured to be in tension while upper abutment faces 612 experience compression forces, so as to resist bending moment forces. As shown in the cross sectional view of FIG. 38B, each segment 602 may have a U-shaped slot 611 or other receiving component sized and configured for receiving the barbell connector 610. In some embodiments, the barbell connector 610 may be constructed from roundbar steel, or may be constructed from wire rope with wire rope thimbles at each end, for example. The segments 602 may additionally have upper lugs 614, as shown in FIG. 38A, to resist vertical shear. In some embodiments, a tensioned cable or cables may couple two or more segments together, as shown for example in FIG. 39. For example, a cable 710 or cables may be passed through multiple aligned segments 702 and tightened at the ends of the outermost segments. The cable 710 may be arranged on a lower portion of the segments 702, nearest the ground surface, and may be configured to be in tension while upper abutment faces 712 experience compression forces, so as to resist bending moment forces. The cable 710 may be pre-tensioned via one or more turnbuckles in some embodiments. The segments 702 may additionally have upper lugs 714 to resist vertical shear.

Figure 36:
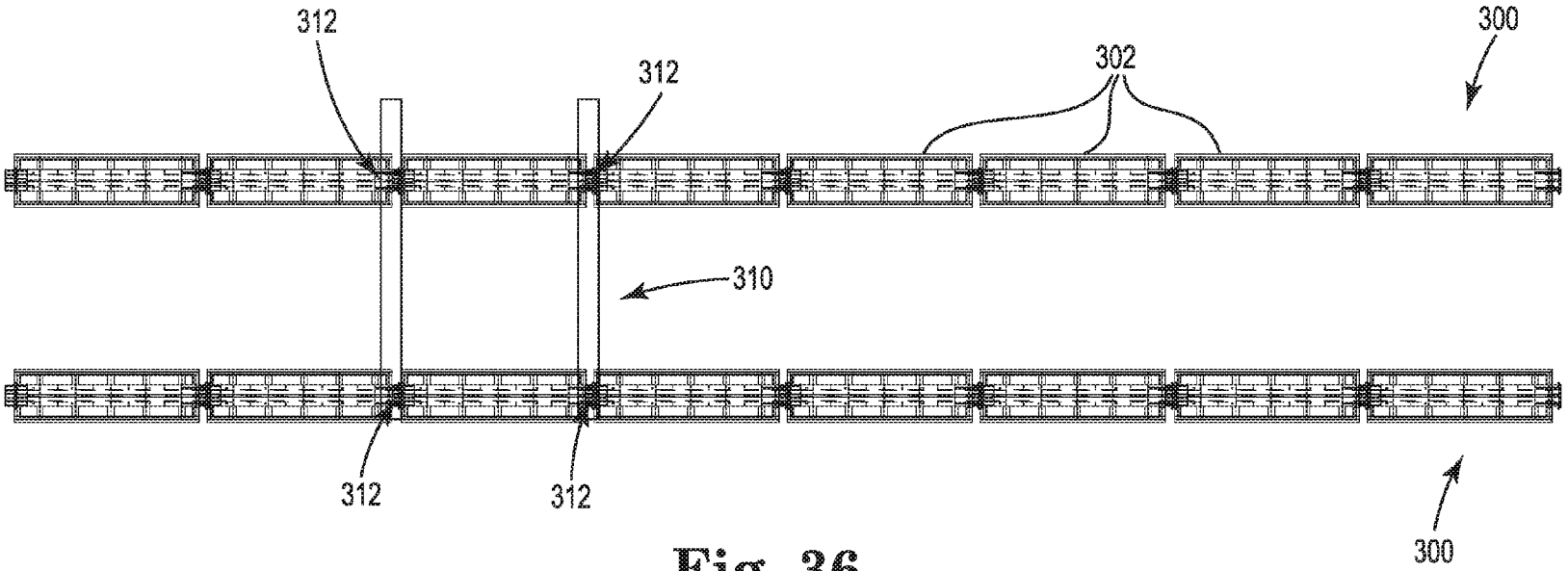
FIG. 36 is an overhead view of a drilling rig arranged on a pair of rails of the present disclosure, according to one or more embodiments.

FIG. 36 shows a drilling rig 310 arranged on a pair of rails 300, each rail having a series of segments 302. The segments 302 may be coupled using the moment resistant connections 304 described above. As shown, the drilling rig 310 may contact each rail 310 via two contact points, such as roller assemblies 312. In other embodiments, the drilling rig 310 may have any suitable number of contact points, such as 1, 3, or 4 contact points for example, on each rail 300. The drilling rig 310 may act on the rails 300 with a load of up to, for example, about 1000 kips at each roller assembly 312 in some embodiments. In other embodiments, the drilling rig 310 may act with higher or lower loading on the rails 300. Additionally, lateral forces orthogonal to the direction of the rails 300, such as wind loading, may act on the drilling rig 310 with a force of, for example, up to 80 kips at each roller assembly 312. Lateral forces may be higher or lower in other embodiments. The loading from the drilling rig 310 and lateral loading may act on any two points along each rail 300 via the two roller assemblies 312. The forces acting on each rail 300 may cause shear and bending moment forces on each rail segment 302. The forces acting on each rail 300 may additionally cause a tendency for rail segments to bend or deflect. The moment resisting connections 304 may provide for distribution of the shear and bending forces to adjacent segments 302. That is, in some embodiments for example, the forces acting through the two roller assemblies 312 on a rail 300 may be distributed through at least three adjacent segments 302. Additionally, distribution of forces to multiple connected segments may provide for a reduced ground reaction force on each segment, thus reducing a potential for beam deflection of the segments. Additionally, the moment of inertia of the segments 302 may be capable of resisting or mitigating deflection.

It may be appreciated that a rail of the present disclosure may be capable of supporting up to a 1000 kip point load with 45 degree wind loading in some embodiments. Moreover, a rail of the present disclosure may be capable of supporting up to two 750 kip loads with 90 degree wind loading in some embodiments. In other embodiments, the rails may be configured for different, including higher, point loads and wind loading. The moment resistant connections between rail segments, as described herein, may allow such point and wind loads acting on a rail segment to be distributed to adjacent rail segments. The loading may thus be transferred to the ground surface, or other surface on which the rails are positioned, without exceeding design requirements for particular ground pressure. That is, for example, a point load arranged on a single segment may be transferred to at least two adjacent segments, coupled to each end of the segment experiencing the point load. Where each segment is, for example, approximately 9 meters in length, the point load may thus be transferred to the ground through a bridge of three segments, extending approximately 27 meters in length. Moment and shear forces may be distributed among the 27 meter length. Each moment resistant connection between the segments may be configured to withstand tensions and compression loads of up to, for example, approximately 2,700 kips. In other embodiments, the moment resistant connections between segments may be configured to withstand larger tension and compression loads. Such distribution of internal shear and bending forces to adjacent rail segments may mitigate deformation, beam deflection, shearing, or sinking of individual segments 102 due to loading forces. Moreover, in addition to having moment resistant connections, a rail segment of the present disclosure may have a moment of inertia capable of resisting deflection. As described above, a rail segment of the present disclosure may have a moment of inertia larger than that of more conventional rail segments. The relatively high moment of inertia of rail segments of the present disclosure may mitigate deflection of the segments.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

The various components, elements, features, and steps described above with respect to various embodiments of the invention are not intended to be limited to the particular embodiment with which they are described. It may be appreciated that components, elements, features, or steps of embodiments described herein may be combined with components, elements, features, or steps of other embodiments. That is, an apparatus, system, method, or process of the present disclosure may include components, elements, features, or steps described above with respect to various different embodiments.

What is claimed is:

1. A system for supporting and transporting a drilling rig, the system comprising:

a pair of rails, each rail comprising a plurality of rail segments and a plurality of connections between the segments, such that each rail comprises a continuous rail system;

wherein each connection comprises:

a plurality of interlocking lugs secured with a shear pin and arranged between a first segment and a second segment of the plurality of rail segments; and an abutment face arranged on an end of the first segment, above or below the plurality of interlocking lugs, and configured to abut an abutment face on an end of the second segment;

such that each connection is configured to transfer moment and shear forces between adjacent rail segments and reduce beam deflection.

2. The system of claim 1, wherein each rail segment is configured to support a point load of at least 1000 kips.

3. The system of claim 1, wherein each rail segment comprises a protruding connector and a receiving connector, and wherein each connection comprises the protruding connector of the first segment and the receiving connector of the second segment.

4. The system of claim 1, wherein a portion of each connection is configured for tension loading and a portion of the connection is configured for compression loading.

5. The system of claim 4, wherein the plurality of interlocking lugs secured with a shear pin are configured for tension loading, such that the tension component of a moment load is transferred between adjacent segments.

6. The system of claim 4, wherein the opposing abutment faces are configured for compression loading, such that the compression component of a moment load is transferred between adjacent segments.

7. The system of claim 1, wherein the connections between segments are configured to transfer vertical shear forces between segments.

8. The system of claim 1, wherein each segment of the plurality of segments has a moment of inertia configured to minimize beam deflection.

9. A rail for supporting and transporting a drilling rig, the rail comprising a plurality of rail segments, each segment comprising:

a base layer comprising:

a protruding connector arranged at a first end of the rail segment and configured to engage a receiving connector of an adjacent rail segment; and a receiving connector arranged at an opposing second end of the rail segment and configured to engage a protruding connector of an adjacent rail segment;

a roller assembly guide configured to engage with one or more rollers coupled to a drilling rig; and an intermediary layer arranged between the base layer and the rail assembly guide.

10. The rail of claim 9, wherein the intermediary layer is a first intermediary layer, and each segment further comprises a second intermediary layer arranged between the first intermediary layer and the rail assembly guide.

11. The rail of claim 10, wherein each of the first and second intermediary layers comprises at least one support structure having a plurality of inner brackets.

12. The rail of claim 9, wherein each of the protruding connector and the receiving connector comprise a plurality of interlocking lugs.

13. The rail of claim 9, wherein each segment further comprises an abutment face arranged at each of the two ends of the segment, the abutment faces arranged above or below the connectors, each abutment face configured to abut an opposing abutment face of an adjacent rail segment.

14. The rail of claim 9, wherein each segment has a moment of inertia configured to minimize beam deflection.

15. The rail of claim 9, wherein each segment is configured to support a point load of at least 1000 kips.

16. A connection between first and second rail segments of a rail for supporting and transporting a drilling rig, the connection comprising:

a tension connector configured for tension loading, such that the tension component of a moment load is transferred between the two rail segments; and an abutment face arranged on an end of the first segment, above or below the tension connector, and configured to abut an abutment face on an end of the second segment, the opposing abutment faces configured for compression loading, such that the compression component of a moment load is transferred between the two rail segments.

17. The connection of claim 16, wherein the tension connector comprises a plurality of interlocking lugs and a shear pin arranged therethrough.

18. The connection of claim 16, wherein the tension connector comprises a barbell connector.

19. The connection of claim 16, wherein the tension connector comprises a protruding connector arranged at the end of the first rail segment, and a receiving connector arranged at the end of the second rail segment.

20. The connection of claim 16, wherein the connection is configured to transfer vertical shear forces between the two segments.

* * * * *